US006298140B1

(12) United States Patent
Manavopoulos

(10) Patent No.: US 6,298,140 B1
(45) Date of Patent: Oct. 2, 2001

(54) ELECTROACOUSTIC TRANSDUCER WITH IMPROVED TONAL QUALITY

(76) Inventor: Christos Manavopoulos, Amarylidos 14 Neos Voutzas, Refina Attika 19009 (GR)

( * ) Notice: Subject to any disclaimer, the term of this patent is extended or adjusted under 35 U.S.C. 154(b) by 0 days.

(21) Appl. No.: 09/252,723

(22) Filed: Feb. 19, 1999

Related U.S. Application Data

(60) Provisional application No. 60/075,368, filed on Feb. 20, 1998.

(51) Int. Cl.[7] ..... H04R 25/00

(52) U.S. Cl. ..... 381/152; 381/162; 381/335; 381/421; 381/431; 181/173

(58) Field of Search ..... 381/152, 190, 381/162, 301, 304, 308, 333, 335, 339, 358, 408, 421, 431; 367/140, 162, 173, 176; 181/173, 199; 310/322, 334, 326

(56) References Cited

U.S. PATENT DOCUMENTS

| | | | | |
|---|---|---|---|---|
| 4,700,396 | * | 10/1987 | Bolin | 381/152 |
| 4,924,504 | * | 5/1990 | Burton | 381/398 |
| 5,119,421 | * | 6/1992 | Reime | 381/301 |
| 5,638,456 | * | 6/1997 | Conley et al. | 381/190 |
| 6,031,926 | * | 2/2000 | Azima et al. | 381/423 |

* cited by examiner

*Primary Examiner*—Curtis Kuntz
*Assistant Examiner*—Suhan Ni

(57) ABSTRACT

An electroacoustic transducer with attenuated effective output irregularities caused by intrinsic normal modes of oscillation. What stands out, as a structural property of a preferred embodiment, is a sandwich assembly, having an oscillating medium of layered components suspended between two rigid baffles, with a hinged baffle extension supporting the device in upright position. An opening, asymmetrically positioned in each of said two rigid baffles, exposes to the ambient medium a driven and asymmetrically positioned antinode belonging to a predetermined mode pattern of the oscillating medium. The resulting asymmetrical and partial coupling of the oscillating medium with the ambient medium limits occurrences of irregularities in effective output. Similarly, the asymmetrical and partial driving of the oscillating medium leads to a relatively high number of normal modes simultaneously excited. Moreover, perturbations in boundary conditions of the oscillating medium give rise to additional superposed standing waves, for a further increase in the number of normal modes simultaneously excited. The resulting higher density of normal modes limits perception of irregularities in effective output. This combined process of limiting both occurrences and perception of irregularities stands out as a functional property of the device for an effective output with improved tonal quality.

20 Claims, 35 Drawing Sheets

Modes of oscillation and associated ratios of higher to fundamental characteristic frequencies for a rectangular thin film of height = (2.33)x(width)

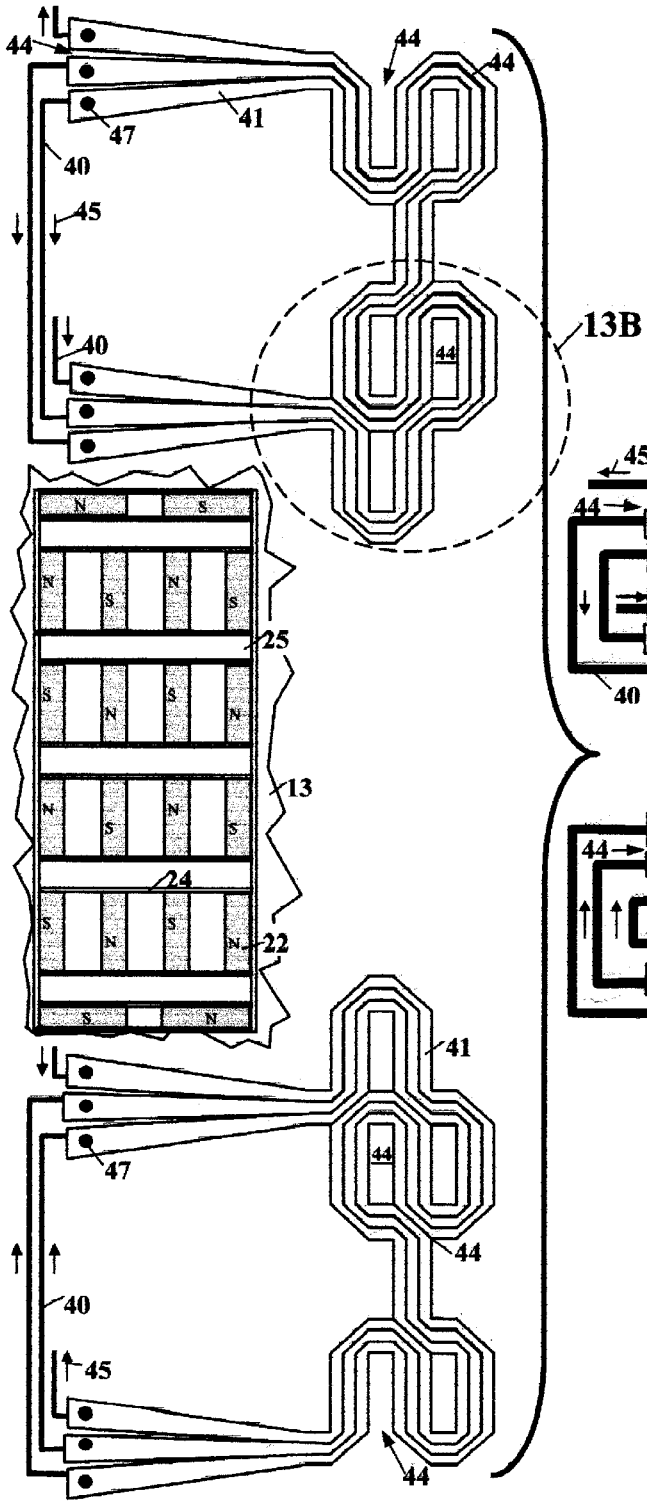
FIG. 13A1
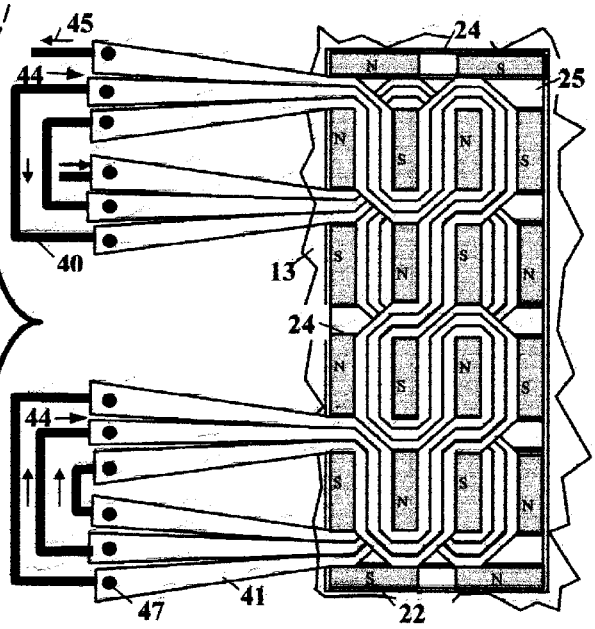
FIG. 13A2

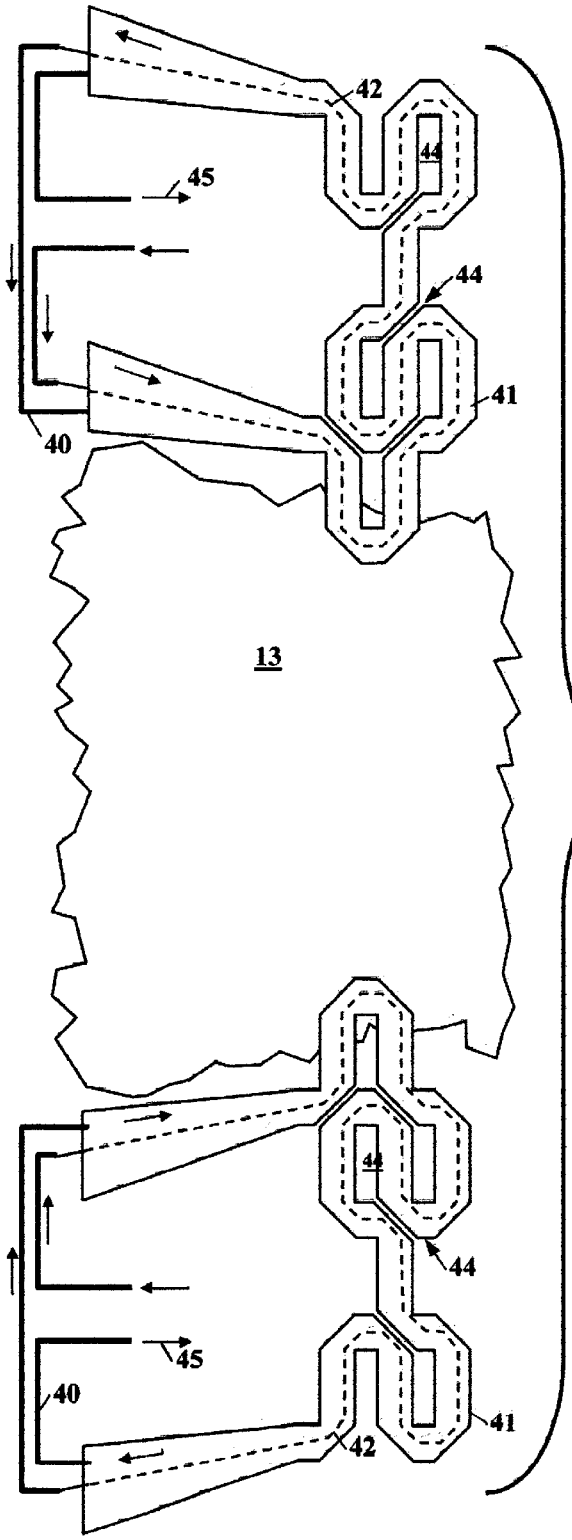
FIG. 14A1
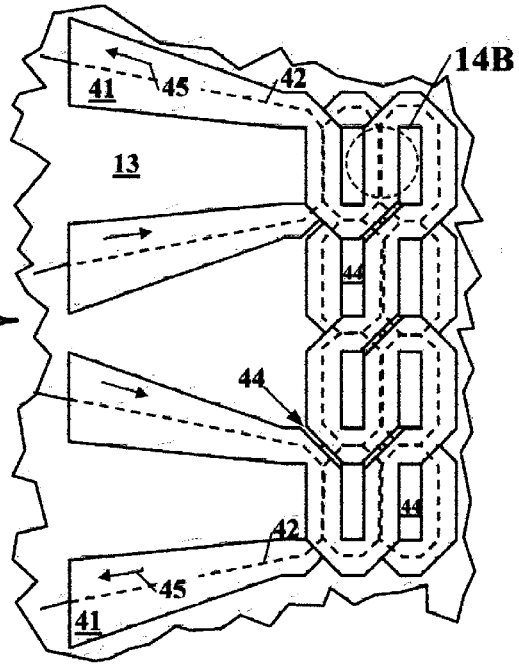
FIG. 14A2

Calculated ratios of resonance (mode) frequencies $f_{mn}$ to lowest fundamental frequency $f_{11}$

| 2.20w=H | | | | | | 0.90w=h | | | | | |
|---|---|---|---|---|---|---|---|---|---|---|---|
| t=t | | | 1.20t=T | | | t=t | | | 1.20t=T | | |
| mode | | fmn | mode | | fmn | mode | | fmn | mode | | fmn |
| m | n | :f11 | m | n | :f11 | m | n | :f11 | m | n | :f11 |
| 1 | 1 | 1,00 | 1 | 1 | 1,10 | 1 | 1 | 1,36 | 1 | 1 | 1,49 |
| 2 | 1 | 1,87 | 2 | 1 | 2,05 | 2 | 1 | 2,22 | 2 | 1 | 2,43 |
| 1 | 2 | 1,23 | 1 | 2 | 1,35 | 1 | 2 | 2,08 | 1 | 2 | 2,28 |
| 2 | 2 | 2,00 | 2 | 2 | 2,19 | 2 | 2 | 2,72 | 2 | 2 | 2,98 |
| 3 | 1 | 2,76 | 3 | 1 | 3,03 | 3 | 1 | 3,17 | 3 | 1 | 3,47 |
| 1 | 3 | 1,54 | 1 | 3 | 1,69 | 1 | 3 | 2,91 | 1 | 3 | 3,19 |
| 3 | 2 | 2,85 | 3 | 2 | 3,13 | 3 | 2 | 3,54 | 3 | 2 | 3,88 |
| 2 | 3 | 2,20 | 2 | 3 | 2,41 | 2 | 3 | 3,40 | 2 | 3 | 3,72 |
| 3 | 3 | 3,00 | 3 | 3 | 3,29 | 3 | 3 | 4,08 | 3 | 3 | 4,47 |
| 4 | 1 | 3,66 | 4 | 1 | 4,01 | 4 | 1 | 4,15 | 4 | 1 | 4,54 |
| 1 | 4 | 1,89 | 1 | 4 | 2,07 | 1 | 4 | 3,78 | 1 | 4 | 4,14 |
| 4 | 2 | 3,73 | 4 | 2 | 4,09 | 4 | 2 | 4,44 | 4 | 2 | 4,86 |
| 2 | 4 | 2,46 | 2 | 4 | 2,70 | 2 | 4 | 4,17 | 2 | 4 | 4,56 |
| 4 | 3 | 3,85 | 4 | 3 | 4,21 | 4 | 3 | 4,88 | 4 | 3 | 5,35 |
| 3 | 4 | 3,19 | 3 | 4 | 3,50 | 3 | 4 | 4,74 | 3 | 4 | 5,19 |
| 4 | 4 | 4,00 | 4 | 4 | 4,38 | 4 | 4 | 5,44 | 4 | 4 | 5,96 |

Table 1

| Mode frequency ratios fmn:f11, sorted in ascending order (Listed, along with associated modes, as a contiguous array) | | | | | | | | | | | |
|---|---|---|---|---|---|---|---|---|---|---|---|
| mode | | fmn | mode | | fmn | mode | | fmn | mode | | fmn |
| m | n | :f11 | m | n | :f11 | m | n | :f11 | m | n | :f11 |
| 1 | 1 | 1,00 | 2 | 1 | 2,22 | 3 | 4 | 3,19 | 1 | 4 | 4,14 |
| 1 | 1 | 1,10 | 1 | 2 | 2,28 | 3 | 3 | 3,29 | 4 | 1 | 4,15 |
| 1 | 2 | 1,23 | 2 | 3 | 2,41 | 2 | 3 | 3,40 | 2 | 4 | 4,17 |
| 1 | 2 | 1,35 | 2 | 1 | 2,43 | 3 | 1 | 3,47 | 4 | 3 | 4,21 |
| 1 | 1 | 1,36 | 2 | 4 | 2,46 | 3 | 4 | 3,50 | 4 | 4 | 4,38 |
| 1 | 1 | 1,49 | 2 | 4 | 2,70 | 3 | 2 | 3,54 | 4 | 2 | 4,44 |
| 1 | 3 | 1,54 | 2 | 2 | 2,72 | 4 | 1 | 3,66 | 3 | 3 | 4,47 |
| 1 | 3 | 1,69 | 3 | 1 | 2,76 | 2 | 3 | 3,72 | 4 | 1 | 4,54 |
| 2 | 1 | 1,87 | 3 | 2 | 2,85 | 4 | 2 | 3,73 | 2 | 4 | 4,56 |
| 1 | 4 | 1,89 | 1 | 3 | 2,91 | 1 | 4 | 3,78 | 3 | 4 | 4,74 |
| 2 | 2 | 2,00 | 2 | 2 | 2,98 | 4 | 3 | 3,85 | 4 | 2 | 4,86 |
| 2 | 1 | 2,05 | 3 | 3 | 3,00 | 3 | 2 | 3,88 | 4 | 3 | 4,88 |
| 1 | 4 | 2,07 | 3 | 1 | 3,03 | 4 | 4 | 4,00 | 3 | 4 | 5,19 |
| 1 | 2 | 2,08 | 3 | 2 | 3,13 | 4 | 1 | 4,01 | 4 | 3 | 5,35 |
| 2 | 2 | 2,19 | 3 | 1 | 3,17 | 3 | 3 | 4,08 | 4 | 4 | 5,44 |
| 2 | 3 | 2,20 | 1 | 3 | 3,19 | 4 | 2 | 4,09 | 4 | 4 | 5,96 |

Table 2

FIG. 15C

ELECTROACOUSTIC TRANSDUCER WITH IMPROVED TONAL QUALITY

CROSS-REFERENCE TO RELATED APPLICATION

This application claims priority under 35 U.S.C. §119(e) to U.S. Provisional Patent Application 60/075,368, filed Feb. 20, 1998, the disclosure and drawings of which are incorporated herein by reference.

BACKGROUND OF THE INVENTION

1. Technical Field of the Invention

This invention relates to electroacoustic transducers for accurate reproduction of sound. Preferred embodiments of the invention use a layered assembly of thin films, baffles and atmospheric air, as an oscillating medium.

2. Description of Prior Art

Transducers for accurate or high-fidelity reproduction of sound available on the market today, when defined by the kind of oscillating medium they use, are of rigid-diaphragm type or stretched thin-film type:

1. As a rule, rigid-diaphragm transducers are employed in the construction of transducers with enclosures. They mostly consist of a cone-shaped radiating area with an electromagnetic driven area (voice coil) positioned at the apex of the cone. The front of the radiating area is fully exposed, whereas at the back of such area there is a magnet assembly and supporting hardware.
2. Stretched thin-film transducers do not employ any enclosure. They are mostly rectangular shaped with either an electrostatic or electromagnetic driving (motor) structure distributed over the entire front or back (or front and back) of the driven area.

I will first examine deficiencies common to all transducers. Then I will cover deficiencies or problems typical of each of the two kinds of transducers with emphasis on stretched thin-film transducers. Examined deficiencies are mostly confined to physical properties and phenomena causing audible irregularities in frequency response and tonal quality (timbre) of reproduced effective output.

A. Deficiencies Common to All Transducers, Affecting Perceived Tonal Quality

A first deficiency common to all transducers is the erratic acoustic power response as a function of frequency. Such erratic response is the result of irregularities in radiated output caused by characteristic mode patterns, known as normal modes of oscillation, resulting from standing waves at resonance frequencies of an oscillating medium. Such mode patterns are determined by oscillating sections of maximum displacement known as antinodes that are delimited by lines of zero displacement known as nodes. The areas of any adjacent antinodes of an oscillating medium have the tendency to be equal in size. Such tendency is a function of the geometry of the oscillating medium boundary in the sense that the closer to a symmetric geometry such boundary is, the more pronounced such tendency is. Each antinode moves out of step or with 180 degrees phase difference with any adjacent antinode. Moreover, the acoustic power radiated by any section of an oscillating medium is a function of the average displacement amplitude of such section. Thus, for each pair of adjacent antinodes, separated by a nodal line, the resulting minimum in the average displacement causes a drop in the effective output. By extrapolation, for each resonance (characteristic) frequency of an oscillating medium producing a mode pattern with an even number of antinodes, there is a minimum average displacement giving an audible dip in effective output. Such dip in effective output is defined as an antiresonance minimum. For a mode pattern with an odd number of antinodes, there is an audible peak in the effective output determined by a maximum from a remaining single (not paired up) antinode. Such peak in effective output caused by a mode pattern with a maximum average displacement is defined as a resonance maximum.

The irregularities in effective output of resonance-antiresonance minima and maxima become particularly audible in the low end of the acoustic spectrum where mode patterns occur at wider spaced resonance frequencies of the oscillating medium. The sparser such resonance frequencies are, the fewer mode patterns occur per unit frequency range, and the more pronounced the effect of such irregularities is, as perceived by the hearing mechanism. One more reason for strong and audible resonance-antiresonance irregularities from mode patterns is the stronger coupling with air of the intrinsically larger antinode areas occurring at low resonance frequencies. Consequently, not only the acoustic power response is erratic but also tonal quality (timbre) of radiated sound deteriorates because dips and peaks, unrelated to the spectrum at source, occur in the reproduced complex sound such as music or speech. Such resonance-antiresonance irregularities are also particularly pronounced under transient conditions at all frequencies.

A second deficiency common to all transducers relates to the tonal quality or timbre of reproduced sound as affected by, correspondingly, size and position of the driven area with respect to size and boundary of the total oscillating area. To a large extent, tonal quality is determined by the structure of the spectrum as derived from a reproduced complex waveform. In turn, a reproduced waveform is affected by the coexistence of superposed standing waves of an oscillating medium at any instant. Therefore such deficiency is reduced to relating tonal quality directly to the content in modes of oscillation being simultaneously excited in the oscillating medium.

A disturbance at a point of an oscillating medium will excite simultaneously a number of modes in proportion to the amplitude associated with each mode pattern at that particular point. One extreme possibility would be for a disturbance, applied at a point of maximum displacement—the centre of an antinode, giving rise to a pronounced associated mode. Another extreme possibility would be for a disturbance, applied at a point of minimum displacement—a nodal line, not being able to excite at all the associated mode. In practice, a disturbance spans at least two adjacent antinodes and interferes with the formation of associated mode patterns because the applied forces act in conflict with the adjacent out of step displacements.

Established and prevalent driving configurations in transducers involve:

(a) Concentration of exerted forces only on a symmetrically positioned, with respect to boundary, central and small section of an oscillating medium, such as in rigid diaphragm transducers;

(b) Distribution of exerted forces throughout the entire area of an oscillating medium, including the central section, such as in thin-film transducers.

Either way, at lower frequencies, a centrally driven section of an oscillating medium is crossed by nodal lines delimiting relatively large adjacent antinodes. The out-of-step displacements of adjacent antinodes conflict with forces applied by a disturbance and restrict the full development of associated mode patterns. Hence, a waveform reproduced by a centrally driven oscillating medium will have spectrum poor in low frequency overtones, causing tonal quality irregularities in effective output. At higher frequencies, progressively denser nodal lines delimit progressively smaller antinodes, and the effect of disturbances conflicting with out-of-phase antinode displacements becomes only statistically significant throughout the entire oscillating medium.

A third deficiency common to all transducers is related to back-to-front-wave-leakage phase cancellations whereby a back compression or a back rarefaction leaks around the edge of the transducer and catches up, respectively, with a front rarefaction or a front compression. The back-to-front-wave-leakage phase cancellations are an additional cause of irregularities in effective output, phenomenon particularly pronounced at low frequencies.

A fourth deficiency is related to all transducers using more than one transducer units in order to extend the frequency range of reproduced sound. Filters (crossover networks) employed in distributing frequency bands to dedicated transducer units, are circuits with their own resonances and losses that affect the original waveform, therefore affecting the perceived tonal quality reaching the listener's ears. A complex problem to solve is the integration of two adjacent frequency bands of two transducer units at frequencies delimiting such bands. Because both such units radiate sound at such delimiting frequencies, the transition from one band to the other must be smooth, or output discontinuity will occur. Crossover networks employed to handle such transition remain a major source of complications in preventing this irregularity.

A fifth deficiency common to all transducers is nonlinear distortion. Nonlinear distortion is due to nonlinear mechanical properties such as elasticity of oscillating media, nonlinear electrical properties such as impedance of crossover networks and voice coils, nonlinear electromagnetic or electrostatic fields producing nonlinear forces exerted on oscillating media. Improvements in material technology (thin film, diaphragm, diaphragm suspension) have reduced nonlinear distortion from mechanical properties to levels difficult to detect in perceived tonal quality. Audible forms of nonlinear distortion are mostly due to nonlinearity of crossover circuits, in general, and, in particular, of voice coils in magnetic fields of thin-film transducers with the magnet structure mounted on one side of such thin film.

A sixth deficiency common to all transducers is directionality. At high frequencies, the acoustic energy is mostly propagated in the direction perpendicular to the plane of the oscillating medium. The larger the ratio of oscillating area dimensions to wavelength of propagated sound, the more pronounced such directionality is.

Note: For all types of transducers, limited attention has been paid to the importance of direct radiation as related to early reflections of emitted sound or to the balance between a listener's ability to localise a sound source and the spatial sensation of the source environment; too much dispersion, and definition is lost; too much directionality, and spaciousness is lost.

B. Deficiencies Typical of Each Kind of Transducers Affecting Perceived Tonal Quality 1. Rigid-diaphragm Transducers Rigid-diaphragm transducers are of a relatively high sensitivity, requiring small amounts of power to produce acceptable acoustic output. As standalone devices, they produce sound of poor tonal quality because of every possible phase cancellation. When mounted in enclosures, however, rigid-diaphragm transducers produce a pleasant (warm) sound but with an artificially rich tonal quality, an inevitable departure from natural, life-like sound reproduction.

A first deficiency typical of rigid-diaphragm transducers is instability of diaphragm. No matter how rigid the diaphragm is made, it is impossible to eliminate or even control its break up (flexing) at resonance frequencies. Especially at higher frequency normal modes of oscillation it is impossible to predict the behaviour of the diaphragm since it ceases following the motions of the voice-coil. Low-mass-high-stiffness materials have been about the best means in constructing the diaphragm. A major obstacle has been the unavoidable compromise between stiffness and low mass. For a given diaphragm mass, the stiffer the material, the less bending (flexing) occurs at resonance frequencies and the more faithfully will the diaphragm follow the motions of the driven area.

A second deficiency of rigid-diaphragm transducers is a frequency-dependent output because of high electric impedance of the coil (voice-coil) driving the diaphragm. This makes the current intensity highly dependent on frequencies present in the waveform, therefore affecting acoustic output and tonal quality. Voice-coil impedance remains a limiting factor in producing frequency-independent output. Compromises between low impedance, electromagnetic force and coil mass remain a major obstacle.

A third deficiency of rigid diaphragm transducers is the poor exchange of energy, between the diaphragm (high density) as the oscillating medium and air (low density) as the ambient wave propagation medium, caused by the impedance mismatch of the two wave-carrying media.

A fourth deficiency is typical of rigid-diaphragm transducers mounted in enclosures. A sealed enclosure eliminates back-to-front-wave-leakage phase cancellations, acting as an approximation of an infinite baffle. An open enclosure minimizes back-to-front-wave-leakage phase cancellations while acting as a low frequency resonator (Helmoltz) and as an acoustic transformer between the diaphragm and the ambient air through the enclosed volume of air. An open enclosure solves partially the low frequency phase cancellation problem and the impedance matching problem but it creates a new one: coloration. The reproduced effective output is altered (coloured) by added resonances occurring in the enclosed volume of air that have no relation to the waveform at source, giving rise to an artificially rich tonal quality. Also, the panels of any enclosure become another source of spurious resonances. Damping air resonances has had limited success in harnessing coloration. It has been proven that although damping reduces ringing by lowering and broadening the resonance peaks (lowering the quality factor Q), it does not reduce audibility of resonances (R. Bucklein—1962, The Audibility of Frequency Response Irregularities, J. Audio Eng. Soc., vol.29, pp.126–131, March 1981). Rigid and damped panels with internal bracing help in building enclosures with excellent properties, yet a barrel-like-originating sound persists in all transducers using enclosures.

2. Stretched Thin-film Transducers

Although able to reproduce low-coloration and low-distortion output, stretched thin-film transducers tend to sound dry, unbalanced, as if lacking the low frequency end of the spectrum. Such transducers employ a relatively large driven (and radiating) area that also requires large and, often, expensive magnetic or electrostatic motor structures. The relatively large driven/radiating area is the source of most of their deficiencies.

A first deficiency typical of thin-film transducers is an erratic response in coustic power, with pronounced audible effects, caused by resonance-antiresonance irregularities. Such irregularities are more pronounced because of a typically large and symmetrical area of the oscillating thin film. The generally accepted reason for making such area large is to compensate for small amplitude displacements. For given amplitude, a larger area displaces larger volumes of air, and, in principle, this is true for any non-resonance frequencies. However, at the occurrence of each mode pattern, resonance-antiresonance irregularities cause excessive variations in air volume displacements, giving rise to pronounced variations in effective output, especially audible at low frequencies. This is because, for a predetermined thin-film area, the lower the resonance (characteristic) frequency, the larger the areas of antinodes and the stronger the coupling with air.

One method to alleviate the problem of resonance-antiresonance irregularities, used by Magnepan Co. and disclosed in U.S. Pat. No. 4,319,096 to J. M. Winey (1982), the disclosure of which is incorporated herein by reference, is by clamping the thin film at points causing excessive amplitude fluctuations. The effectiveness of the method is limited to specific resonance frequencies.

A proposed method of reducing the effect of normal modes is by applying a lightweight damping material on the thin film, as disclosed in H. Suyama (1981). Besides the problem of added mass, bending and flexing at resonance frequencies still occurs, therefore, audible improvements in tonal quality are minor.

A second deficiency typical of stretched thin-film type of transducers is that they behave as large planar dipoles emitting acoustic energy in front and back with unavoidable back-to-front-wave-leakage phase cancellations at low frequencies, whereby a compression generated at the back catches up with a rarefaction generated at the front of the dipole. This deficiency reduces acoustic power, and is particularly noticeable at the low end of the spectrum, resulting in unbalanced sound, lacking low frequency content. There is virtually no baffle to prevent back-to-front-wave-leakage phase cancellations because this would make their total size prohibitive to normal domestic or professional use.

Increasing the oscillating area offers some marginal benefits to perceived effective output because a larger oscillating area means also a larger, bordering the edge, peripheral area that acts as a virtual baffle for the central area. Virtual baffle in the sense that the intrinsic stiffness of the peripheral area dictates low amplitude oscillations relative to the amplitude oscillations of the central area. Nevertheless, antiresonance minima reduce the low frequency content of the effective output to such an extent that the peripheral area ceases to play any significant role as a virtual baffle in preventing back-to-front-wave-leakage phase cancellations. On the other hand, such marginal benefits are outweighed by the inconvenience of an increased size and associated increased material and manufacturing costs.

A third deficiency of stretched thin-film type of transducers is their pronounced directionality. Because of a large oscillating area, the acoustic energy is mostly propagated in the direction perpendicular to the plane of the oscillating medium. The larger the oscillating area and the higher the frequency, the more pronounced such directionality is. Effective (and expensive) solutions for the directionality problem exist on the market. One product that solves the problem for horizontal and vertical dispersion of sound is the electrostatic ESL-63 by QUAD Electroacoustics. Using a single stretched thin film and circuitry feeding the signal with time delays, it simulates a hemispherical wavefront seeming to originate from a point source behind the oscillating medium. Other models (Acoustat, Martin-Logan) simulate a semicylindrical wavefront originating from a line source with acceptable horizontal but poor vertical dispersion of sound.

A fourth deficiency typical of thin-film transducers is, again, caused by the large driven/radiating area as related to the way standing waves and resulting mode patterns are excited at resonance frequencies of the air in the listening room. The larger the driven/radiating area, the higher the probability of such area spanning room air volumes (typically mode patterns with antinodal parallelepipeds and nodal planes) that oscillate out of step at resonance frequencies. The equivalent statement would be that the larger the driven/radiating area, the higher the probability of such area being crossed by a nodal plane separating two adjacent antinodes belonging to a mode pattern of the room air volume. This means a higher probability of room air modes interfering with full development of the driven/radiating area modes. Therefore, the mode patterns of air volume reduce the effective output at certain resonance frequencies. Since the transducer fails to excite the air in the room at certain frequencies, and since sound is processed through coupling of transducer to air, this irregularity affects the tonal quality of the input reaching the listener's ears.

A fifth deficiency typical of stretched thin-film transducers relates to the unstable behaviour of a large-area oscillating thin film at low frequencies. The mass of the thin film is so low when compared to the mass of the air in the room that the effective mass must be treated as the sum of the two masses. This means good thin-film to air impedance matching for relatively small rooms. This also means that the effective output at low frequencies will be a function of the room volume. In a small room, the oscillating thin film interacts with the entire room air mass, whereas in larger rooms it decouples itself from part of the contained air mass due to increased compressibility of the larger volume of air. This results in poor thin-film-to-air-mass impedance matching for relatively large rooms.

A proposed solution to solving some of the problems of a large oscillating area is in U.S. Pat. No. 4,156,801 to R. C. Whelan et al. (May, 1979), the disclosure of which is incorporated herein by reference, disclosing a thin-film transducer with a centrally driven/radiating area that is small when compared to the nondriven area. The nondriven area is baffled in order to minimize the effect on the radiated output of the nondriven area moving out-of-phase with the centrally driven area. Additional intentions, as stated by the inventors, were to exploit dimensions of the driven/radiating area for better sound dispersion, radiation energy, bandwidth and other parameters. A side benefit of a driven/radiating area positioned in a central opening of a relatively large baffle is the reduction of back-to-front-wave-leakage phase cancellations at low frequencies due to increased back to front effective wave path. For baffle dimensions much larger than the driven/radiating area and much larger than the wavelength of emitted sound, the back and front of the transducer act independently. However, at low resonance frequencies above the fundamental, antiresonance minima already reduce effective output to such an extent that the baffle ceases to play any significant role in preventing back-to-front-wave-leakage phase cancellations. Despite the existence of a relatively small driven/radiating area, pronounced low frequency antiresonance minima will still occur because the intrinsic symmetry of the centrally positioned driven/radiating area, in combination with:

(a) such area being, to a large extent, symmetrically crossed by nodal lines, (b) such nodal lines belonging to a large number of mode patterns, (c) such mode patterns having an even number of antinodes, will still give rise to phase cancellations from out-of-phase displacements of adjacent antinodes that are exposed through the central opening (open area) in the baffle.

A further reduction in strength of effective output, and a consequent degradation of the tonal quality, originates in the central area being driven by forces that act in conflict with the out-of-phase displacements of adjacent antinodes. The spectrum of the radiated waveform will be poor in frequency components associated with such adjacent antinodes. And one last deficiency caused by the symmetrically (centrally) positioned driven/radiating area is an equal back-to-front-wave-path of all possible paths, giving rise to strong destructive interference for comparable wavelengths of emitted sound. Such destructive interference is manifested as an additional amplitude dip in the frequency response or as an additional gap in the spectrum of a complex waveform, with audible degradation in tonal quality of effective output. Hence, a symmetrically (centrally) positioned driven/radiating area in a relatively large oscillating thin film, combined with a symmetrically (centrally) positioned opening in a relatively large baffle, offers limited improvements to tonal quality of the transducer.

A sixth deficiency of some thin-film transducers originates in the need for a transformer or other circuitry in order to match a significant impedance difference with the amplifying device, rendering impossible the benefits and simplicity of direct coupling.

A seventh deficiency, typical of stretched thin-film transducers with magnetic field distributed over one side of the thin film, is distortion due to nonlinearity of the magnetic (or electrostatic) field. In particular, for large displacements (excursions), the conductors adhered on the thin film are exposed to a weaker magnetic field because of larger distances from the magnet assembly. Hence, for a given current intensity, the electromagnetic forces will be much weaker or much stronger at extreme positions compared to average displacements of the oscillating medium. A side effect of magnetic structures is the magnetic field intensity losses due to pole pieces (usually perforated ferromagnetic plates) supporting the magnet assembly. Losses in internal magnetomotive force result from the magnetic reluctance in the pole piece and in the inevitable gap where the pole piece joins the magnet. A pole piece is necessary for directing a maximum magnetic flux to the conductors adhered to the thin film.

An eighth deficiency typical of all thin-film transducers is the interference of magnetic or electrostatic motor structures with the process of reproducing a waveform and the process of radiating a waveform:

The interference of such structures with the process of producing a waveform relates to strong coupling of the oscillating thin film with air. The free motion of the oscillating thin film becomes a function of the displaced air volume flowing through the structure per unit time that, in turn, depends on the total cross-sectional area of air-flow spacing. The smaller the cross-sectional area of air-flow spacing, the smaller the volume of air flowing per unit time and the stronger the interference of such structure with the free motion of the oscillating thin film. For example, in a structure composed of a magnet assembly mounted on a perforated pole piece, the total air-flow spacing area is determined by the total area of perforations not covered by the assembly of magnets. In practice, the compromise between ferromagnetic and mechanical properties of the pole piece, minimisation of magnetic flux losses and total air-flow spacing cross-sectional area constitutes an obstacle in achieving an optimum air flow through the magnet structure. Thus, the magnet structure interferes with the free motion of the oscillating thin film that, in turn, affects the reproduced waveform, therefore the tonal quality of the transducer. An extreme case of a structure interfering with free motion of the oscillating thin film is the flapping of the thin film against such structure at high amplitude oscillations.

The interference of structures with the process of radiating a waveform relates to obstructing the propagation of waves in air. Transducers with such structures on each side of the oscillating medium, interfere with wave propagation of both front and rear waves. Transducers with structures on one side of the oscillating medium, interfere with the propagation of waves on that side only. Since radiated waves propagate as air disturbances induced by thin-film oscillations, such structures act as obstacles that interfere with free propagation of waves, thus degrading the tonal quality of reproduced sound.

A ninth deficiency characteristic of electromagnetic thin-film transducers relates to a predominantly parallel, in lengthwise or widthwise direction, sparse distribution of conductors and magnetic fields throughout the driven/radiating area. The resulting sparse distribution of the exerted electromagnetic forces gives rise to nondriven long parallel strips oscillating out-of-phase with driven long parallel strips. Minima in effective output will occur at all frequencies by out-of-phase cancellations from driven strips alternating with nondriven strips.

To sum up, main sources of audible effects on tonal quality are:

For rigid-diaphragm transducers: inefficiency in reproduced output of hermetically sealed enclosures, coloration caused by air resonances in open enclosures, pronounced variations in effective output caused by diaphragm modes of oscillation at resonance frequencies, voice coil impedance, crossover impedance, crossover resonances, and crossover losses.

For thin-film transducers: tonal quality and resonance-antiresonance irregularities in effective output at resonance frequencies of the oscillating thin film, pronounced back-to-front-wave-leakage phase cancellations and back-to-front-wave-path destructive interference for comparable wave length of radiated sound, dependence of thin-film low end frequencies on room volume, cancellations in effective output because of the thin film spanning adjacent out-of-phase room air antinodes, pronounced directionality, interference of driving structures with radiation of waves, out-of-phase motion of driven and nondriven sections of the oscillating medium, flapping against such structures at high amplitudes, low frequency oscillations of thin film, nonlinear magnetic field for magnet structures positioned on only one side of the thin film, crossover resonances, crossover impedance and crossover losses, weak mechanical coupling of conductors with oscillating medium, sparse distribution of exerted forces throughout the driven/radiating area.

With all their drawbacks, rigid diaphragm transducers with enclosures have been dominating the high-fidelity market because of their excellent performance to price ratio. Tonal quality, though affected by enclosure coloration, is rich in overtones, giving rise to warm, pleasant sound. On the other hand, thin-film transducers are low distortion devices with virtually no coloration but poor in tonal quality, unbalanced, because the low frequency content, though possibly present, is inaudible.

Consequently, a need exists for a transducer with reduced irregularities in effective output for the purpose of achieving a closer approximation to natural tonal quality of reproduced sound.

SUMMARY OF THE INVENTION

An electroacoustic transducer is described with attenuated effective output irregularities caused by the inherent normal modes of oscillation. A preferred embodiment has a sandwich assembly, having a composite oscillating medium of layered components suspended between two rigid baffles, with a hinged baffle extension supporting the device in upright position. An opening or open area, asymmetrically positioned in each of such two rigid baffles, exposes to the environment a driven and asymmetrically positioned antinode belonging to a predetermined mode pattern of said oscillating medium. The resulting asymmetrical and partial coupling of the oscillating medium with the ambient medium limits occurrences of irregularities in effective output. Similarly, the asymmetrical and partial driving of the oscillating medium leads to a relatively high number of normal modes simultaneously excited. Moreover, perturbations in geometry of the oscillating medium components give rise to additional superposed standing waves, for a further increase in the number of normal modes simultaneously excited. The resulting higher density of normal modes limits perception of irregularities in effective output. This combined process of limiting both occurrences and perception of irregularities in effective output stands out as a functional property of the device. The perturbations in geometry of the oscillating medium components along with the geometry of the baffles, jointly contribute to determining the boundary conditions of the oscillating medium and constitute fundamental means in their own right for an effective output with improved tonal quality.

In general, the present invention contemplates a transducer operating in a fluid ambient medium at a predetermined effective range of frequencies, for reproducing with improved accuracy a stimulus applied thereupon, comprising: an oscillating medium comprising at least one oscillating member having predetermined boundary conditions and predetermined normal mode patterns with associated characteristic frequencies of said oscillating member; said oscillating member having an asymmetrically positioned section therein, said section being coincident with an asymmetrically positioned antinode belonging to a predetermined pattern of said normal mode patterns of said oscillating member, adapted for asymmetrically and partially coupling said oscillating medium to said stimulus so as to obtain a substantially high effective density of normal modes concurrently participating in reproducing said stimulus; supporting means for affecting said boundary conditions of said oscillating member, so as to control effective output irregularities caused by the intrinsic normal modes of said oscillating medium; and driving means for coupling of said oscillating medium with said stimulus, so as to minimize effective output irregularities caused by nonlinear displacements of said antinode.

In such a transducer of this invention, the supporting means is adapted to alter said boundary conditions of said oscillating medium and desirably comprises: media-coupling means for partially coupling said oscillating medium with said ambient medium, so as to limit occurrences of resonance-antiresonance irregularities in effective output; and density-increasing means for further increasing said effective density of normal modes of said oscillating medium concurrently participating in reproducing said stimulus, so as to minimize the detection or perception of resonance-antiresonance irregularities in effective output.

In such a transducer of this invention, the media-coupling means desirably comprises: at least one outer baffle facing said oscillating medium and separated therefrom by predetermined spacing, said outer baffle having an asymmetrically positioned opening therein aligned with said antinode, allowing partial coupling of said oscillating medium with said ambient medium through said opening, so as to minimize occurrences of resonance-antiresonance irregularities caused by intrinsic normal modes of the oscillating medium.

In such a transducer of this invention, the density-increasing means comprises: stationary elements adapted to produce perturbations in geometry of said oscillating medium, for creating at least two coupled oscillating regions therein, each of said oscillating regions having distinct normal modes with associated characteristic frequencies interlaced in the frequency domain, for further increasing said effective density of normal modes of the oscillating medium that concurrently participate in reproducing said stimulus, so as to minimize detection or perception of resonance-antiresonance irregularities caused by intrinsic normal modes of said oscillating medium.

In such a transducer of the present invention, the oscillating medium desirably comprises a cavity with ambient medium fluid entrapped therein, for: matching impedance of said oscillating medium with said ambient medium, so as to optimize exchange of energy between said oscillating medium and said ambient medium; increasing said effective density of normal modes of the oscillating medium that concurrently participate in reproducing said stimulus, so as to minimize resonance-antiresonance irregularities caused by intrinsic normal modes of said oscillating medium.

In such a transducer of the present invention, the oscillating medium desirably comprises at least two oscillating members forming a hermetically sealed cavity with a therebetween suspended inner baffle having an asymmetrically positioned opening aligned with said antinode, said inner baffle partially coupling said oscillating members through said opening and by way of ambient medium fluid entrapped therein, for: matching impedance of said oscillating medium with said ambient medium, so as to optimize exchange of energy between said oscillating medium and said ambient medium; said driving means being adapted to exert phase-coherent forces uniformly over a predetermined area of said oscillating medium area by way of constant, per unit area of thin oscillating member, forces from a substantially constant pressure of entrapped fluid, thereby inducing in-phase displacements of said predetermined oscillating medium area for every point thereof.

In such a transducer of the present invention, the oscillating medium desirably comprises: a layered assembly of two rectangular parallel oscillating thin films with a substantially massive, rigid and rectangular inner baffle therebetween, said inner baffle having similar largest dimensions with said thin films; said inner baffle having a rectangular inner-baffle opening asymmetrically positioned therein and aligned with said asymmetrically positioned antinode; each of said thin films being stretched with predetermined tension on a rectangular inner-baffle spacer of predetermined thickness, bordering each side of said inner baffle, said inner-baffle spacer also defining boundary geometry of each of said thin films; said tension being predetermined for defining interlacing positions in the frequency domain of characteristic frequencies associated with the normal modes of oscillation of each of said thin films; each of said thin films being suspended parallel with, and at (inner) air-gap spacing, from said inner baffle by way of said inner-baffle spacer, while forming with said inner-baffle spacer and said inner baffle, in combination, a hermetically sealed cavity with air entrapped therein; said thin films being coupled at said antinode, through said inner-baffle opening, by air entrapped in said cavity, for maximizing interaction of modes in said antinode driven area; whereby said inner baffle decouples said thin films in the remaining nondriven area, limiting interaction of modes thereof; air in said cavity having substantially constant pressure for uniform and in-phase oscillating forces per unit area of said antinode of each of said thin films; air oscillating in said cavity maximizing the impedance matching between said oscillating medium and air of said ambient medium, for optimizing acoustic energy exchange between the two media; whereby said oscillating medium constitutes a layered module of two oscillating thin films with an inner baffle therebetween forming an oscillating air-sealed cavity coupling asymmetrically and partially said two oscillating thin films.

In such a transducer of the present invention, said stationary elements desirably includes edge clamps introduced as predetermined perturbations in geometry of each of said thin films for altering said boundary conditions of said oscillating medium and defining distinct oscillating regions in each of said thin films with additional characteristic frequencies interlaced in the frequency domain; and end clamps introduced as variable perturbations in geometry of said oscillating thin films, altering the area size of each of said oscillating regions and fine-tuning, by shifting, the interlaced positions of said characteristic frequencies in the frequency domain for each of said oscillating regions; whereby said boundary conditions of said oscillating medium are jointly determined by said inner baffle in combination with each said inner-baffle spacer, air layer (compressibility) in each said (inner) air-gap spacing and said perturbations in geometry of said oscillating medium. Said edge clamps are desirably triangular and said end clamps are desirably rectangular strips.

A transducer of the present invention desirably further comprises a pair of parallel outer baffles of substantially identical geometry with said inner baffle, each of said outer baffles having an asymmetrically positioned outer-baffle opening (open area) therein and a rectangular outer-baffle spacer of predetermined thickness bordering the inner side of each of said outer baffles; a sandwich configuration of said two outer baffles with said oscillating medium suspended at (outer) air-gap spacing therebetween by way of said outer-baffle spacers, and having said asymmetrically positioned outer-baffle opening therein aligned with said antinode for asymmetrically and partially coupling said oscillating medium with said ambient medium; air oscillating in said (outer) air-gap spacing substantially improving the impedance matching between said oscillating medium and air of said ambient medium, for improved acoustic energy exchange between the two media; and a baffle extension extending the area of said outer baffles while supporting the device in upright position; whereby said boundary conditions of said oscillating medium are determined by the combination of said outer baffles, said inner baffle, each said outer-baffle spacer, each said inner-baffle spacer, air layer in each said (inner and outer) air-gap spacing, perturbations in geometry of said oscillating medium and said baffle extension.

In a transducer of the present invention, said driving means desirably comprises: an assembly of current-carrying grid of conductors secured to each said thin film within substantially all of the area of said antinode; a frame-like magnet array, flush-mounted in each said outer-baffle opening; a panel-like magnet array flush-mounted in said inner-baffle opening; both of said magnet arrays being adapted to provide a substantially uniform magnetic field within the space defined by extreme displacement amplitudes of each said antinode by forces exerted on currents carried by said conductors; said air-sealed cavity in said oscillating medium having constant air pressure for uniform and in-phase forces per area unit.

To put it slightly differently, the present invention generically contemplates a transducer, having a composite oscillating medium of at least two oscillating components with predetermined boundary conditions, operating in an ambient medium at predetermined effective range of frequencies, for reproducing a stimulus applied thereupon, comprising:

stimulus-coupling means for asymmetrically coupling said stimulus with said oscillating medium, so as to obtain an initially high effective density of intrinsic normal modes of said oscillating medium concurrently participating in the reproduction of said stimulus; and stimulus-driving means for driving said stimulus-coupling means, so as to exert linear and phase-coherent forces combined with improved exchange of energy between the oscillating medium and said ambient medium;

whereby the spectrum of the reproduced waveform of said effective output of said transducer constitutes a satisfactorily faithful reproduction of the spectrum of the waveform of said stimulus at source.

Desirably said stimulus-coupling means comprises:

an antinode area belonging to a predetermined mode pattern of each said at least two oscillating components of said oscillating medium, asymmetrically positioned therein;

at least one inner baffle, parallel with said at least two oscillating components while suspended at predetermined inner-air-gap distance therebetween, said inner baffle having an asymmetrically positioned opening (open area) therein aligned with said antinode area, for mutually and asymmetrically coupling each of said at least two oscillating components at said antinode area, while mutually decoupling each said at least two oscillating components in the remaining area;

so as to obtain an initially high number of superposed standing waves concurrently excited in said oscillating medium resulting from said applied thereupon stimulus.

Desirably such a transducer further comprises:

two parallel outer baffles, with said oscillating medium suspended therebetween at predetermined outer-air-gap distance, each of said outer baffles having an asymmetrically positioned opening (open area) therein aligned with said antinode area, for asymmetrically coupling said oscillating medium with said ambient medium by way of said asymmetrically positioned antinode area and through said opening, while decoupling said oscillating medium from said ambient medium in the remaining area, so as to limit or minimize occurrences of resonance-antiresonance irregularities in effective output.

Desirably such a transducer further comprises:

perturbations in geometry of said at least two oscillating components, altering said boundary conditions of said oscillating medium, defining oscillating regions therein having distinct normal modes of oscillation and associated characteristic frequencies interlaced in the frequency domain for further increasing said effective density of intrinsic normal modes of said oscillating medium so as to limit or minimize detection of resonance-antiresonance irregularities in effective output.

In the embodiment described in greater detail herein, said ambient medium is atmospheric air, said effective range of frequencies is within hearing limits, said oscillating components are rectangular thin films coupled to and driven by said stimulus at said asymmetrically positioned antinode area.

Alternatively, a thin, low-mass plate (not necessarily flat—it could be a shell such as in stringed musical instruments) would serve, though of course stronger driving forces would be required.

In such a transducer, the oscillating medium desirably comprises: said inner baffle having a rectangular inner-baffle opening asymmetrically positioned therein and aligned with said asymmetrically positioned antinode area;

each of said thin films stretched with predetermined tension on a rectangular inner-baffle spacer of predetermined thickness, bordering each side of said inner baffle, also defining boundary geometry of each of said thin films;

said predetermined tension for defining interlacing positions in the frequency domain of characteristic frequencies associated with the normal modes of oscillation of each of said thin films;

each of said thin films being suspended parallel with, and at inner-air-gap distance, from said inner baffle by way of said inner-baffle spacer, while forming with said inner-baffle spacer and said inner baffle, in combination, a hermetically sealed cavity with air entrapped therein;

said thin films being coupled at said antinode area, through said inner-baffle opening, by air entrapped in said cavity, for maximizing interaction of modes in said antinode driven area;

said inner baffle decoupling said thin films in the remaining nondriven area, for limiting interaction of modes thereof;

air oscillating in said cavity substantially matching the impedance of said composite oscillating medium with air of said ambient medium, for optimizing acoustic energy exchange between said oscillating medium and said ambient medium;

whereby said oscillating medium constitutes a layered module of two oscillating thin films forming, in combination with said inner baffle and said inner spacer an oscillating air-sealed cavity coupling asymmetrically said two oscillating thin films.

In such a transducer, there are desirably right-angle triangular clamps, introduced as predetermined perturbations in geometry of each of said thin films, altering said boundary conditions of said oscillating medium and defining distinct oscillating regions in each of said thin films with additional said characteristic frequencies interlaced in the frequency domain, for a further increase in said effective density of intrinsic normal modes of said oscillating medium; and there are also desirably narrow rectangular clamps introduced as adjustable perturbations in geometry of said oscillating thin films, altering the area size of each of said oscillating regions and fine-tuning, by shifting, the interlaced positions of said characteristic frequencies in the frequency domain for each of said oscillating regions; whereby said boundary conditions of said oscillating medium are physically (by components) determined by said inner baffle in combination with each said inner-baffle spacer, air layer in each inner-air-gap and said perturbations in geometry of said oscillating medium.

Moreover, the preferred transducer of the present invention further comprises a pair of parallel outer baffles of substantially identical geometry with said inner baffle, each of said outer baffles having an asymmetrically positioned outer-baffle opening therein and a rectangular outer-baffle spacer of predetermined thickness bordering the inner side of each of said outer baffles; wherein there is a sandwich configuration of said two outer baffles with said oscillating medium suspended therebetween at outer-air-gap spacing by way of said outer-baffle spacers, and having said asymmetrically positioned outer-baffle opening therein aligned with said antinode for asymmetrically and partially coupling said oscillating medium with said ambient medium; air oscillating in said outer-air-gap spacing substantially matching the impedance of said oscillating medium with air of said ambient medium, for improved acoustic energy exchange between said oscillating medium and said ambient medium. Desirably the transducer further includes a baffle extension, for extending the area of said outer baffles while supporting the device in upright position. Such baffle is preferably hinged to the aforementioned elements or otherwise secured thereto. In such a device, the boundary conditions of said oscillating medium are physically (by way of components) determined by the combination of said outer baffles, said inner baffle, each said outer-baffle spacer, each said inner-baffle spacer, said perturbations in geometry of said oscillating medium, air layers oscillating in each said inner-air-gap and each said outer-air-gap spacing, and said baffle extension.

In such a transducer the driving means desirably comprises an assembly of current-carrying grid of conductors secured to each said antinode area; a frame-like magnet array, flush-mounted in each said outer-baffle opening; a panel-like magnet array flush-mounted in said inner-baffle opening; said frame-like array and panel-like array of magnets, exposing concurrently and in combination said grid of conductors of each said antinode to a substantially uniform magnetic field within the space defined by extreme amplitude displacements of each said antinode, so that forces exerted on said current-carrying conductors are substantially linear; said air-sealed cavity in said oscillating medium having substantially constant air pressure as a result of said two thin films moving in tandem, so that forces per unit area are in-phase and uniform for every point of said antinode of each of said thin films; whereby said driving means constitute external and internal elements of said oscillating medium.

Alternatively, any force-producing field such as electrostatic, piezoelectric or electromagnetic, in any combination could serve as driving means. The reader will appreciate that thin film transducers operate with a relatively low degree of power efficiency; that is, relatively greater amounts of energy will need to be supplied to a transducer of the present invention (main embodiment) to produce a predetermined decibel level of output than with more efficient transducers. This is because the conductors cannot be exposed in the gap of a magnet as is the case for the voice coil of conventional cone transducers. There is, therefore, a structural limitation that does not allow for a high magnetic flux. Also, for reasons of effective electrostatic field strength, electrostatic transducers are relatively inefficient compared with conventional cone transducers. With the wide availability of powerful audio amplifiers, such power inefficiency does not constitute a significant drawback.

Stated in another way, the present invention provides a transducer comprising an oscillating medium with predetermined boundary conditions, operating in an ambient medium at predetermined effective range of frequencies, for reproducing with improved accuracy a stimulus applied thereupon, comprising:

controlling means for controlling the intrinsic normal modes of oscillation of said oscillating medium, so as to limit effective output irregularities caused by resonance frequencies, associated with said normal modes, participating in the spectrum of a waveform reproduced from said applied stimulus;

matching means for matching impedance of said oscillating medium with said ambient medium so as to optimize exchange of energy between said oscillating medium and said ambient medium; and driving means for linear and in-phase driving of said oscillating medium by said stimulus, so as to limit effective output irregularities caused by nonlinear as well as out-of-phase displacements of said oscillating medium; whereby the spectrum of the reproduced waveform of said effective output of said transducer constitutes an improved approximation of the spectrum of the waveform of said stimulus at source.

A more particular aspect of the invention provides such a transducer wherein said controlling means comprises:

stimulus-interfacing means for asymmetrically and partially coupling said oscillating medium with said stimulus so as to obtain an initially high density of normal modes concurrently participating in reproducing said stimulus;

environment-isolating means for asymmetrically and partially decoupling said oscillating medium from said ambient medium, so as to limit occurrences of resonance-antiresonance irregularities in effective output.

An even more particular aspect of the invention provides such a transducer further comprising:

mode-density means for substantially increasing said effective density of normal modes of said oscillating medium concurrently participating in reproducing said stimulus, so as to limit detection of resonance-antiresonance irregularities in effective output;

whereby said boundary-condition means control the resonance-antiresonace irregularities in effective output caused by the intrinsic normal modes of said oscillating medium.

In accordance with the present invention, said stimulus-interfacing means desirably comprises:

an asymmetrically positioned antinode belonging to a predetermined mode pattern of said oscillating medium, for asymmetrically and partially coupling said oscillating medium to said stimulus, so as to obtain a substantially high effective density of normal modes concurrently participating in reproducing said stimulus.

In accordance with the present invention, said stimulus-interfacing means desirably comprises:

A composite oscillating medium having at least two oscillating members coupled at said antinode while decoupled in the remaining area of said oscillating members, each of said oscillating members having distinct normal modes of oscillation and having associated characteristic frequencies interlaced in the frequency domain, for further increasing the effective density of modes.

In accordance with the present invention, such a transducer desirably incorporates perturbations in geometry of said oscillating member, for creating at least two coupled oscillating regions therein, each of said oscillating regions having distinct normal modes with associated characteristic frequencies interlaced in the frequency domain, so as to further increase said effective density of normal modes of said oscillating medium that concurrently participate in reproducing said stimulus.

In accordance with the present invention, said medium-interfacing means desirably comprises:

an asymmetrically positioned antinode belonging to a predetermined mode pattern of the oscillating medium, for asymmetrically and partially coupling said oscillating medium to said stimulus, so as to obtain a substantially high effective density of normal modes concurrently participating in reproducing said stimulus;

at least one outer baffle facing the oscillating medium and separated from the oscillating medium by a predetermined air-gap distance, said baffle having an asymmetrically positioned opening therein aligned with said antinode, so as to allow asymmetrical and partial coupling of the oscillating medium with said ambient medium through said opening.

Straightforward application of physics of oscillations is the main implementation criterion for a transducer with improved tonal quality in the present invention. Simplicity in construction, operation and cost-effectiveness of a preferred embodiment is demonstrated in a standalone device having no need for additional elements such as crossover networks, ancillary transducers or enclosures for artificially enriching the spectrum of reproduced sound. Accordingly, it is an object of my invention to provide a transducer with reduced irregularities in effective output caused by intrinsic resonances of the device main components.

Advantages of the present invention include the reduction of:

tonal quality irregularities caused by the normal modes of a symmetrically driven oscillating medium;

audibility of resonance-antiresonance irregularities caused by the normal modes of the oscillating medium;

occurrences of resonance-antiresonance irregularities caused by lower frequency modes of the oscillating medium;

coloration caused by resonances of structural components; and/or irregularities caused by resonances of complex circuitry.

A feature of the present invention is that it provides a transducer with reduced effective output irregularities caused by interference of components with reproduction and radiation of sound. In particular, embodiments of the present invention avoid, more or less, the following disadvantages of the prior art:

a magnet array structure interfering with radiation of emitted waves;

a magnet array structure with inherent air flow impedance interfering with the free motion of the coupled with air driven/radiating area;

an oscillating medium driven by strips of adhered thereon conductors oscillating out of phase with nondriven sections thereof;

an oscillating medium flapping against the magnet array structure at high amplitude low frequency displacements.

Another advantage of the present invention is that it provides a transducer with reduced effective output irregularities related to the propagation of sound in air, namely:

directionality of radiated sound;

acoustical properties of the listening room;

back-to-front-wave-leakage-phase cancellations;

back-to-front-wave-path destructive interference.

Yet another advantage of the present invention is that it provides a transducer with reduced effective output irregularities caused by distortions originating in mechanical or electrical properties of components, namely:

nonlinearity of forces exerted on current-carrying conductors;

weak mechanical coupling of conductors with driven/radiating area;

sparse distribution of conductors over driven/radiating area;

losses in impedance matching transformers;

losses in complex circuitry of filters and crossover networks;

sparse distribution of the magnetic field and of the resulting forces exerted throughout the driven/radiating area;

magnetic flux losses.

The following are further various features of some or all embodiments of the present invention:

the asymmetric coupling of the oscillating medium with ambient medium, the asymmetric coupling of oscillating thin films with each other, means for increasing normal modes density by interlacing resonance frequencies, driving an oscillating thin film at asymmetrically positioned antinode, the inner baffle as a non-oscillating component of the oscillating medium, the outer baffles as means for filtering out resonance irregularities, the inner and outer baffles contributing to definition of boundary conditions, the grid of conductors, the grid-shaped magnetic field, the hermetically sealed cavity with magnet array 'immersed' therein, linearity of exerted forces due to cavity-'immersed' magnetic field, phase-coherent forces exerted from constant pressure inside the cavity, impedance matching of oscillating with ambient medium by way of air in cavity, the absence of any driving components in front and back of driven area.

Objects and Advantages

A transducer of the present invention offers the advantage of a standalone, simple and cost-effective device, with predictable and controllable physical properties for reducing effective output irregularities. Such advantage is obtained as the result of:

A. Reduced effective output irregularities from intrinsic resonances caused by transducer components:

providing a transducer having an oscillating medium with a driven/radiating area therein defined by an asymmetrically positioned antinode belonging to a predetermined mode pattern, for limiting interference in the development of normal modes from disturbances that act in conflict with out-of-phase displacements of adjacent antinodes; the resulting high number of normal modes that participate in the process of reproducing the spectrum of a radiated waveform, leads to an effective output rich in overtones;

providing a transducer having an oscillating medium with modified effective dimensions from perturbations in boundary shape that cause multiple path, multiple length reflections of a propagated disturbance, for producing additional superposed standing waves; the resulting increased effective mode density limits perception of resonance-antiresonance irregularities and extends the effective frequency range of the transducer.

providing a transducer with an oscillating medium and a driven/radiating area therein defined by an asymmetrically positioned antinode belonging to a predetermined mode pattern, such oscillating medium suspended in the gap between two parallel baffles with asymmetrically positioned openings therein, such driven/radiating area aligned with, and interacting through, such openings with the ambient medium; the consequent masking of the oscillating medium nondriven area limits occurrences of resonance-antiresonance irregularities caused by the lower frequency normal modes, including the pronounced irregularity at the fundamental resonance frequency;

providing a transducer having component baffles with mutually destructive interference of inherent normal modes, for reducing coloration caused by resonances of such baffles;

providing a transducer having an oscillating medium driven by a simple, resistive circuit, with terminals directly coupled to a signal amplifying device, for eliminating inherent resonances of complex circuitry.

B. Reduced effective output irregularities from mechanical interference with the process of reproduction and radiation of sound caused by transducer components:

providing a transducer having the magnet array structure positioned within the driven/radiating area of the oscillating medium, for eliminating interference with propagation of emitted waves;

providing a transducer with grid-like magnet-array gaps giving rise to low air flow impedance, for reduced interference with the free motion of the coupled with air driven/radiating area;

providing a transducer having an oscillating medium with a driven/radiating area oscillating in-phase for every point thereof;

providing a transducer having an oscillating medium with an asymmetrically positioned driven/radiating area therein combined with an asymmetrically positioned boundary-perturbation and with reduced compressibility of air in multiple air-gaps between the layers of the oscillating components and the layers of the supporting baffles, for increased protection from relatively small driven/radiating area, flapping against the magnet array structure.

C. Reduced effective output irregularities from spurious acoustical phenomena caused by propagation of sound in air:

providing a transducer with a baffle area having adjustable orientation for controlling directionality of radiated sound;

providing a transducer having an oscillating medium with air entrapped therein, suspended in the air gap between two parallel baffles, with each of such baffles having an asymmetrically positioned and limited size opening therein, for reduced dependence on the acoustical properties of the listening room, that is, for restricting irregularities from the interaction of the air volume normal modes with the oscillating medium motion; such oscillating medium interacts with the ambient air through each of such openings as well as by way of such entrapped air and by way of air in such air gap, for improved acoustic impedance matching with ambient air;

providing a transducer having a driven/radiating area aligned with an opening in a baffle, such baffle being relatively large with respect to such opening, for restricting irregularities from the back-to-front-wave-leakage-phase cancellations;

providing a transducer having a driven/radiating area aligned with an opening in a baffle, such opening asymmetrically positioned in such baffle, for restricting irregularities from the back-to-front-wave-path destructive interference.

D. Reduced effective output irregularities from distortions caused by components:

providing a transducer with a magnet array structure having a practically constant magnetic field, for exerting linear push-pull forces on current-carrying conductors within limits of high amplitude excursions of driven/radiating area;

providing a transducer having a driven/radiating area with conductors adhered thereon forming a grid-shaped assembly, for strong mechanical coupling of such conductors with such driven/radiating area;

providing a transducer having a driven/radiating area with conductors adhered thereon forming a grid-shaped assembly, for a more uniform distribution of electric current in such conductors over such driven/radiating area;

providing a transducer having a driven/radiating area with conductors adhered thereon forming a grid-shaped assembly resulting in higher impedance from a longer conductor path, for matching from the outset the impedance of a signal amplifying device;

providing a transducer having an oscillating medium driven by a simple, resistive circuit, with terminals directly coupled to a signal amplifying device, for preventing inherent distortions of complex circuitry;

providing a transducer with a grid-shaped magnet array forming a grid-shaped magnetic field that is aligned with the grid-shaped current-carrying conductors, for a more uniform distribution throughout the driven/radiating area of the magnetic field and of the resulting exerted forces;

providing a transducer with a grid-shaped magnet array structure using no pole piece, for a minimum in magnetic flux losses;

Providing a transducer with a strip-shaped magnet array structure having no pole piece, for minimal magnetic flux losses.

Further advantages and features of the present invention are to provide an electroacoustic transducer of modular design for cost-effective construction and repair. Also to provide an electroacoustic transducer for cost-effective updating, as technology improves in both thin-film materials and electromagnetic or electrostatic driving structures. Still further advantages and features will become apparent from the ensuing drawings and description.

The principle of operation of the present electroacoustic transducer is identical with any other such transducer in the sense that the oscillating medium radiates acoustic energy when stimulated by an electric signal or, conversely, the oscillating medium generates an electric signal when stimulated by a mechanical disturbance. The present invention provides an electroacoustic transducer for accurate and faithful reproduction of a received stimulus. This means that a received stimulus, affected by accuracy deviations along the path from sound at source to the transducer, is left with such deviations undisturbed, therefore audible when reproduced; there is no attempt to reprocess the signal through additional circuitry and no enrichment of reproduced sound by additional transducers or resonators. Furthermore, the fact that the oscillating medium, just like any other oscillating body, resonates at various characteristic frequencies is accepted as such; that is, no attempt is made to suppress resonances. On the contrary, standing waves manifested as mode patterns of the oscillating medium are exploited as means for minimizing inherent effective output irregularities at resonance frequencies, by limiting their perception and occurrence.

In accordance with the present invention, the following are preferred:

said ambient medium is atmospheric air;

said effective range frequencies are within normal human hearing limits;

said oscillating medium is a rectangular thin film coupled to and driven by said stimulus at said asymmetrically positioned antinode.

In accordance with the present invention, the oscillating medium desirably comprises:

a layered assembly of two rectangular parallel oscillating thin films with a substantially massive, rigid, rectangular inner baffle therebetween, having outside dimensions corresponding to the dimensions of said thin films;

said inner baffle having a rectangular inner-baffle opening asymmetrically positioned therein and aligned with said asymmetrically positioned antinode; each of said thin films being stretched with predetermined tension on a rectangular inner-baffle spacer of predetermined thickness, bordering each side of said inner baffle and defining boundary geometry of each of said thin films;

said predetermined tension defining interlacing positions in the frequency domain of characteristic frequencies associated with the normal modes of oscillation of each of said thin films;

each of said thin films being suspended parallel with, and at air-gap spacing, from said inner baffle by said inner-baffle spacer, while forming in combination with said inner-baffle spacer and said inner baffle, a hermetically sealed cavity with air entrapped therein;

said thin films being coupled at said antinode, through said inner-baffle opening, by air entrapped in said cavity, for maximizing interaction of modes in said antinode driven area;

said inner baffle decoupling said thin films in the remaining nondriven area, for limiting interaction of modes thereof;

air oscillating in said cavity substantially matching the impedance between said oscillating medium and air of said ambient medium, for optimizing acoustic energy exchange between the two media;

whereby said oscillating medium constitutes a layered module of two oscillating thin films with an inner baffle therebetween forming an oscillating air-sealed cavity coupling asymmetrically and partially said two oscillating thin films.

Such a transducer in accordance with the present invention desirably further comprises:

clamps (desirably right-angle triangles) introduced as predetermined perturbations in geometry of each of said thin films, which alter said boundary conditions of said oscillating medium and define distinct oscillating regions in each of said thin films with additional said characteristic frequencies interlaced in the frequency domain; and rectangular clamps (desirably narrow) introduced as variable perturbations in geometry of said oscillating thin films, which alter the area size of each of said oscillating regions and fine-tune, by shifting, the interlaced positions of said characteristic frequencies in the frequency domain for each of said oscillating regions;

whereby said boundary conditions of said oscillating medium are component-determined by said inner baffle in combination with each said inner-baffle spacer and said perturbations in geometry of said oscillating medium.

Such a transducer in accordance with the present invention desirably further comprises a pair of parallel outer baffles of shape and size substantially identical with said inner baffle, each of said outer baffles having an asymmetrically positioned outer-baffle opening therein and a rectangular outer-baffle spacer of predetermined thickness bordering the inner side of each of said outer baffles;

a sandwich configuration of said two outer baffles with said oscillating medium suspended at air-gap spacing therebetween by said outer-baffle spacers, and having said asymmetrically positioned outer-baffle opening therein aligned with said antinode for asymmetrically and partially coupling said oscillating medium with said ambient medium;

whereby air oscillating in said air-gap spacing affects advantageously the impedance matching between said oscillating medium and air of said ambient medium, for improved acoustic energy exchange between the two media.

Such a transducer desirably also includes:

a hinged baffle extending the area of said outer baffles while supporting the transducer in upright position;

whereby said boundary conditions of said oscillating medium are physically determined by the combination of said outer baffles, said inner baffle, each said outer-baffle spacer, each said inner-baffle spacer, air in each air-gap spacing, said perturbations in geometry of said oscillating medium and said hinged baffle extension.

In a transducer of the present invention as described above, said driving means desirably comprises:

an assembly of current-carrying grid of conductors secured to each said antinode;

a frame-like magnet array, flush-mounted in each said outer-baffle opening;

a panel-like magnet array flush-mounted in said inner-baffle opening;

said frame-like magnet array and said panel-like magnet array being so disposed as to expose concurrently and in combination said grid of conductors of each said antinode to a substantially uniform magnetic field within the space defined by extreme amplitude displacements of each said antinode, so that forces exerted on said current-carrying conductors are substantially linear;

said air-sealed cavity in said oscillating medium having constant air pressure from said two thin films moving in tandem so that forces per area unit of oscillating medium are uniform and in-phase; air in said cavity having substantially constant pressure for uniform and in-phase oscillating forces per unit area of said antinode of each of said thin films;

whereby said driving means are external and internal elements of said oscillating medium.

In the disclosed principal embodiment of the invention, said oscillating medium is an assembly of two opposed and parallel thin films that form an air sealed cavity when stretched on spacers bordering an inner baffle therebetween; said inner baffle having a baffle opening asymmetrically positioned therein. Said baffle opening is aligned with (facing) an antinode positioned asymmetrically in the geometric pattern of the fourth mode of oscillation of each of said thin films, so that said two thin films "see each other's asymmetrically positioned antinode" through said asymmetrically positioned baffle opening in the therebetween baffle. The air in said hermetically sealed cavity couples asymmetrically the two thin films, at each antinode area because of the inner baffle decoupling them in the remaining area. Said antinode area interfaces an applied stimulus with the oscillating medium. Said spacers, in combination with the inner baffle, are part of the components defining boundary conditions of the oscillating medium in the context of the application.

The stimulus is applied concurrently on said asymmetrically positioned antinode of each of said thin films, for an initially high density of normal modes participating in the reproduction of said applied stimulus. There is a further increase in density of modes resulting from the two thin films being stretched with different tensions. This leads to the resonance (characteristic) frequencies of each of said thin films being shifted with respect to each other so that they become interlaced in the frequency domain.

Triangular clamps introduced as perturbations in the geometry of each thin film alter boundary conditions of the oscillating medium and define distinct oscillating regions within each of said thin films. Said regions, with own modes of oscillation and with associated characteristic frequencies shifted and interlaced in the frequency domain, afford an even further increase in the density of modes. The resulting high effective density of normal modes limits perception (audibility) of resonance irregularities in the spectrum of the reproduced waveform.

Two outer baffles, similar in geometry to said inner baffle, form a sandwich assembly with the oscillating medium 'suspended' on spacers therebetween, in a configuration analogous to the oscillating medium assembly itself.

The outer baffles serve to filter out the irregularities caused by normal modes associated with resonance frequencies lower than or equal to the resonance frequency associated with the selected forth normal mode defining said antinode. In fact, the baffles enforce asymmetrical and partial coupling of the oscillating with the ambient medium because of each asymmetrically positioned baffle opening. Note: Where, for brevity, I say resonance irregularities, I refer to what is described more specifically herein "resonance-antiresonance irregularities". Simply put, for a mode pattern with an even number of antinodes, there is an antiresonance minimum (dip in effective output) and for a mode pattern with an odd number of antinodes there is a resonance maximum (peak in effective output).

The two thin films are displaced in tandem; hence the air in the hermetically sealed cavity is forced to oscillate in tandem with the two thin films. Since the oscillating medium contains hermetically sealed atmospheric air and, since the thin films are so thin that can be considered acoustically transparent, there is superior matching of impedance between the oscillating medium and the ambient medium. Furthermore, air in the gap between the outer (and inner) baffles and the thin films oscillates as it is 'sucked in and squeezed out' during the displacements of the oscillating medium. Since this gap-air is strongly coupled (attached) to the oscillating medium, it follows closely the oscillating motion thereof, for a further improvement in matching the impedance of the two media. Also, the inherent asymmetry of the device induces variable mechanical impedance of the oscillating medium by way of the gap-air: higher for the lower-frequency-producing sections (hearing mechanism less sensitive) and lower for the higher-frequency-producing sections (hearing mechanism more sensitive). This provides an efficient exchange of energy between the oscillating medium and the ambient medium and for an effective output adapted to the properties of the hearing mechanism.

The antinode in each of said thin films is driven by oscillating currents flowing through a grid of conductors 'flooded' by a magnetic field that follows, with an identical grid pattern, said grid of conductors. Said magnetic field is generated by a panel array of magnets flush-mounted in said inner baffle and by a frame array of magnets flush-mounted in each of said outer baffles. The resultant magnetic field is essentially immersed in the volume space of the oscillating medium (the hermetically sealed cavity). The grid pattern offers superior coupling of the conductors with the oscillating medium compared to existing methods using parallel strips of conductors.

Forces exerted on the current-carrying conductors are linear within large amplitude limits of the driven antinode. This linearity of forces is due to the fact that the magnetic field originates within the cavity of the oscillating medium itself. Since the air sealed cavity moves in tandem with the two thin films, the pressure therein is constant. A constant pressure gives rise to forces per unit of thin-film area that are exerted in-phase for every point of the oscillating medium. Because the magnet array is 'immersed' inside the cavity of the oscillating medium, the antinode area is fully exposed to the environment on both sides (front and back) of the transducer.

There is also no need for a perforated ferromagnetic backplate interfering with the free motion of air volume displaced by the oscillating medium. Generally, backplates redirect the magnetic flux towards the conductors. However the magnetic circuit of the panel magnet array is open, creating a grid-shaped magnetic flux directed to said grid of conductors on both sides of said array.

Preferred embodiments of this invention make use of a set of two vibrating thin films, which constitute the basic transducer structure. These films are put in tension to different degrees so their resonances are interlaced within the frequency spectrum. The thin films are put into vibration by audio frequency electrical signals from an amplifier which circulates audio currents in a series combination copper and aluminum coils adhered to the surfaces of the two thin films. The changing magnetic fields produced by the audio currents cause attraction and repulsion from the adjacent magnetic field of a permanent magnet array, producing a vibrating motion of the thin films. The vibrating films are coupled to the surrounding air medium where waves are propagated outward into a listening room or the surrounding air.

Aluminum and small diameter copper wire, a composite assembly, can form a current-carrying member affixed to the film surfaces. Such current-carrying member and its method of fabrication are part of the present invention. Signal current flows in series fashion through both conductors, resulting in a longer length, hence a denser signal field with better cooling characteristics. The added length of series conductors raises the impedance of the conductor path, adhered to the film surfaces, and makes matching to driving amplifiers possible with no output transformer needed.

A magnet array constituting a multiplicity of rare earth magnets is mounted on a supporting surface within the enclosed volume between the two thin film diaphragms and brought within close range of the coil structure adhered to the two vibrating thin films. Care is taken to maintain adequate clearance between the plane of the magnet array and the surface of the thin film. The rare earth magnets produce a powerful and adequate field to propel the thin film magnets and allow free movement without restricting the space between the magnets and the film surface.

A set of three baffles are incorporated as part the aforesaid preferred transducer assembly. There are one inner baffle and two outer baffles. The inner baffle is sandwiched between the two vibrating films and forms a sealed chamber with them. The two vibrating films are coupled through the asymmetrically located port (opening, open area) in the inner baffle; this enforces an asymmetrical and partial coupling of the oscillating thin films with each other.

The two outer baffles are on the outside surfaces of the two vibrating films. Each outer baffle has a port cut therein with area considerably smaller than the areas of the two vibrating films. This port is asymmetrically positioned with respect to the edge of each baffle and with respect to the edge of the two vibrating films.

The port, or open area, in both inner and outer baffles, enforces asymmetrical coupling between the inner sealed air cavity and the ambient surrounding air.

The combination of the vibrating films, the magnet array, and the inner and outer baffle provide a transducer in accordance with this invention.

The aluminum coils adhered on the vibrating films are made of aluminum foil and insulated copper wire. The aluminum coils may be cut from thin sheet stock on a template. The copper is preferably adhered to the aluminum foil and held in place by heat seal adhesive.

As assembly proceeds, the small diameter copper wire is hooked in series with the aluminum coils all adhered to the thin film diaphragm surface. This results in three advantages.

Firstly, the electromagnetic field produced by the circulating current is stronger because the total current intensity is higher since there are two sets of conductors, or double the number of windings, with a slight increase in resistance from the aluminum conductors. Secondly, part of the heat generated by the insulated thin copper wires is dissipated by the aluminum conductors that act also as heat-sinks due to their relatively large area in contact with ambient air. Thirdly because the conductor, copper wire plus aluminum, is longer, it has higher electrical impedance and matches the output of the amplifier without a matching transformer, lowering cost, and removing a cause for distortion due to power losses in windings and the ferromagnetic hysteresis losses in the iron core required by the transformer.

The air sealed in the chamber between the two thin films contributes to superior matching of acoustic impedance between the vibrating films and the ambient air, resulting in more efficient output from the transducer.

Part of this invention involves clamping selected areas of the vibrating thin films for the purpose of increasing the number of superposed standing waves thereon, giving rise to an increased effective density of modes participating in the production of a smooth audio output.

Another part of this invention involves using baffles, opening in baffles, and oscillating medium in combination, to limit output from resonance-antiresonance irregularities, thus contributing to smooth reproduction across the prescribed frequency range of the transducer.

An aspect of this invention involves altering boundary conditions of vibrating thin film so as to change physical position and associated resonance frequency of antinodal areas, thus producing acoustic output over a broad range and reducing resonance-antiresonance extremes in the output response of the thin film assembly.

Another aspect of this invention involves using clamps on selected edges of vibrating thin film for adjusting the modes of vibration, so as to spread vibrational energy across the operating spectrum of the transducer.

The present invention provides a composite module for radiating sound energy, with the module advantageously comprising: at least two thin vibrating films held in varying degrees of tension, between spacers and with electrically conducting members attached thereto; at least one inner baffle which maintains spacing between said vibrating thin films and which together constitute a sealed, tunable air chamber; two outer baffles with asymmetrically located ports therein; having a permanent magnet array for driving said thin vibrating films.

It is a feature of the present invention to make the radiating area of transducer relatively small so that directionality effects are minimized.

It is another feature of the present invention to limit influence of listening room acoustics, by way of selective coupling between vibrating elements and the room volume. This is accomplished by using baffles with asymmetric and relatively small ports therein.

It is another feature of the present invention to provide a magnet array and films with space therebetween having minimum obstruction, to allow air to move freely through the transducer assembly. By use of powerful and thereby relatively small rare earth magnets, significant space between the magnets and the coils on the oscillating film can be accomplished.

Yet another feature of the present invention is a magnet array layout to provide a linear field to drive thin films with current-carrying members adhered thereon. Having the thin films immersed in a magnetic field from an inner and two outer magnet arrays gives rise to a linear field, through which the coils pass and produce output with minimum waveform distortion.

A preferred embodiment of my invention is an electroacoustic transducer having one inner and two outer modules assembled as a sandwich configuration of three rectangular panels, attached to a baffle of similar dimensions movably secured thereto, as by a hinge, and with: an inner module forming a layered composite oscillating medium assembly of two stretched parallel thin films and an inner baffle therebetween; each of these thin films are distanced from the inner baffle by way of a rectangular frame-like spacer bordering the inner module and each of the thin films so as to form an air-sealed cavity while defining boundaries for each of the thin films.

Each of the thin films has a driven/radiating area at an extreme asymmetrical position and coincident with an antinode belonging to a predetermined mode pattern as dictated by geometry of such boundary; this inner baffle has an opening asymmetrically positioned, and aligned with the driven/radiating area. These thin films are coupled through the opening by air entrapped in such cavity, while decoupled by the inner baffle in the remaining, nondriven area. A geometrical perturbation is applied to the boundary of each of the thin films, defining two oscillating regions therein and coupled by way of such driven/radiating area. Each of the outer modules has an outer baffle having an asymmetrically positioned open area therein, aligned with such driven/radiating area. The thin films are coupled with the ambient medium, in the driven/radiating area, through such opening.

An assembly of current-carrying conductors adhered to the driven/radiating area is exposed to three magnetic fields: from a frame-like magnet array, flush-mounted in the opening of each outer baffle, and from a panel-like magnet array also flush-mounted in the opening of the inner baffle. The extension baffle extends the area of each outer baffle while supporting the device in an upright position. Each baffle desirably has a different thickness.

The present invention provides a transducer having an oscillating medium with predetermined boundary conditions, for accurate reproduction of a stimulus applied thereupon, by employing certain novel design methods, as stated below. Each of these methods is part of the present invention:

Limiting detection resonance-antiresonance irregularities in effective output caused by normal modes of oscillation of the oscillating medium. This is in effect a "contrarian" approach, by exploiting inherent properties of said modes rather than by suppressing said modes.

Deriving a high density of normal modes participating in reproducing a stimulus by applying said stimulus on an asymmetrically positioned antinode of oscillating components belonging to said oscillating medium.

Increasing the density of normal modes of the oscillation medium by altering boundary conditions, so as to limit detection of irregularities. This means producing an effective spectrum with resonance frequencies so close to each other, in the frequency domain, that they become difficult to detect. A "masking out" effect.

Screening out irregularities in effective output in the low frequency range by further altering boundary conditions of the oscillating medium. This screening-out process limits occurrences of irregularities by eliminating the effect of all resonance frequencies at and below the resonance frequency associated with a predetermined normal mode oscillation.

Optimizing the exchange of energy between oscillating and ambient medium by incorporating in the oscillating medium a component matching the impedance of the ambient medium, preferably a substance contained in the ambient medium.

Limiting the effective output distortions by driving (applying said stimulus on) said antinode of the oscillating medium through linear and phase-coherent forces per unit area of oscillating medium.

Limiting the interference by a driving said oscillating medium structure, with the process of reproducing an applied on the oscillating medium stimulus.

BRIEF DESCRIPTION OF DRAWINGS

FIG. 13A1 is an exploded plan view showing separately three layers, two of which are conductors and one of which is an array of magnets, for use in a driving assembly in accordance with the present invention.

FIG. 13A2 is a plan view in which the layers shown in FIG. 13A1 are assembled.

FIG. 14A1 is an exploded plan view showing separately three layers, two of which are conductors and one of which is a film, for use in a driving assembly in accordance with the present invention.

FIG. 14A2 is a plan view in which the layers shown in FIG. 14A1 are assembled.

FIG. 15C Tables 1 and 2 are tables of resonance frequencies, containing calculated ratios of (higher) resonance frequencies to the (lowest) fundamental frequency.

Note: in FIGS. 16A to 16B, the only magnet array used is the one immersed in the oscillating medium and it consists of two parallel rows of magnets of opposite polarity. Also, the outer baffles have opening with oblique edges for higher dispersion of waves.

REFERENCE NUMERALS IN DRAWINGS

Figure 1:
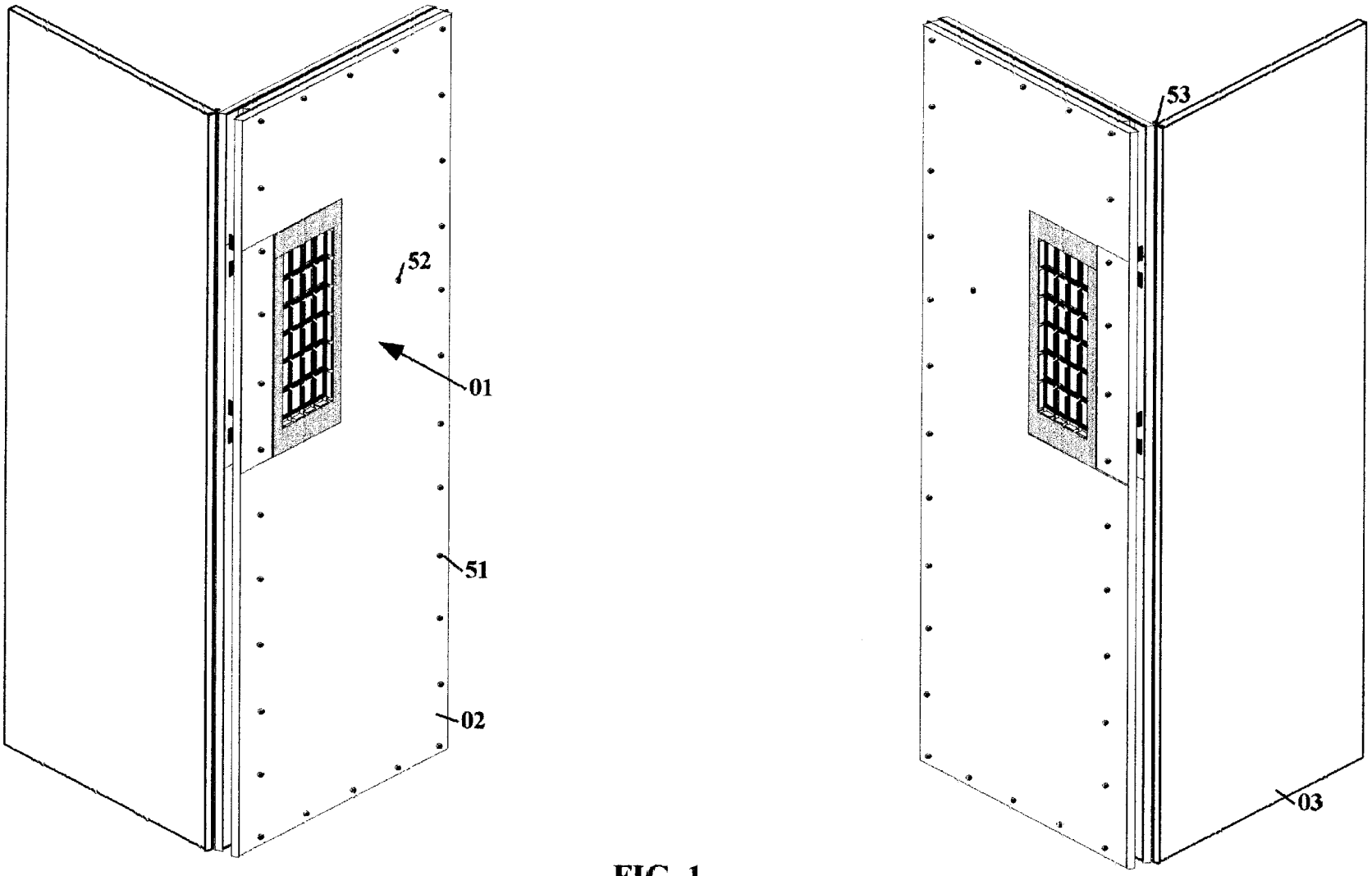
FIG. 1 is a perspective view of a pair of free-standing transducers of the present invention supported by hinged baffles.

Unless the context requires otherwise, the following reference numerals refer to the following elements in the drawings:

00 Transducer: a layered assembly of an (inner) oscillating-medium module suspended between two (outer) baffle modules

- 01 Open area in baffle: asymmetrically positioned therein, exposing a predetermined section of the oscillating medium
- 02 Assembled baffles: three layers of baffles with 01 therein
- 03 Baffle extension of 02 and support: hinged, door-like panel

10 Module: layered components

- 11 Outer baffle: of predetermined thickness, outside layer of 00, with 01 and 21 therein
- 12 Inner baffle: of predetermined thickness, inside layer of the oscillating medium, with 01 and 22 therein
- 13 Thin film: outside layer of the oscillating medium, driven at section therein with area and position predetermined by an asymmetrically positioned antinode aligned with 01
- 14 Frame-like spacer: maintaining gap between 13 and 11, and between 13 and 12
- 15 Hole: to pass screw

20 Magnet assembly: rectangular

- 21 Frame-like array: in 01 of 11
- 22 Panel-like array: in 01 of 12
- 23 Steel pole piece: for 21
- 24 Thin beam: supporting 22
- 25 Gap: within array

30 Clamp: for thin film

- 31 Triangular: as a perturbation in geometry of 13
- 32 Rectangular: for fine adjusting lower frequency regions
- 33 Rectangular: for fine adjusting higher frequency regions
- 34 Hole: to pass screw

40 Conductor/connector: electric

- 41 Aluminum: adhered on 13
- 42 Insulated copper wire: adhered between 13 and 41
- 43 Cable: imaginary
- 44 Cutaway: in aluminum foil
- 45 Sense of current: in conductors
- 46 Sense of current: in imaginary conductors
- 47 Hole: to pass screw

50 Hardware: tooling, parts

- 51 Screw: assembling
- 52 Screw: clamping
- 53 Hinge: baffle extension 03
- 54 Paper cutter: for cutting 41
- 55 Adhesive: heat resistant
- 56 Template: for conductor pattern
- 57 Waxed paper: for cutting 41
- 58 Cutting mat: for 54

60 Oscillations: thin film

- 61 Propagated disturbance: sense and direction
- 62 Disturbance propagating in both oscillating regions: not affected by 31 as a perturbation in geometry of 13
- 63 Disturbance in lower frequency
- 64 Disturbance in higher frequency region: produced by geometry perturbation in 13
- 65 Parameter sense and direction of change: increasing compliance, effective mass and damping
- 66 Node: defining mode pattern
- 67 Antinode: rectangular area
- 68 Sense of displacement sign: for antinode 67

DETAILED DESCRIPTION

Referring to the drawings, I now describe in greater detail various embodiments of the present invention, as well as its operating principles.

Figure 2A:
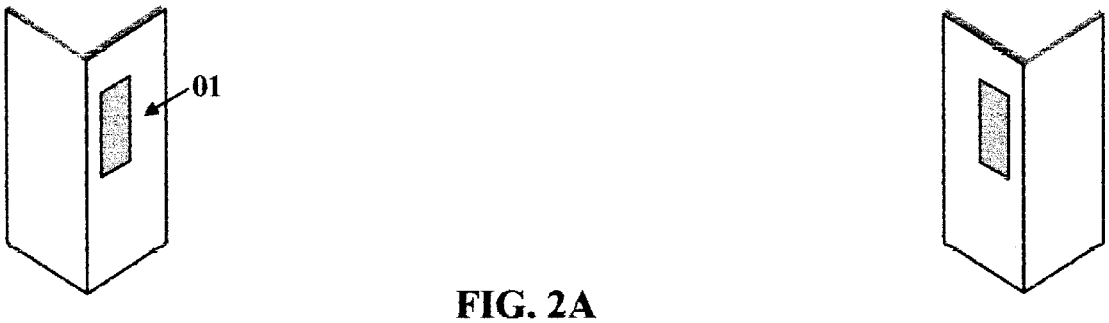
FIGS. 2A to 2D are diagrammatic perspective views of a pair of transducers of FIG. 1 in various free-standing positions.
Figure 2B:
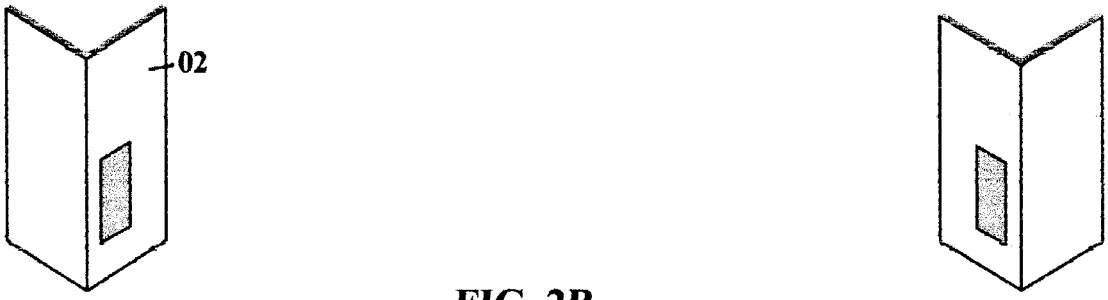
Figure 2C:
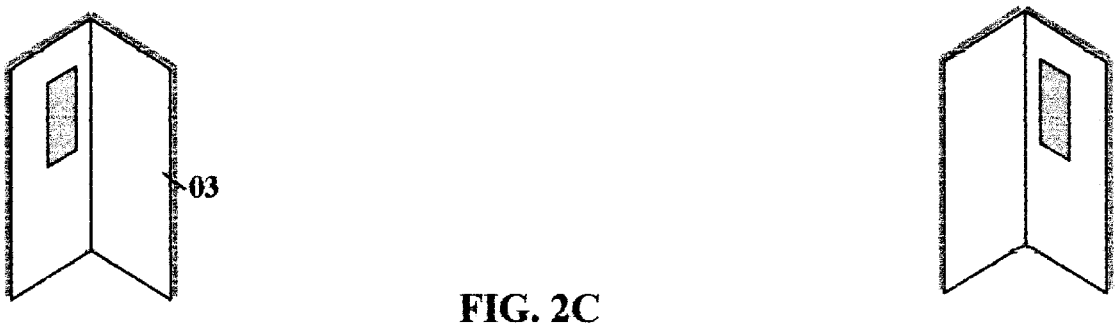
Figure 2D:
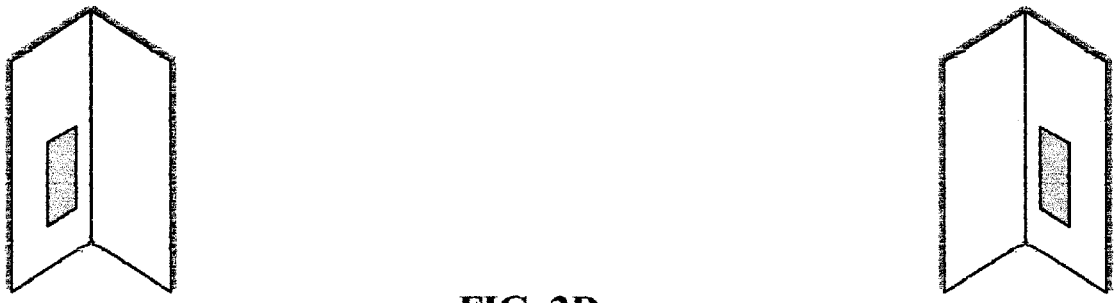
Figure 3A:
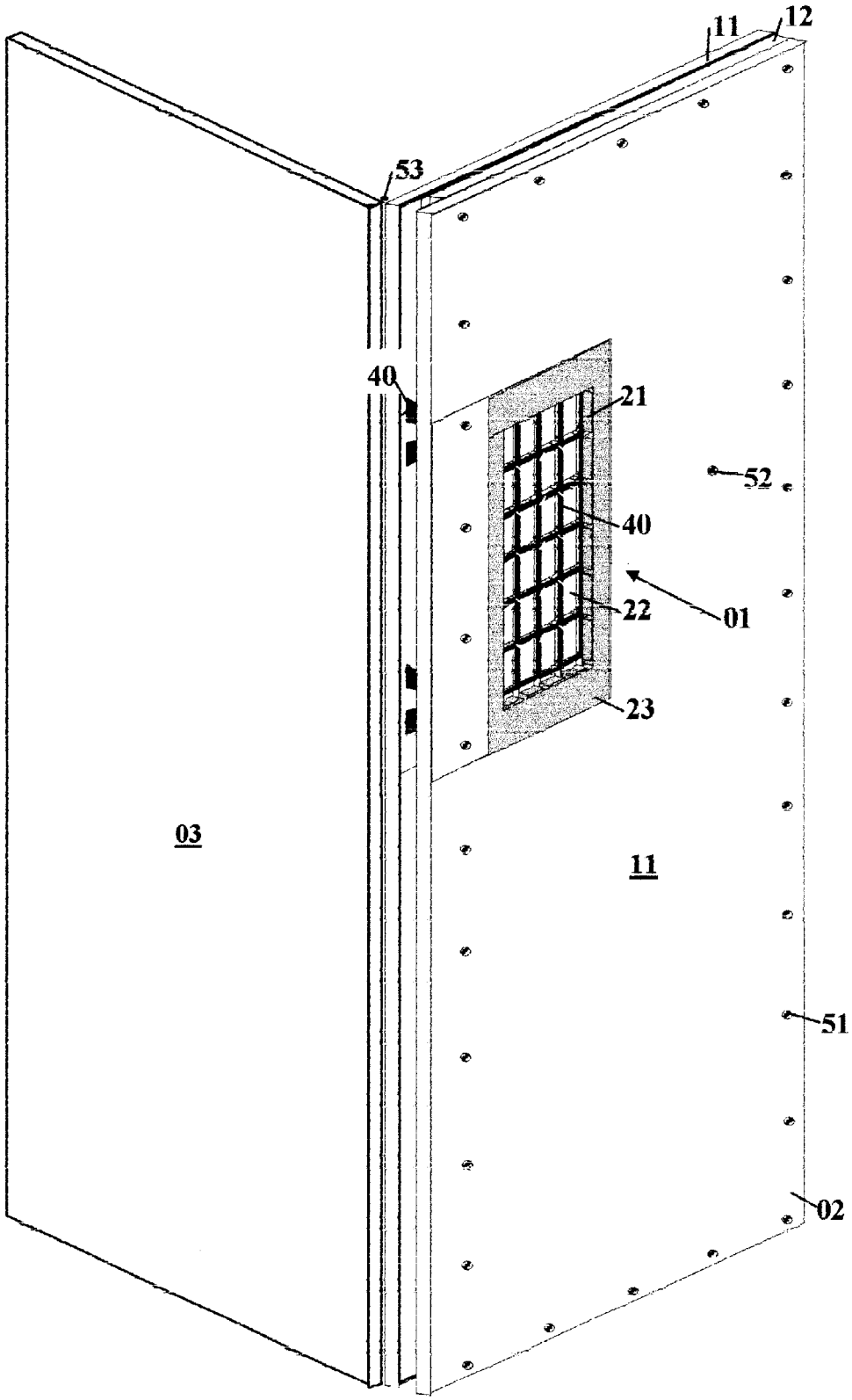
FIG. 3A is a perspective view of one of the transducers of FIG. 1.
Figure 3B:
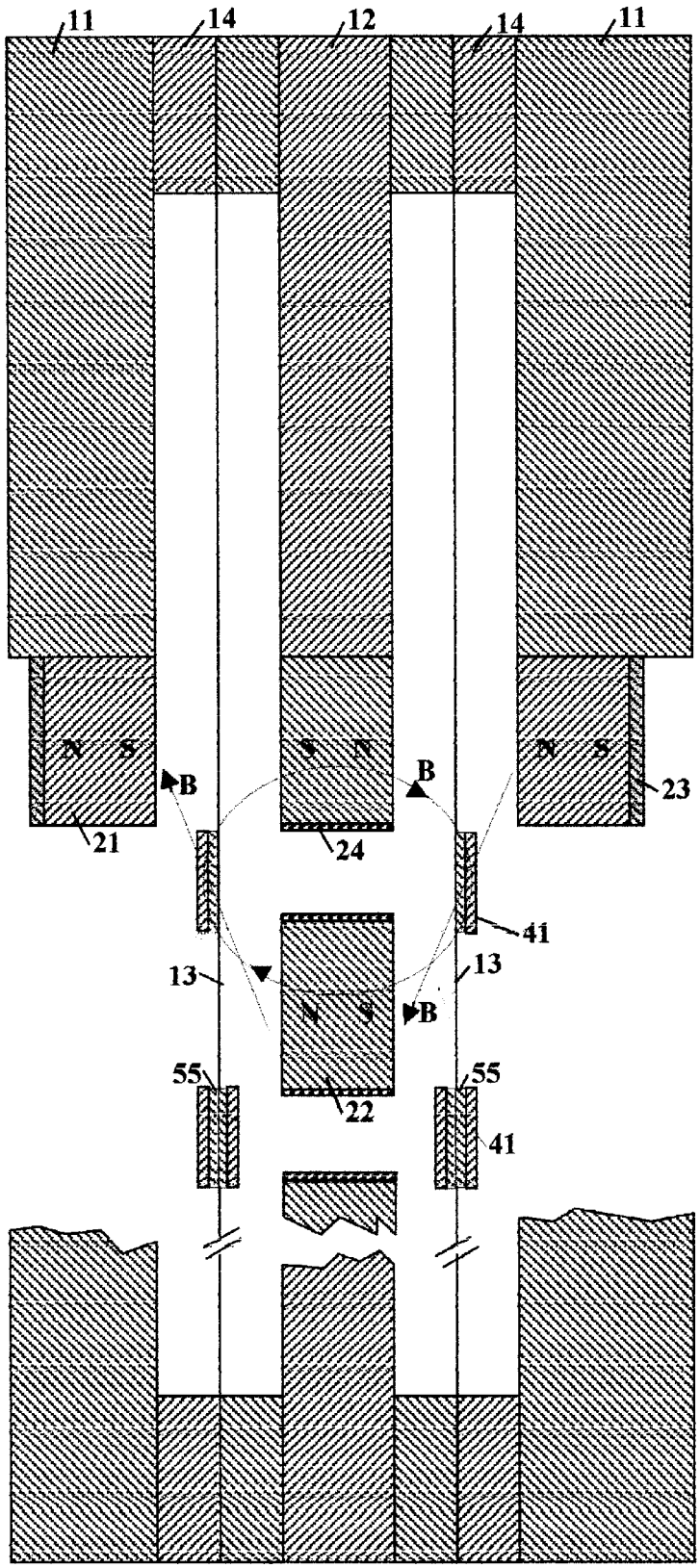
FIG. 3B is a diagrammatic cross section of a transducer of the present invention.

A typical configuration of a preferred embodiment of the present invention consists of a pair of transducers 00 arranged as shown in FIG. 1. The asymmetrically positioned open area 01 in baffle 02 along with hinged baffle 03 allow a variety of distinct mirror image arrangements as illustrated in FIGS. 2A to 2D. A modular, sandwich-like construction stands out in the close-up view shown in FIGS. 3A to 3B, where an exaggerated cross section of the transducer with the hinged baffle removed shows three layered modules. FIG. 3A is a close-up view of a transducer from FIG. 1 without the hinged baffle, showing a sandwich-like (layered) modular construction with one inner and two outer modules. FIG. 3B is a cross section of the transducer without the hinged baffle.

Note: The modules are different in thickness, from each other and from the extension baffle hinged thereto.

The typical and preferred embodiment of present invention consists of three layered sandwich-like modules, two outer baffles 11 and one inner baffle 12, attached to a hinged baffle 03. The four baffles have slightly different resonance frequencies by way of different mass and elasticity resulting from difference in thickness. The shifted with respect to each other resonance frequencies give rise to mutually destructive (and desirable) interference among the modes of the baffles for preventing pronounced (reinforced) audibility of irregularities from coincidence of associated modes. A similar method is used in manufacturing double windows for acoustical insulation of quiet environments such as building interior spaces or control rooms in recording studios.

As shown in FIGS. 1 to 3A, the asymmetric position in baffle assembly 02 of the open area 01 in combination with hinged baffle 03 allow a variety of possibilities for controlling back or front of the transducer first reflections. The combination of baffle assembly 02, baffle extension 03 and the floor form a trihedron with useful properties when the planes of the baffle assembly, of the baffle extension and of the floor are perpendicular to each other. FIGS. 2A to 2D show possibilities of preventing transducer uncontrollable first reflections on the side walls of the listening room by way of controlling early reflections from the transducer baffles and the floor.

An alternative way of regarding such control of early reflections is that the combination of baffle assembly 02, baffle extension 03 and the floor offers a mechanism for controlling dispersion of emitted sound. This is the reverse of the sonar and radar application whereby targets made of three circular plates perpendicular to each other return a received signal as a double-plate reflection to the source location. In the present invention, the trihedron consisting of baffle assembly 02 with open area 01 and driven/radiating area therein, hinged baffle 03 and the floor, emits sound as if reflected from imaginary sources located in front (FIGS. 2C to 2D) or back (FIGS. 1 to 2B and FIG. 3A) of the transducer.

Figure 4:
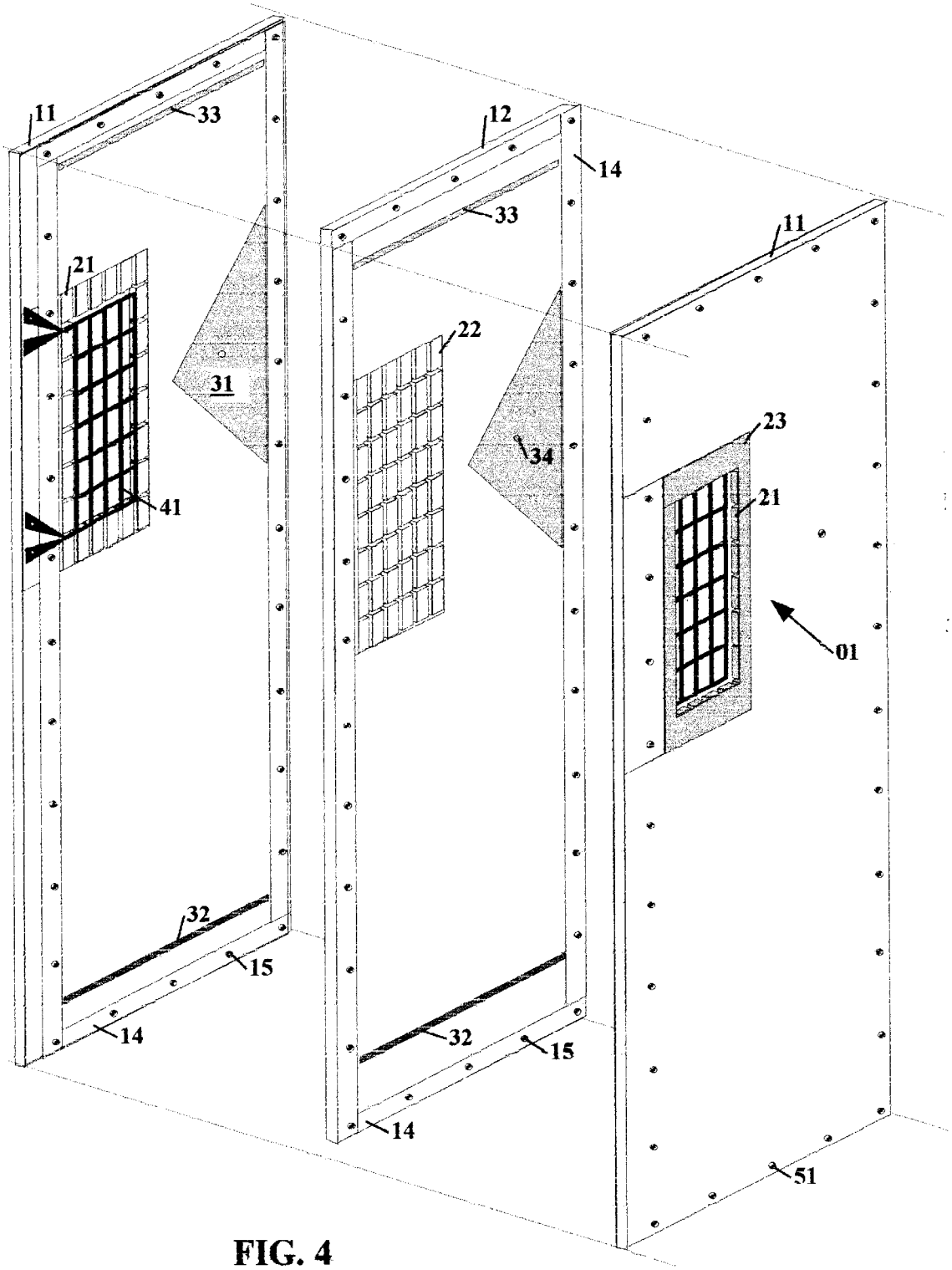
FIG. 4 is a partially exploded perspective view of the transducer of FIG. 3A, without the hinged extension 03.

The three modules shown in FIG. 4 are made of massive and rigid baffles 11 (outer) and 12 (inner) with asymmetrically positioned openings 01 and magnet arrays 21 and 22 flush-mounted therein. The thickness of inner baffle 12 is equal to the thickness of the magnets 22, typically 1 to 2 cm. The outer baffle 11 has thickness at least equal to the sum of the thickness of the magnet array 21 plus the thickness of the pole piece 23. The outer baffles 11 differ in thickness by approximately 20% with the thinner of the baffles 11 differing by approximately 20% from the inner baffle 12. The hinged baffle 03 is thicker by about 20% than the thicker of the two baffles 11. Suitable materials for the panels are Medium Density Fiber (MDF), plywood, Plexiglas (acrylic), ebonite, marble, or the like. The magnets are typically parallelepiped in shape, either ceramic or rare earth magnets. The rare earth magnets provide superior performance and with no significant compromise in cost because fewer in number are sufficient.

The magnet assembly 22 is supported by thin beams 24 made of wood or plastic adhered thereon to form a suspended magnet structure in open area 01 of inner baffle 12. The magnet assemblies 21 are adhered along with pole pieces 23 directly to the edge of the openings in outer baffles 11. Magnet assemblies 21 by being aligned with periphery of magnet assembly 22 reinforces the peripheral magnetic field in order to compensate for lower current intensity due to the existence of only one conductor instead of two in the periphery of the grid formed by conductors 41.

As illustrated in FIG. 3B, two parallel thin films 13 form a hermetically sealed cavity with air contained therein. The distance between the parallel thin films is equal to the sum of the thickness of the magnet array 22 (or panel 12) and the total thickness of two frame-like spacers 14, as shown in FIG. 3B. The thin film is Kapton Type 30HN of thickness 7.5 microns, a polyamide (nylon) film with excellent mechanical (Young modulus), electrical (dielectric strength), thermal (heat dissipation) properties, made by Du Pont Electronics. The spacers are made of pressed cardboard or any plastic material 2 to 3 mm thick and 5 cm wide. To achieve superior seal, nonporous materials such as plastics are preferable for baffles 11, 12 and frame-like spacers 14.

Note: The assembly of the two parallel thin films 13, the conductors 41 adhered thereon, the pair of frame-like spacers 14, the air layer and the inner baffle 12 in the cavity separating the two thin films constitute the oscillating medium in the context of the present invention. The inner baffle 12 and the frame-like spacers 14, though not oscillating bodies as such, help determine the properties of the oscillating medium.

Figure 5:
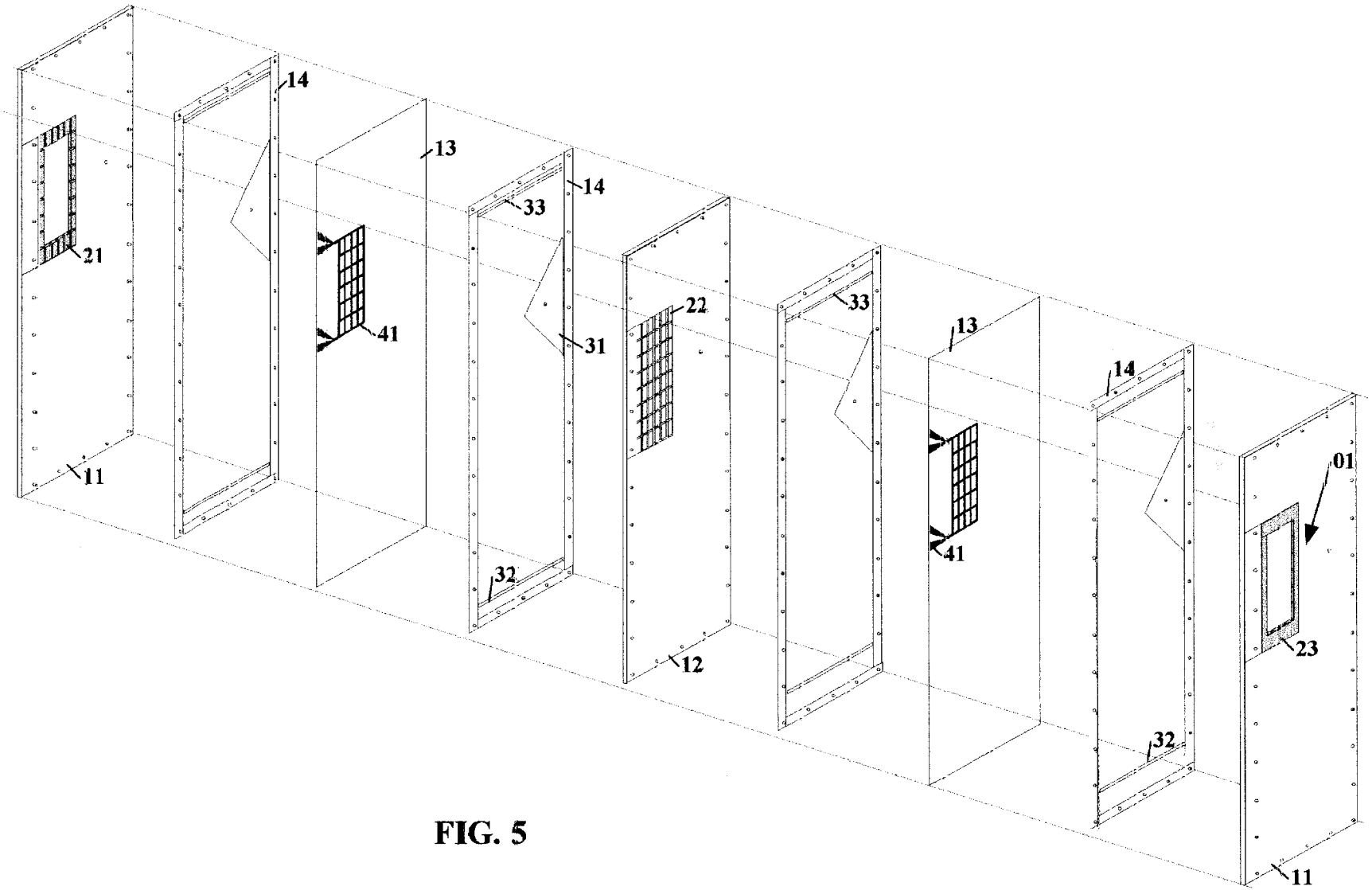
FIG. 5 is a fully exploded diagrammatic perspective view of the transducer of FIG. 4.

FIG. 4 shows an exploded view of the three modules while FIG. 5 shows an exploded view of all the components, except for the fact that aluminum conductors 41 are shown adhered on thin films 13. The larger dimensions of the assembled modules are approximate multiples of the larger dimensions of the magnet arrays (about three to four times). The smallest dimension, the depth, is the approximate sum of the thickness of the three baffles, the four spacers and the two pole pieces. The resulting dimensions of the preferred embodiment are about 5 cm×30 cm×100 cm (hinged baffle 03, excluded) with open area 01 about 10 cm×20 cm.

Figure 7A:
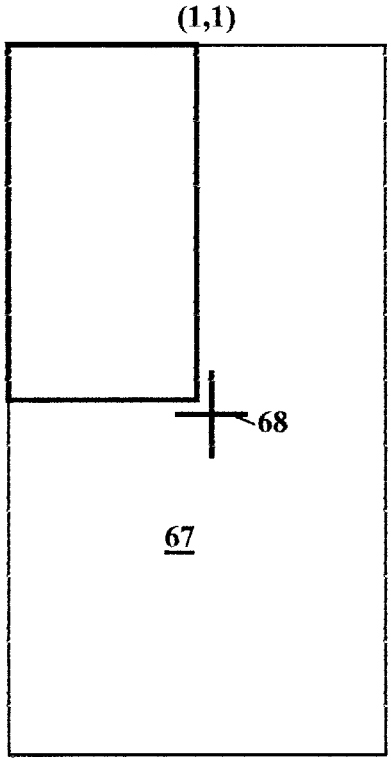
FIGS. 7A to 7D are diagrammatic plan views of an oscillating rectangular thin film showing the first four vibratory mode patterns.
Figure 7B:
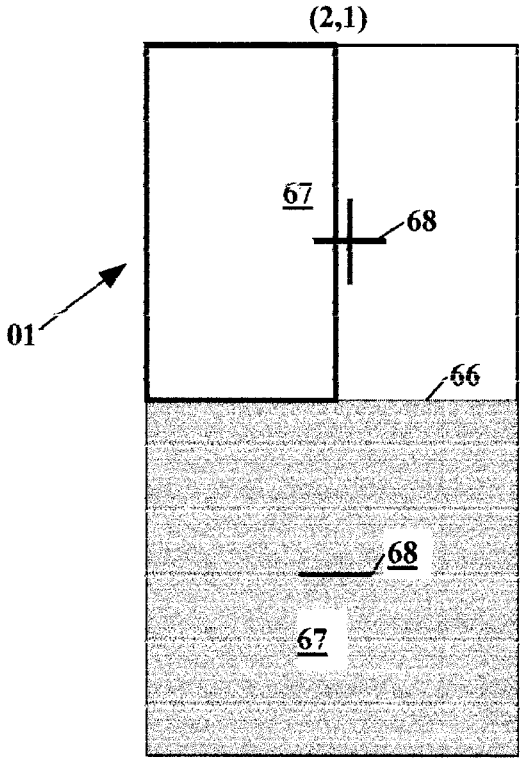
Figure 7C:
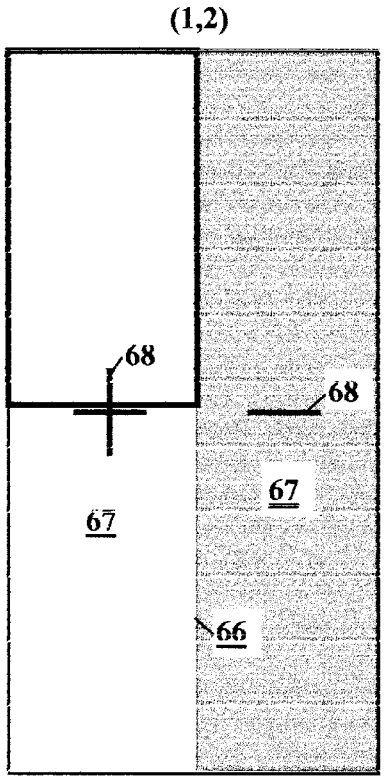
Figure 7D:
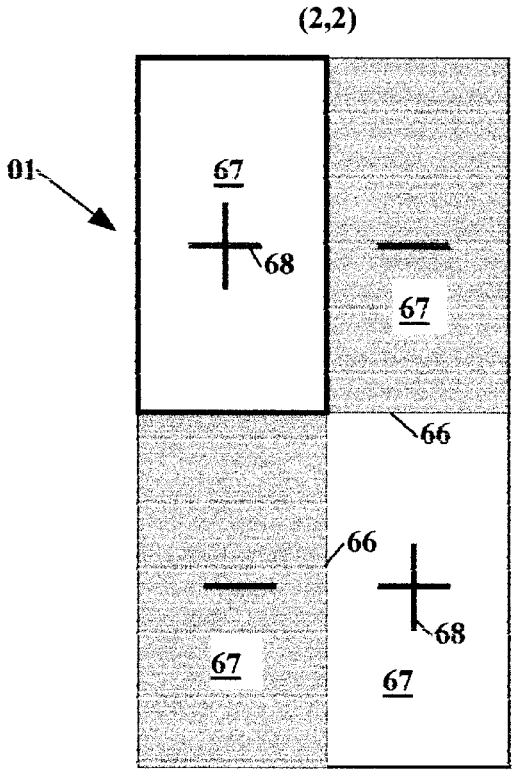
Figure 7E:
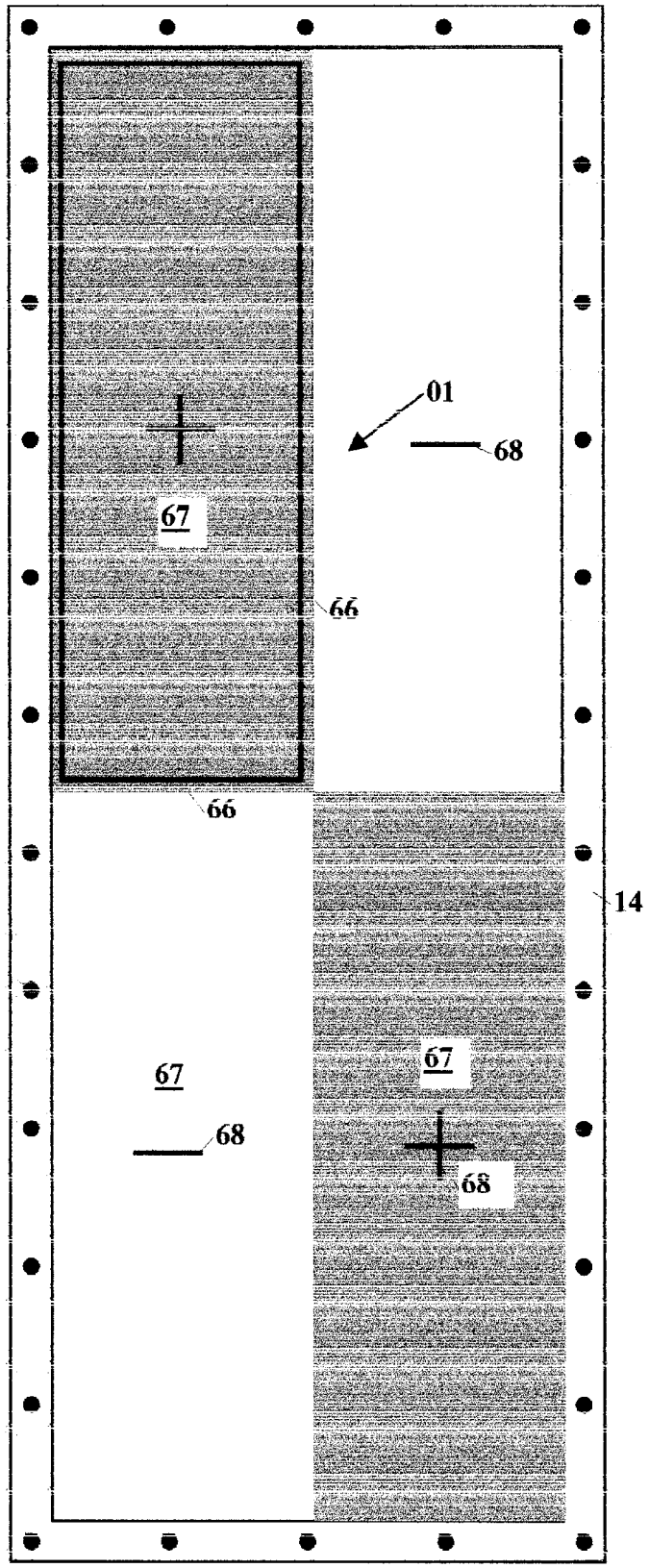
FIG. 7E is a plan view of an oscillating rectangular thin film such as in FIGS. 6A, 6B and 6C, diagrammatically showing the vibratory mode pattern (2,2) of a rectangular oscillating thin film.
Figure 7F:
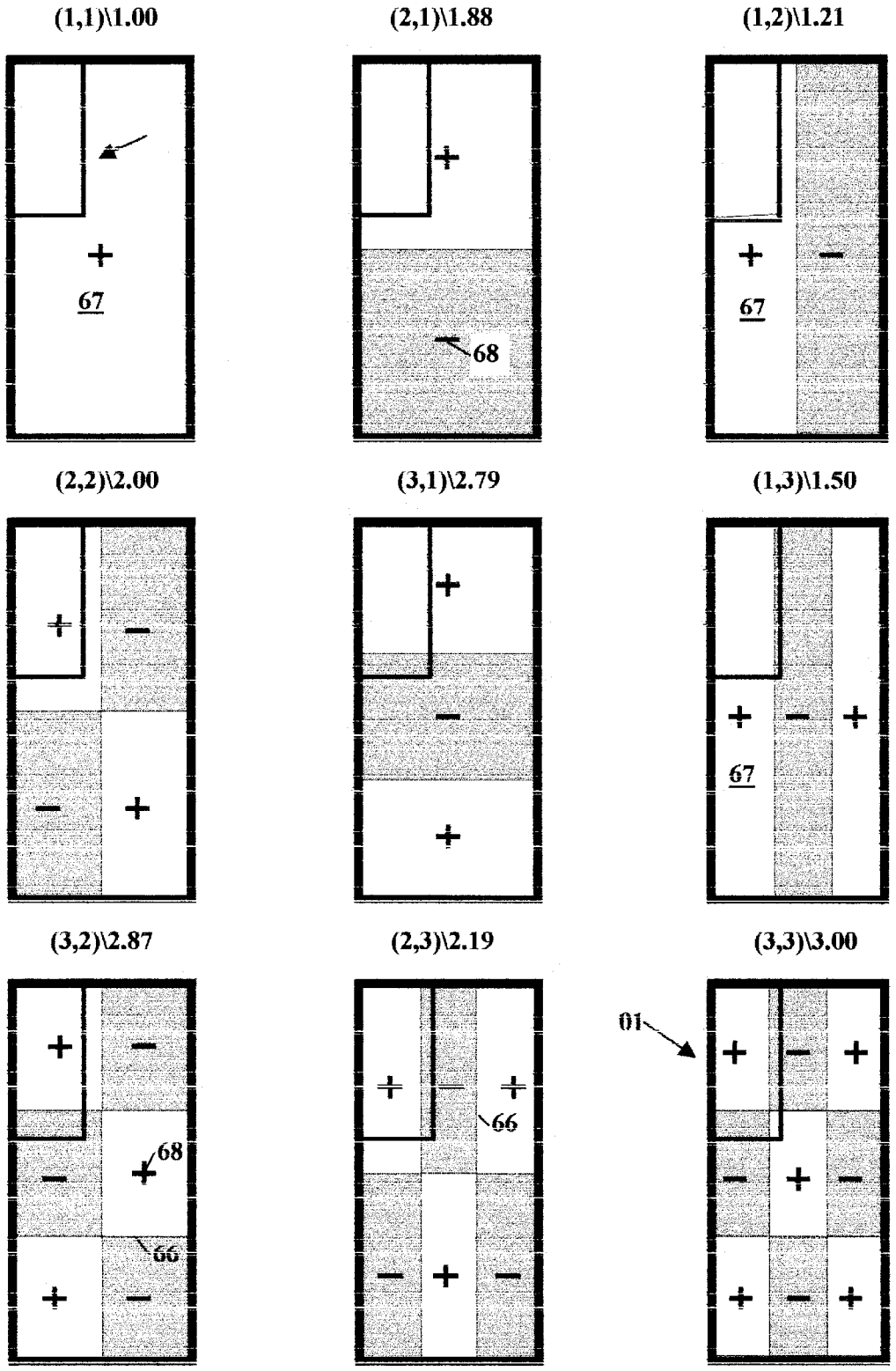
FIG. 7F is a diagrammatic plan view in the nature of FIGS. 7A to 7D, showing the first nine mode patterns of a rectangular vibrating film. It shows modes of oscillation and associated ratios of higher to fundamental, characteristic frequencies, for a rectangular thin film of height=(2.33)× (width).
Figure 7G:
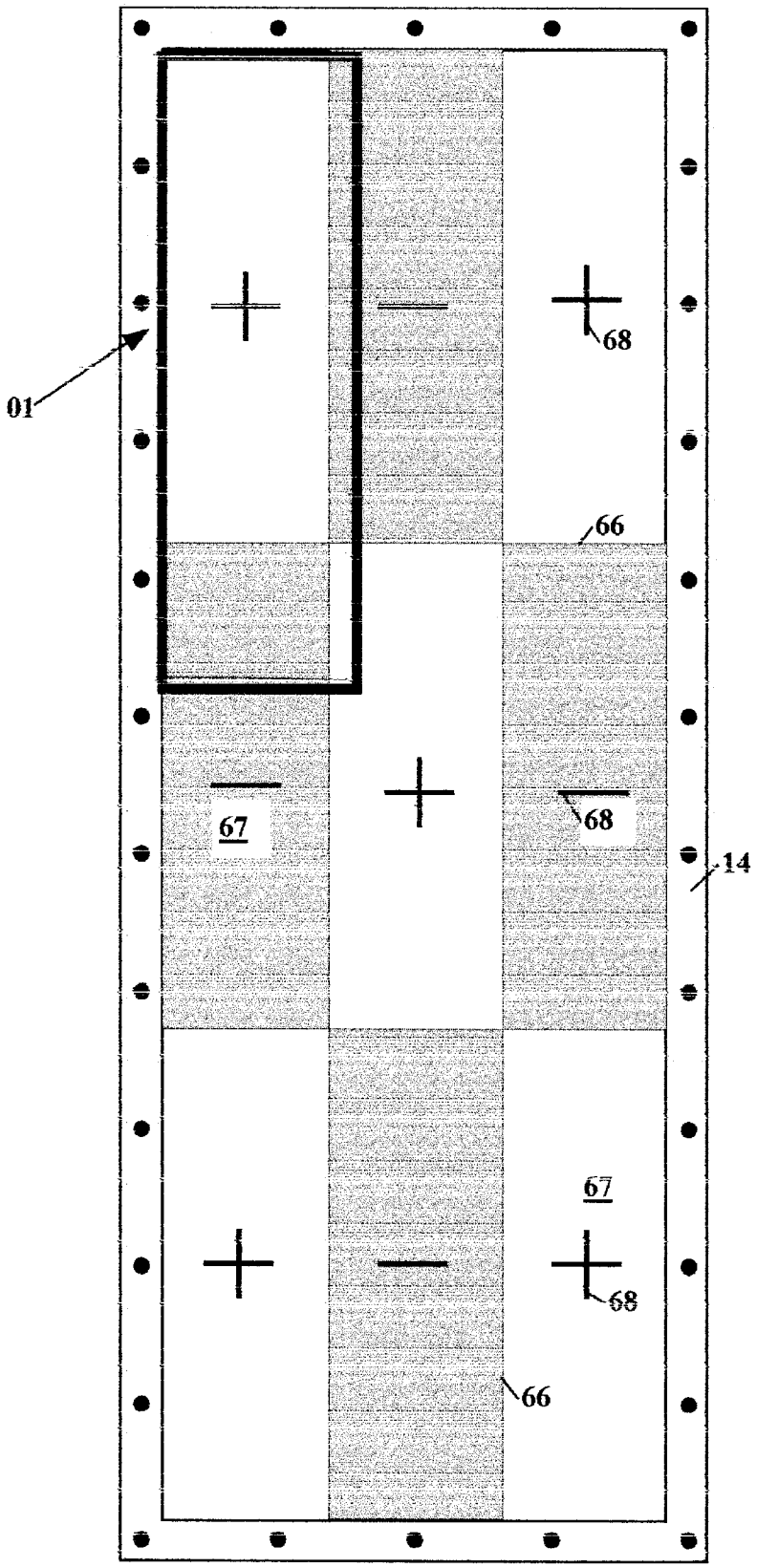
FIGS. 7G, 7H are plan view in the nature of FIG. 7E, diagrammatically showing the vibratory mode pattern (3,3) of a rectangular oscillating film as shown in FIG. 7F.

The driven/radiating area in open area 01 is of a relatively limited size compared to the total area of the oscillating medium, as shown in FIG. 4. The driven/radiating area has size and position determined by the approximate size and position of an antinode 67 belonging to a higher mode of oscillation, say mode (2,2), as shown in FIGS. 7A to 7F or mode (3,3) as shown in FIG. 7G. Which mode is utilised is a matter of design choice.

Note: In accordance with the present invention, the driven/radiating area is asymmetrically positioned within the overall shape of the oscillating element. By that, I mean that is an off-center antinode of a predetermined mode of oscillation. Preferably it is as close as possible to the boundary of the oscillating element (see FIGS. 7A to 7H, 18A to 18C for rectangular shape and see FIG. 16C, 18E to 18G for circular shape). It is the mode pattern of nodes and antinodes that determine the position and size of the selected antinode as the driven sub-area. Of course, the entire oscillating element oscillates but in accordance with this invention, it is driven only at the selected off-center antinode (extreme asymmetrical position). The selection of a particular mode of oscillation is arbitrary and a function of design considerations, e.g., compromise between high dispersion of emitted waves (smaller area antinode belonging to a higher mode) and higher directionality of emitted waves (larger area antinode belonging to a lower mode of oscillation).

A right-angle isosceles triangular clamp 31 (perturbation in thin-film rectangular geometry), equal in thickness to frame-like spacers 14, divides each thin film into two distinct oscillating regions while the presence of two thin films doubles the number of distinct oscillating regions of the oscillating medium, as shown in FIGS. 6A to 6C, FIG. 7H and FIGS. 8A to 8B. Narrow rectangular clamps 32 to 33, equal in thickness to frame-like spacers 14, adjust the size of such distinct regions.

Figure 6A:
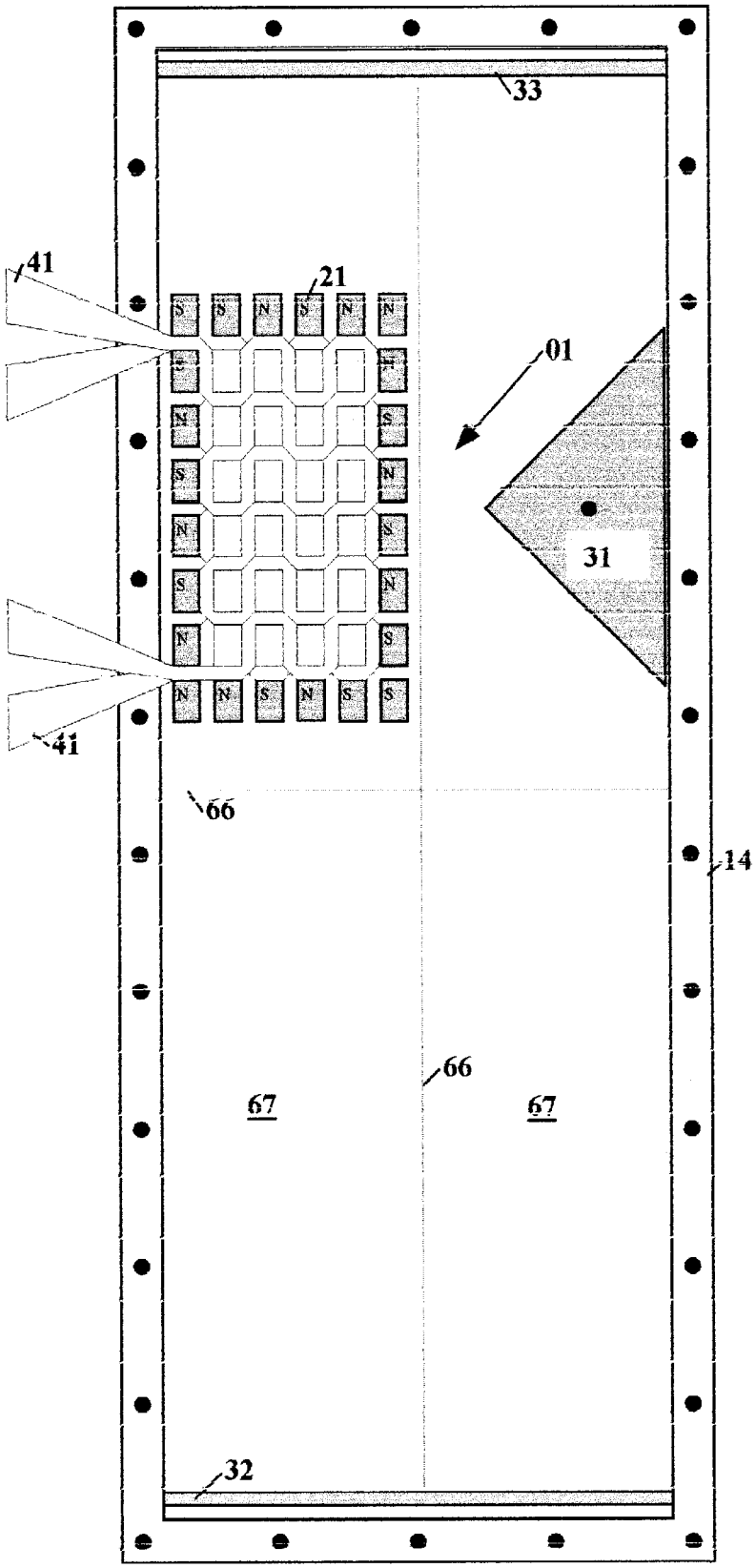
FIGS. 6A and 6B are plan views showing the outer modules of the transducer of FIG. 4.
Figure 6B:
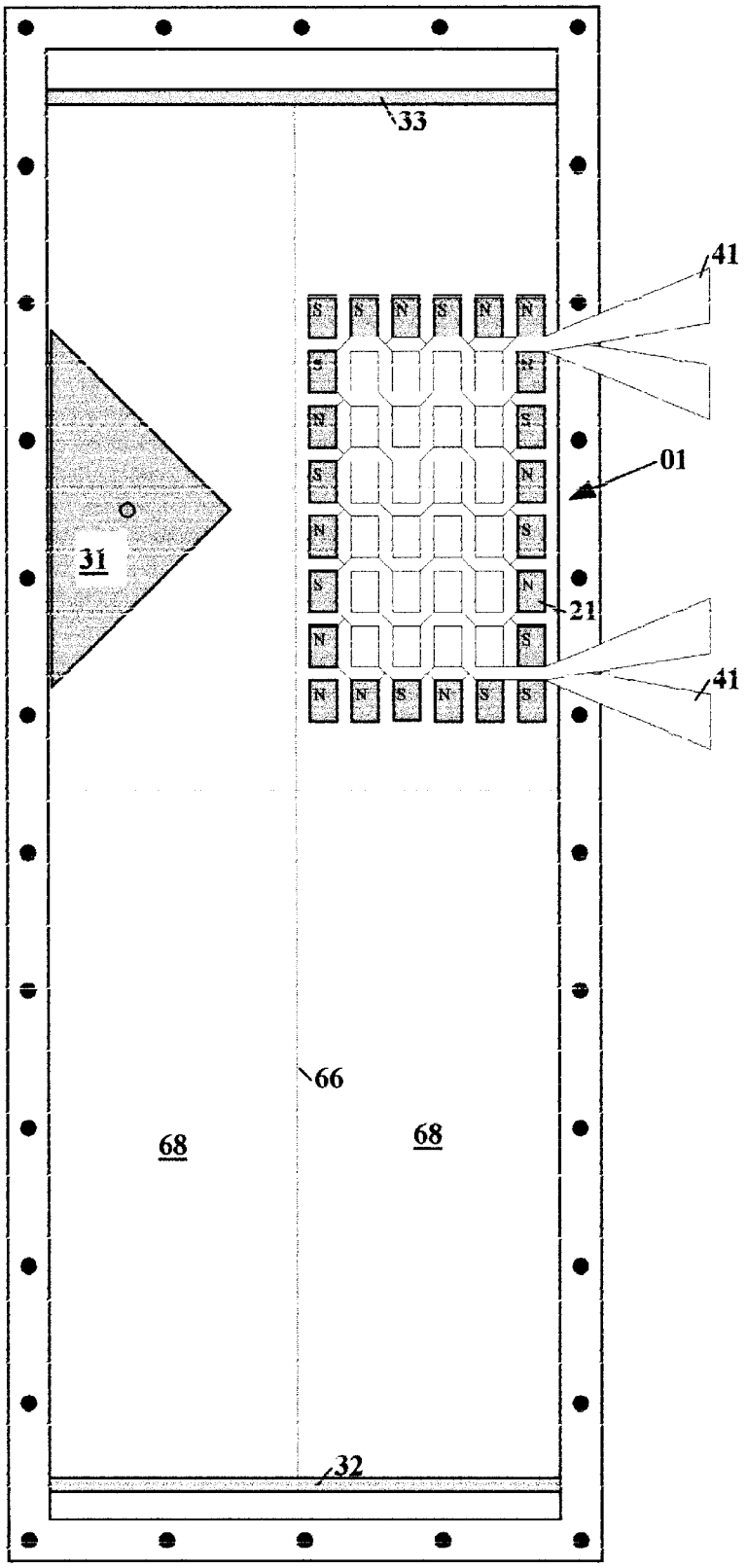
Figure 6C:
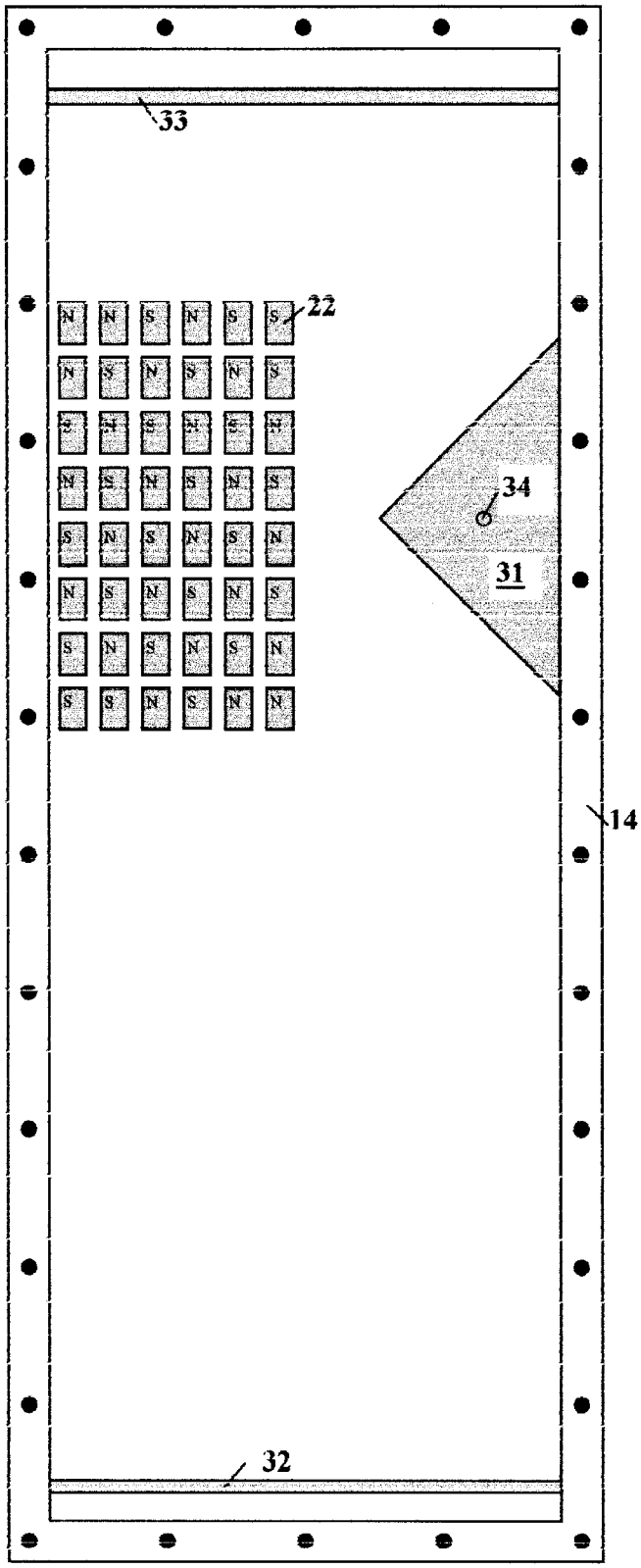
FIG. 6C is a plan view showing the inner module of the transducer of FIG. 4, having a panel-like array of magnets and a clamp.
Figure 9A:
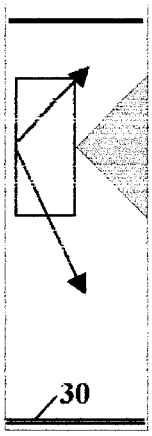
FIGS. 9A to 9L are diagrammatic plan views of the transducer of FIG. 8A showing a variety of boundaries defining the geometry of a stretched thin film.
Figure 9B:
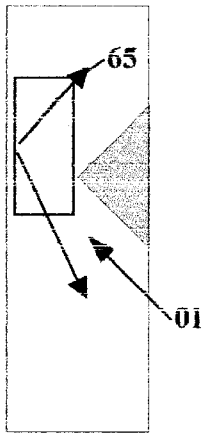
Figure 9C:
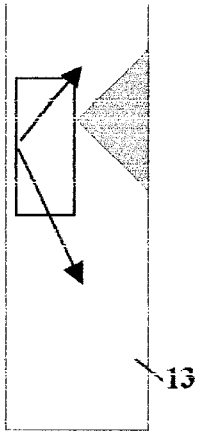
Figure 9D:
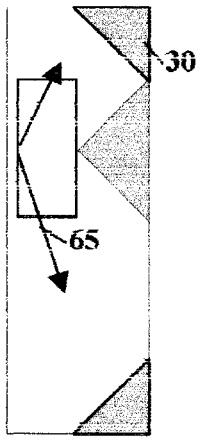
Figure 9E:
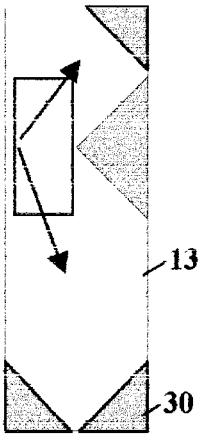
Figure 9F:
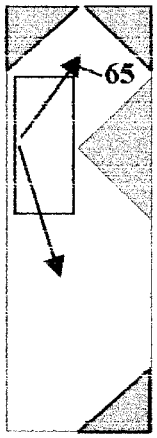
Figure 9G:
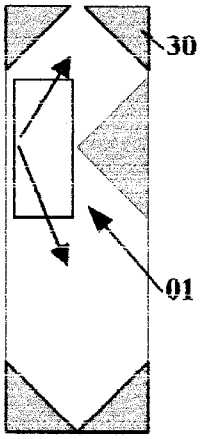

In defining two distinct oscillating regions for each thin film, the triangular clamps 31 create two oscillating media on top of each other, separated by a line passing through the height of the triangular clamp 31 as shown in FIGS. 6A to 6C. FIGS. 9A to 9L illustrate a variety of thin-film boundaries for the creation of one (FIGS. 9I to 9J) to three (FIG. 9H) distinct oscillating regions; arrows 65 show sense (from lower to higher) of change for the physical parameters of the driven/radiating area as defined by antinode 67: compliance, effective mass, impedance and damping. FIGS. 9B and 9C demonstrate the adjustment of the relative size of oscillating regions by altering the position of triangular clamp 31.

FIG. 4 is an exploded view of FIG. 3A showing three assembled modules without the hinged baffle. The thin film being transparent, only the edge thereof is illustrated.

Note: The two oscillating thin films are shown adhered to the baffles of the outer modules. The two oscillating thin films could be adhered on each side of the baffle of the inner module with no consequence to the structural and functional properties of the assembled modules.

FIG. 5 is a detailed exploded view of a transducer showing all the components of a transducer without the hinged baffle. The illustration demonstrates inherent modularity for ease of constructing, dismantling and updating the device as technology of components such as magnets or thin-film materials improves.

FIGS. 6A and 6B shows the outer modules of FIG. 4 having frame-like arrays of magnets mounted in periphery of baffle openings, stretched thin film with adhered thereon conductors forming a grid, and clamp perturbations redefining the boundary geometry of said thin film.

FIG. 6C shows the inner module with a panel-like array of magnets and with clamp perturbations redefining the boundary of the thin film.

FIGS. 7A to 7D show the first four mode patterns of the normal modes of a rectangular thin film with each (m,n) pair of corresponding integers marked above the top side of each figure. FIG. 7E shows the mode pattern (2,2) of a rectangular oscillating thin film with driven/radiating area selected as the top left antinode that represents an asymmetrically positioned integer submultiple (¼) section of the total area of the oscillating thin film. FIG. 7F shows the first nine modes of oscillation of a rectangular thin film with specific geometry whereby the height is slightly larger than twice the width. Each mode and calculated resonance (characteristic) frequency are marked on top of each mode pattern separated by a back slash (\). The driven/radiating area is, again, positioned asymmetrically and defined by the top left antinode of the mode pattern (3,3). FIG. 7G is a blow-up drawing of mode (3,3) in FIG. 7F. FIG. 7G shows a rectangular thin film with a triangular (isosceles right-angle) shape perturbation (clamp) dividing the thin film into two regions (area ratio 3:1) with individual resonance frequencies and related individual mode patterns. The asymmetrically positioned driven/radiating area spans both said regions and is defined by two combined adjacent antinode areas belonging to the two sets of mode patterns produced by the shape perturbation (clamp).

Figures 8A, 8B:
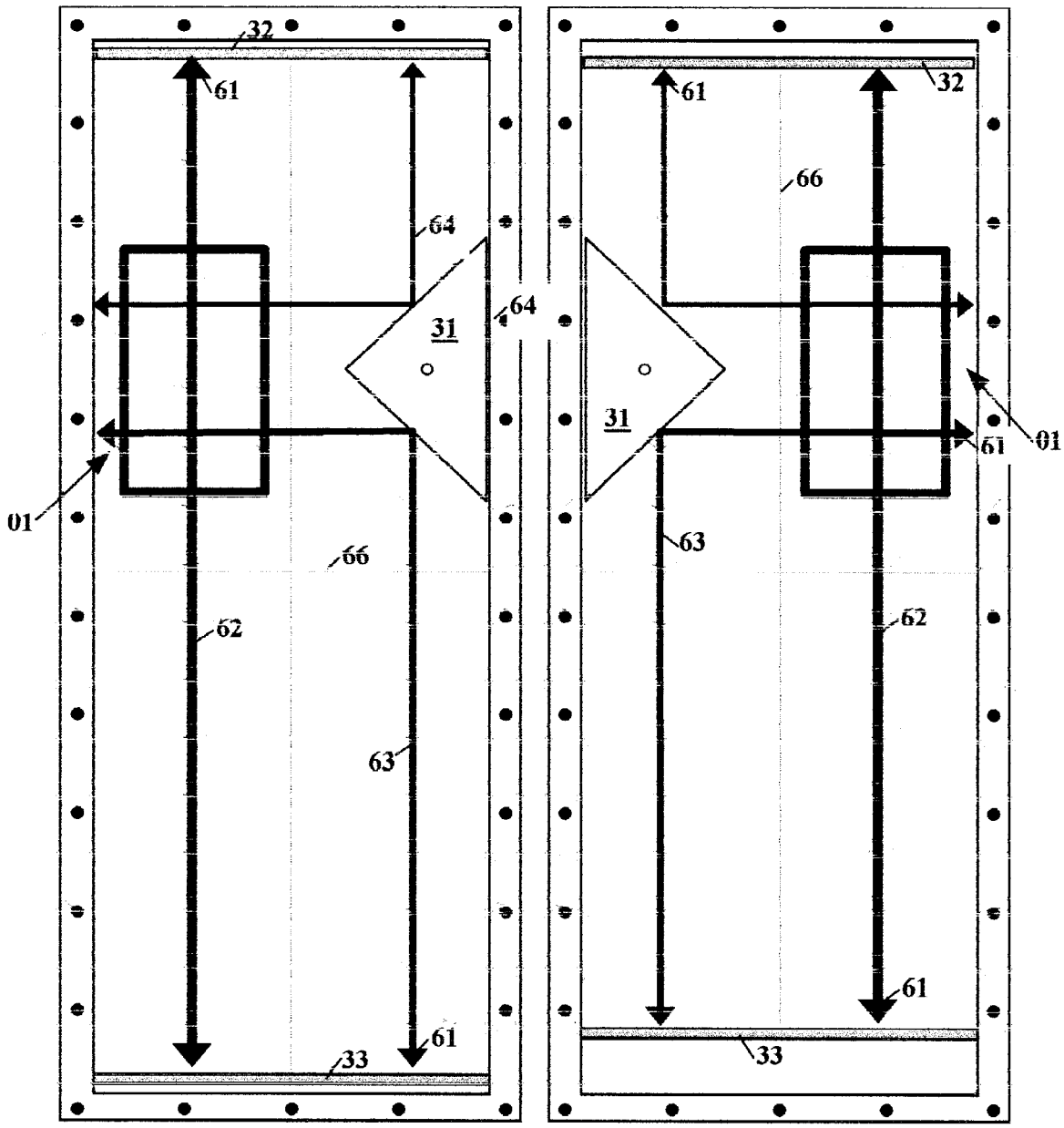
FIGS. 8A and 8B are plan views in the nature of FIG. 7E diagrammatically representing oscillating thin films in transducers in accordance with the present invention, with a disturbance propagating from the asymmetrically positioned driven/radiating area.

FIGS. 8A and 8B show the oscillating thin films with a disturbance propagating from the asymmetrically positioned driven/radiating area and reflected back to said area. The triangular perturbation increases the widthwise path of the disturbance that would otherwise be limited to the geometrical width of the oscillating thin films. Said perturbation does not affect the lengthwise path of the disturbance. The pair of figures also shows narrow rectangular clamps for adjusting area size of the individual regions thereby shifting resonance frequencies of the oscillating thin films.

FIGS. 9A to 9L show a variety of boundaries defining the geometry of a stretched thin film. Specifically, FIGS. 9B to 9C show how the ratio of the areas of the two regions as defined in FIG. 7H can be adjusted by adjusting the position of the perturbation (clamp). FIGS. 9D to 9G show additional triangular clamps positioned at corners affecting the propagation path (distance and direction) of a disturbance.

Figure 9H:
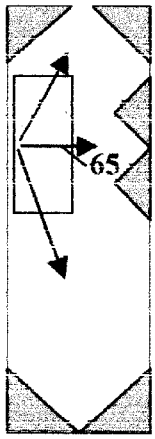

FIG. 9H shows a boundary geometry for creating three distinct oscillating regions.

Figure 9I:
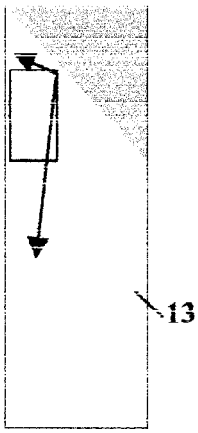
Figure 9J:
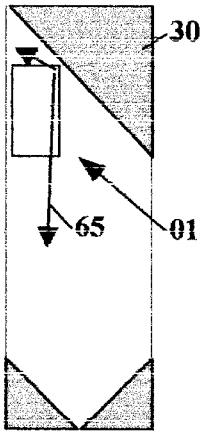
Figure 9K:
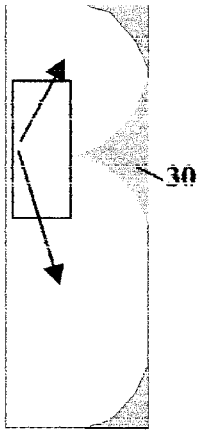
Figure 9L:
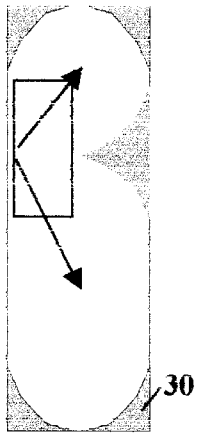
Figure 9M:
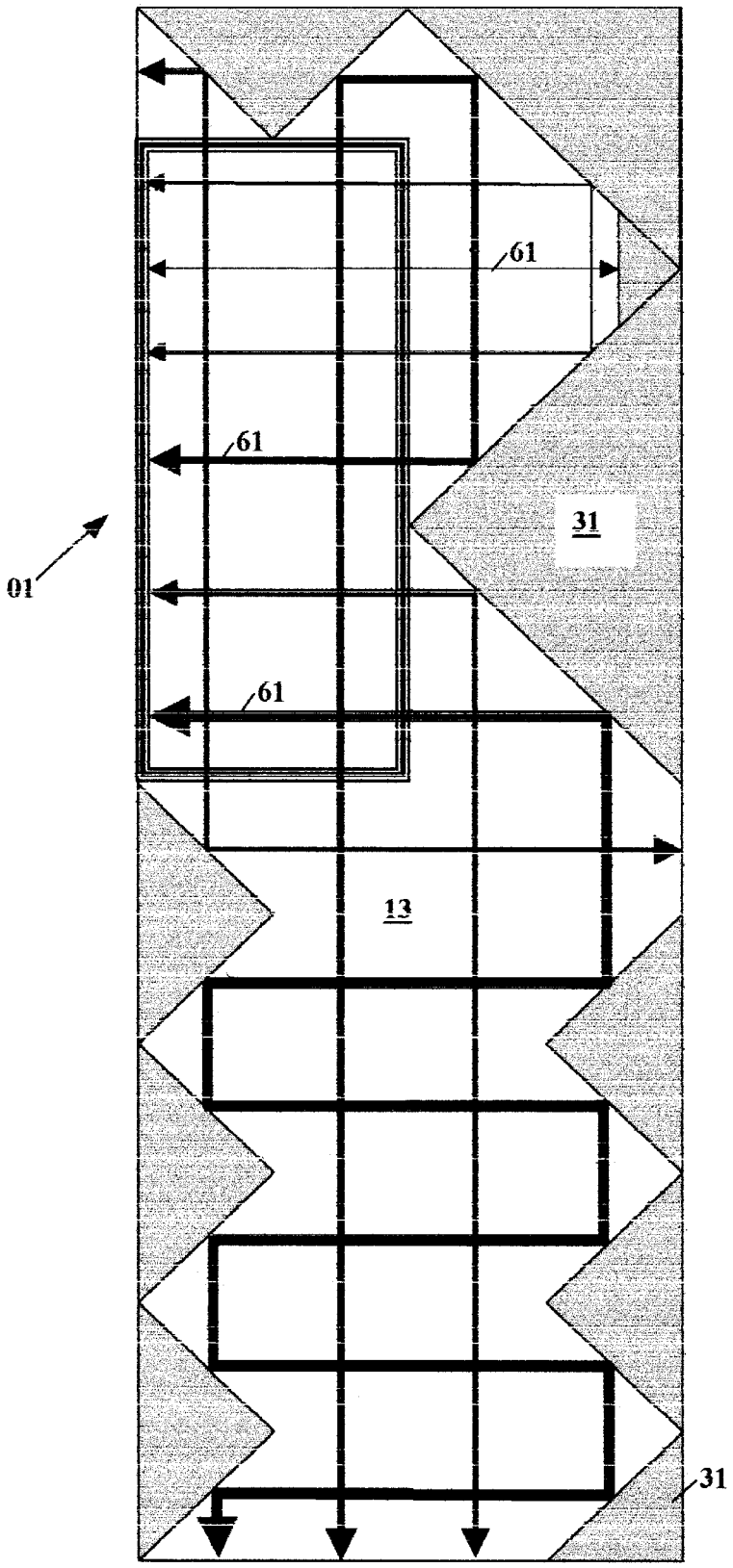
FIG. 9M is a diagrammatic plan view showing the oscillating thin film of another embodiment of a transducer of the present invention, with a boundary geometry causing one single reflection and five multiple reflections of a disturbance.

FIGS. 9I and 9J show boundary geometry for generating strong lengthwise and rather weak widthwise reflections. FIGS. 9K and 9L show curved boundaries for better trapping the disturbances in individual regions. FIG. 9M shows an oscillating thin film with a boundary geometry causing one single reflection and five multiple reflections of a disturbance. Correspondingly, the resulting propagation paths will vary from smaller to much larger lengths than the dimensions of the oscillating thin film.

Figure 10A:
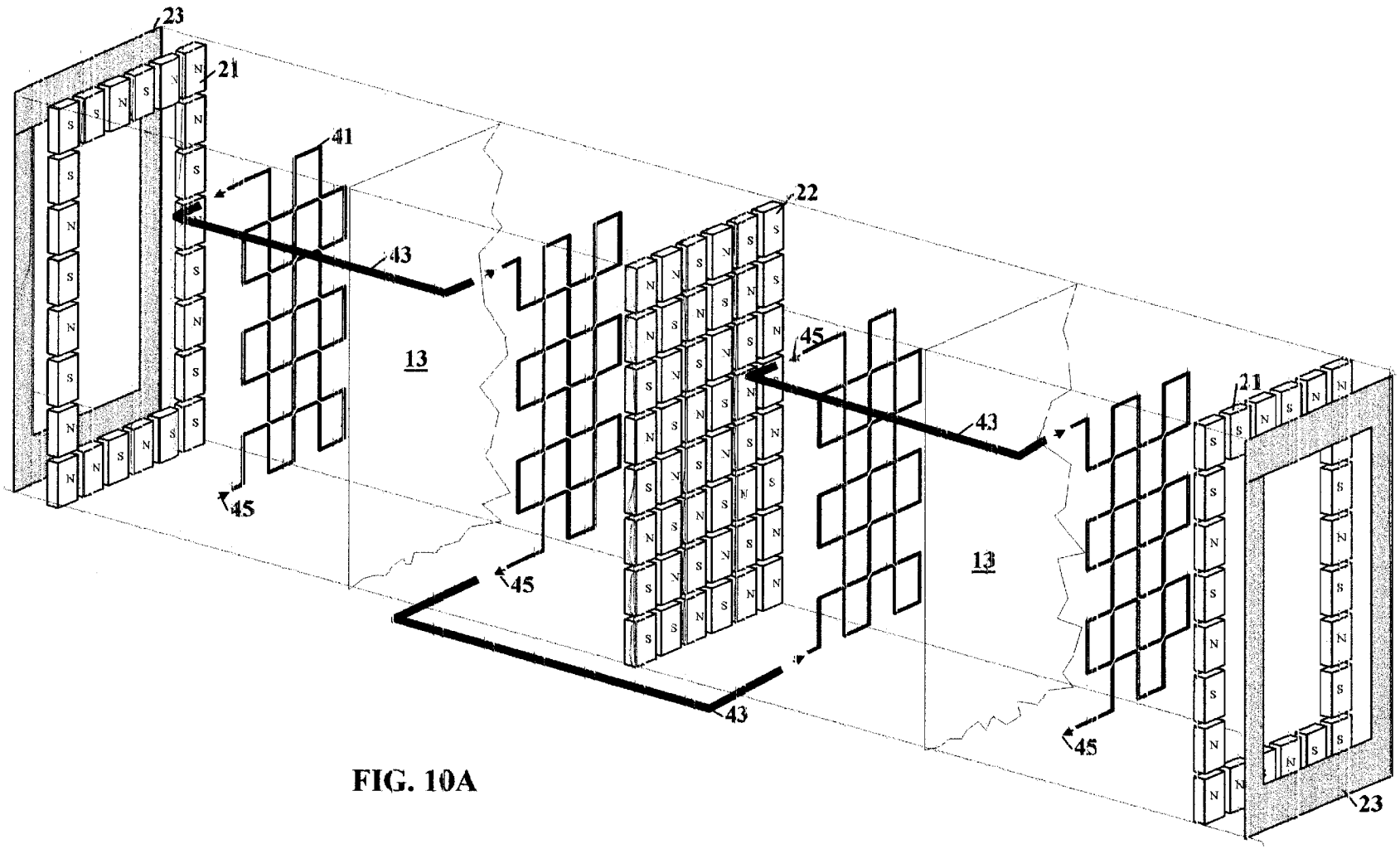
FIG. 10A is an exploded perspective view showing the construction of a driving assembly of a transducer in accordance with the present invention, with two thin films plus three magnet arrays.
Figure 10B:
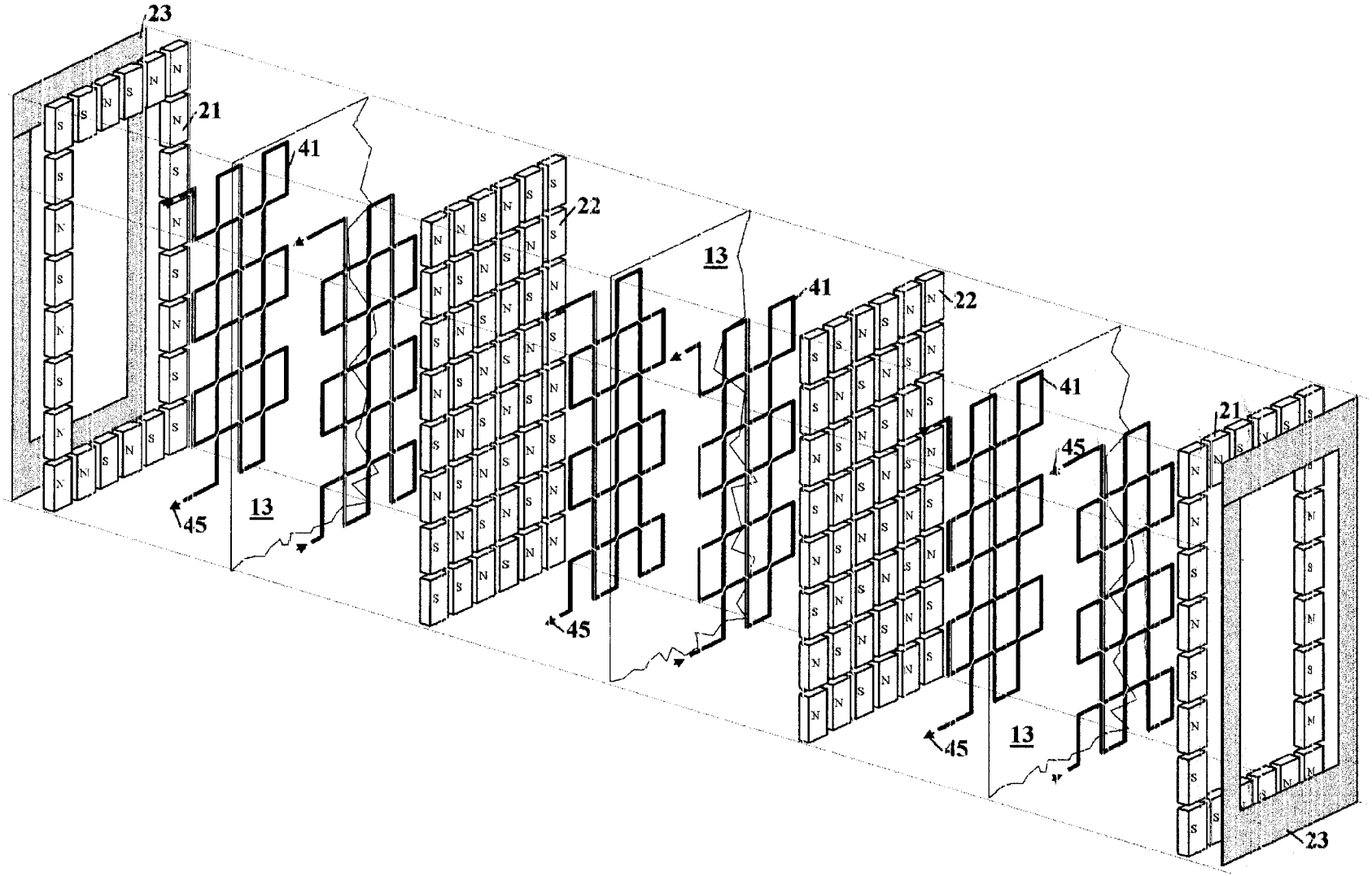
FIG. 10B is an exploded perspective view in the nature of FIG. 10A showing the construction of an alternative driving assembly of a transducer in accordance with the present invention with three thin films plus four magnet arrays.
Figure 10E:
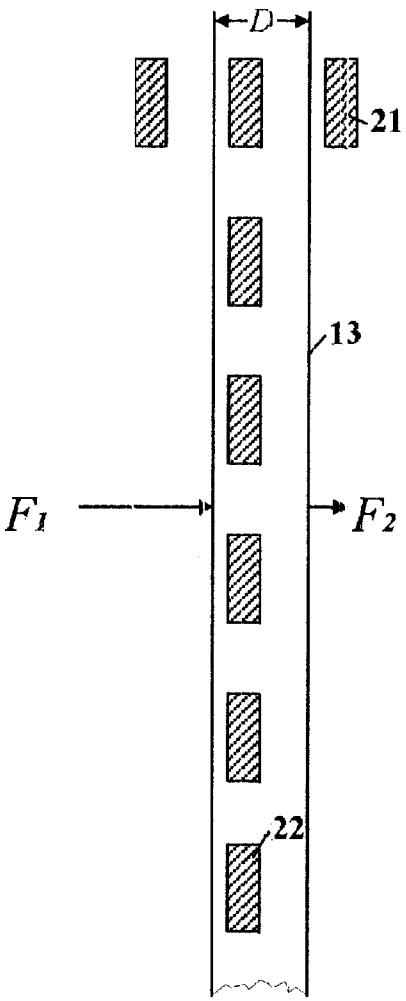
FIGS. 10C to 10E are diagrammatic fragmentary cross-sectional views of the driving assembly of FIG. 10A illustrating the forces on the films in three respective positions.
Figure 10D:
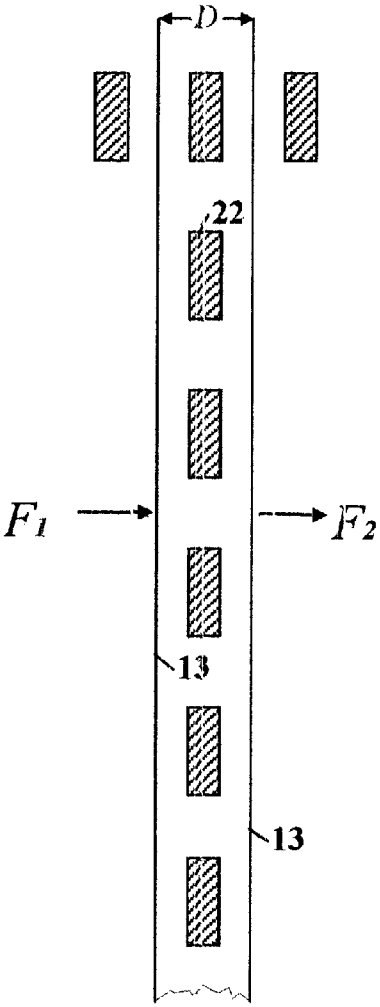
Figure 10C:
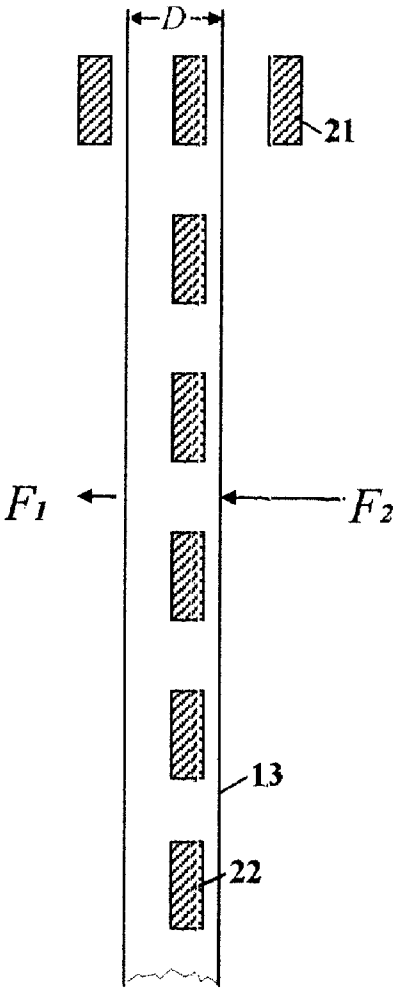

FIGS. 10A and 10B show two alternatives for driving assemblies: with two thin films plus one magnet array and with three thin films plus two magnet arrays. The adhered on the thin films conductors form a grid coinciding with the grid pattern of the air gaps of the magnet arrays and with the grid pattern of the magnetic field driving the current-carrying conductors.

Figure 10F:
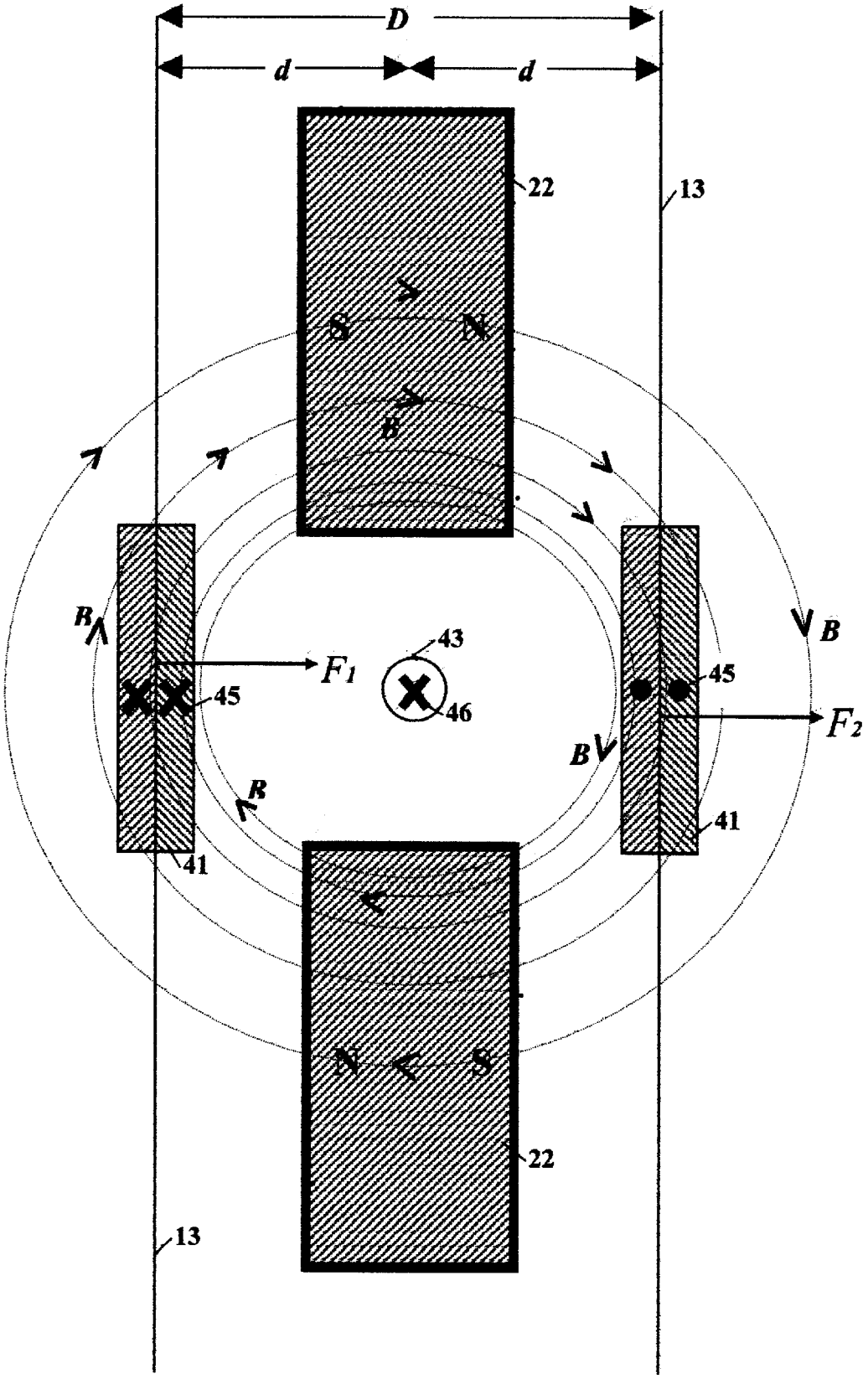
FIGS. 10F and 10G are diagrammatic fragmentary cross-sectional views of the driving assembly of FIG. 10A illustrating the forces on the films in two respective positions.
Figure 11A:
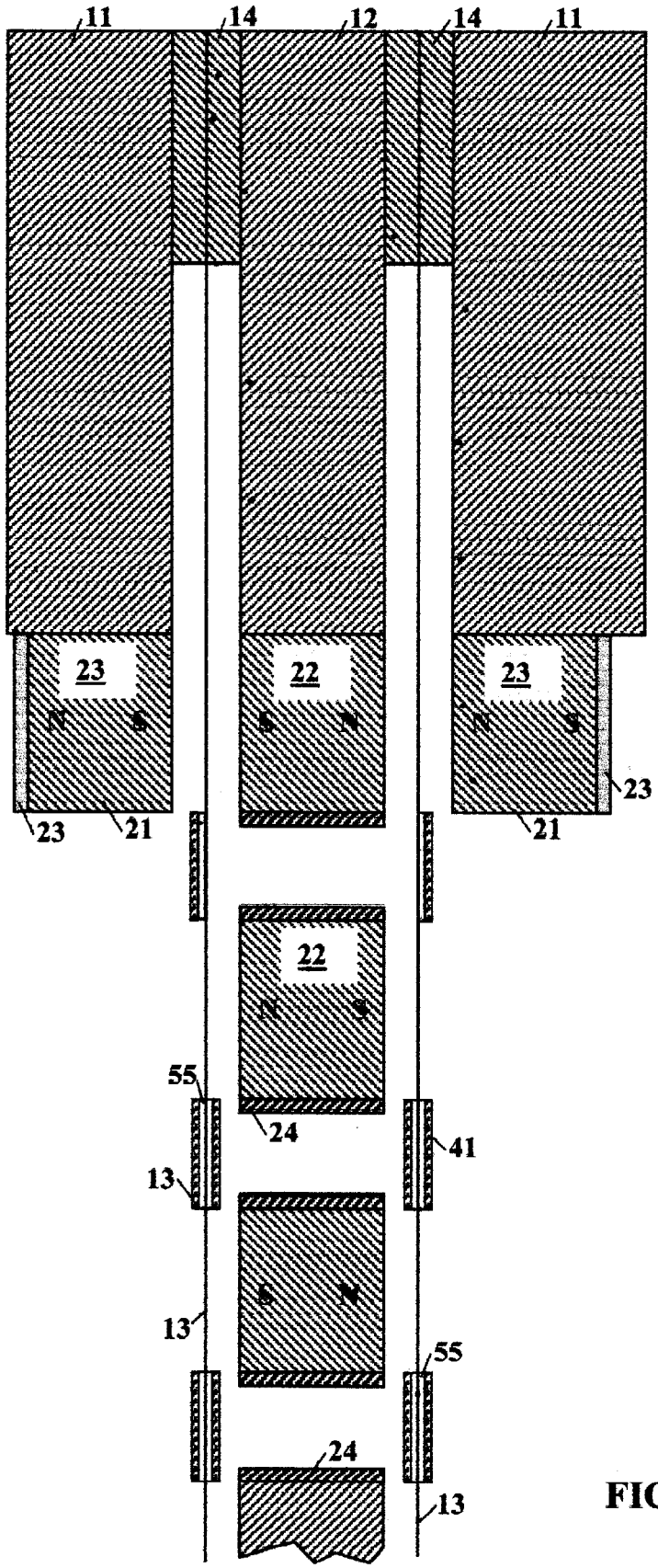
FIG. 11A is a fragmentary cross section of a top segment of the assembled transducer driving assembly of FIG. 10A.
Figure 11B:
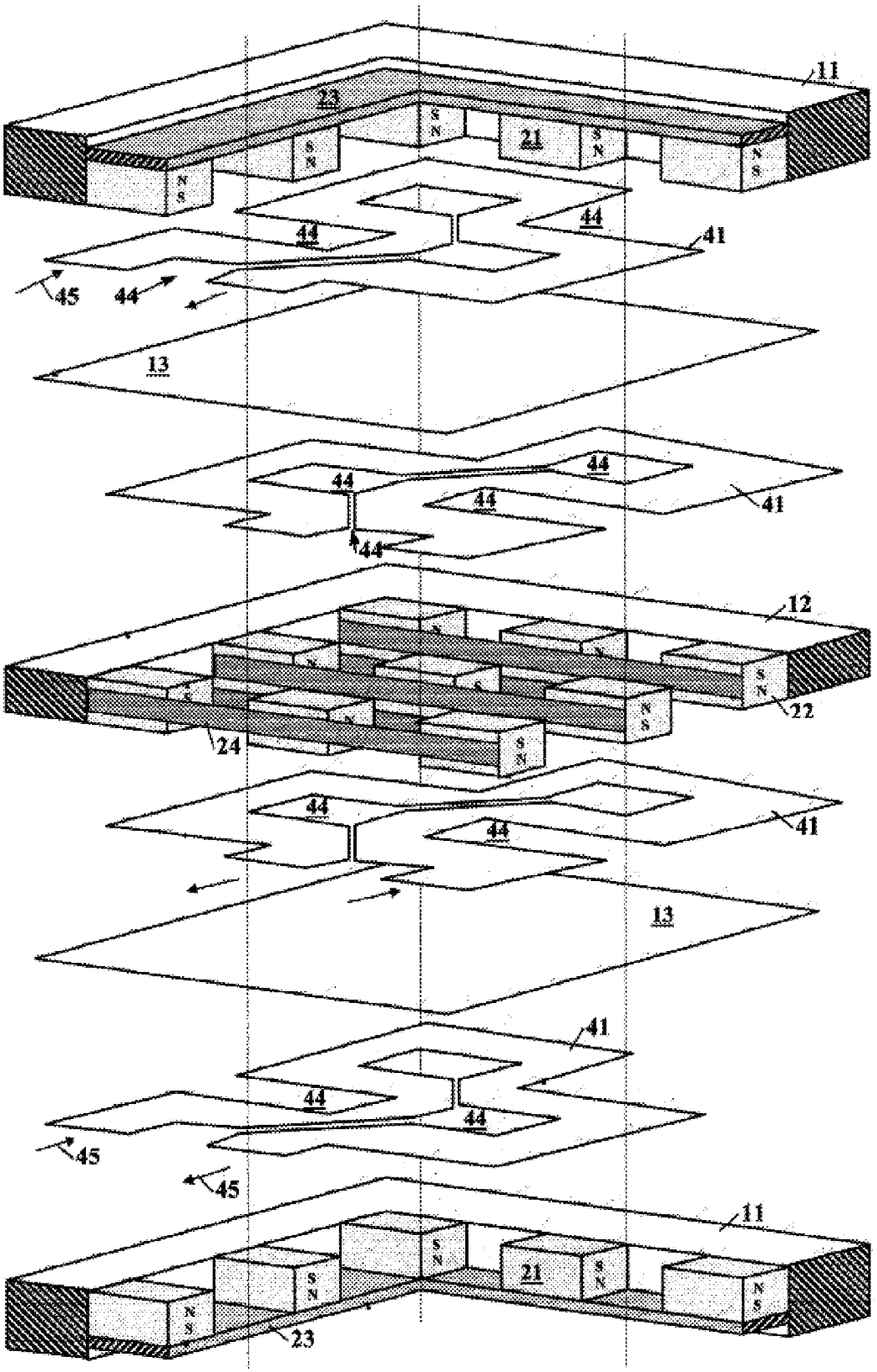
FIG. 11B is a fragmentary exploded perspective view of a corner of the transducer driving assembly of FIG. 11A.

FIGS. 10A to 10B show exploded views of a driven/radiating area, for an oscillating medium composed of two and three thin films respectively. FIGS. 10C to 10F show a segment of the driven/radiating area cross section for the purpose of demonstrating schematically that the resultant force, exerted thereupon by the combined magnetic field of arrays 22 and 21, is independent of displacement because the average distance from such magnet arrays of the two thin films remains practically constant for any position of such area. FIGS. 11A to 11B show detailed cross section and exploded view of a driven/radiating area corner.

FIGS. 10C to 10G show schematically that, given a constant magnetic field B, then, for any position of an oscillating medium consisting of two thin films, the resultant push-pull force is a practically linear function of the current intensity when magnet array is placed in the space separating the two thin films.

FIG. 11A shows exaggerated cross sections of a top segment of the assembled transducer. FIG. 11B is an exploded drawing of a corner of the driven/radiating area, showing segments of the magnet structure arrays, conductors and thin films.

Figure 12A:
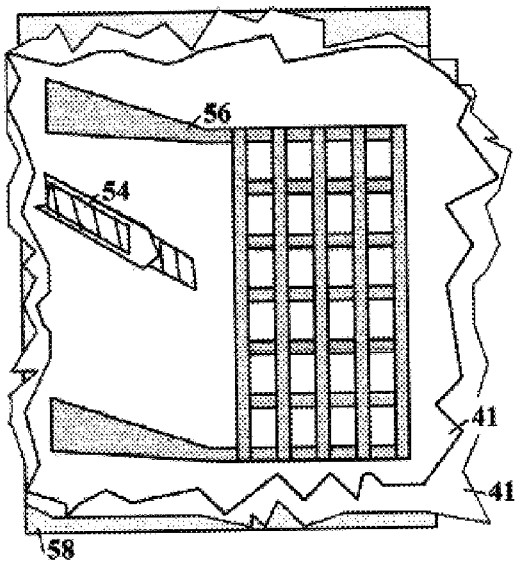
FIGS. 12A to 12I are diagrammatic plan views showing successive steps in the assembly of a pattern of conductors on a film in accordance with the present invention.
Figure 12B:
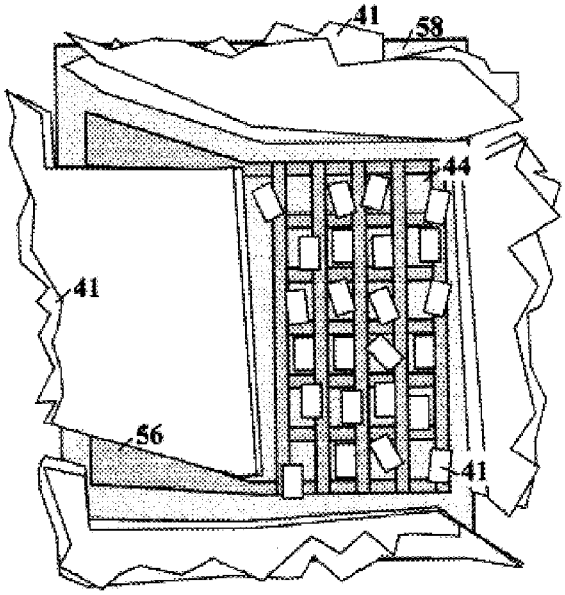
Figure 12C:
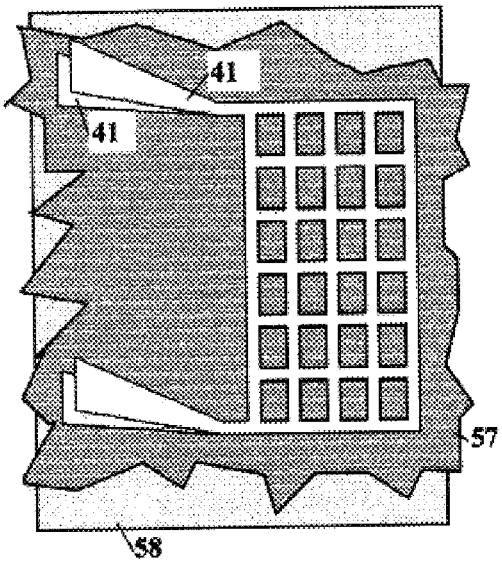
Figure 12D:
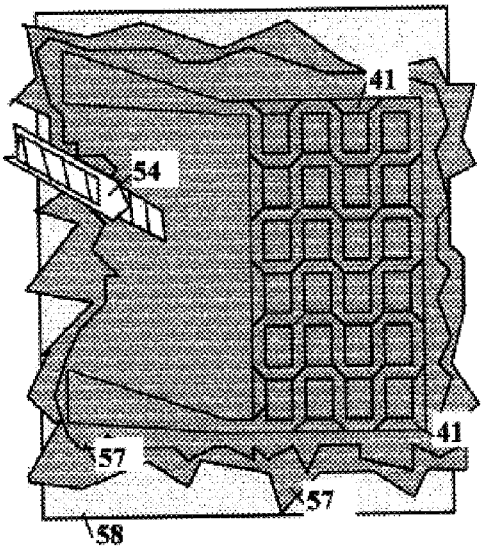
Figure 12E:
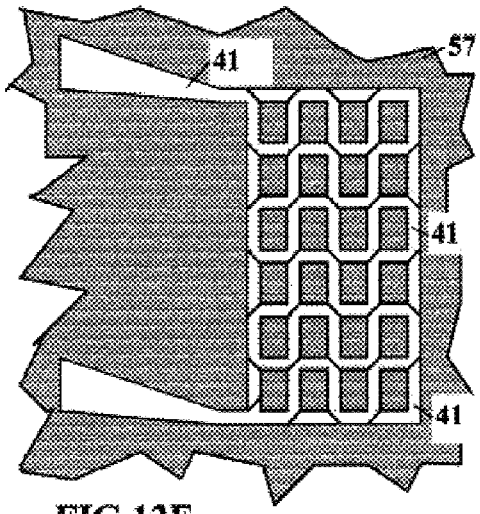
Figure 12F:
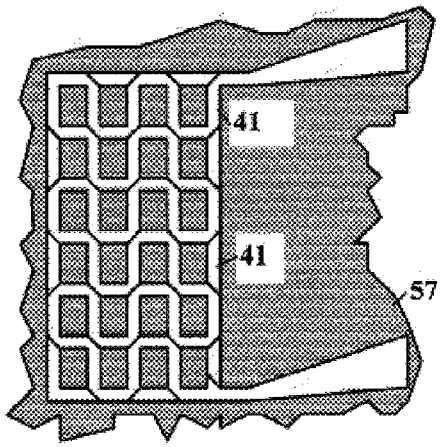
Figure 12G:
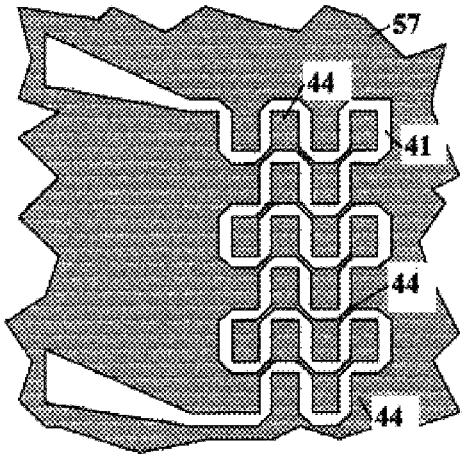
Figure 12H:
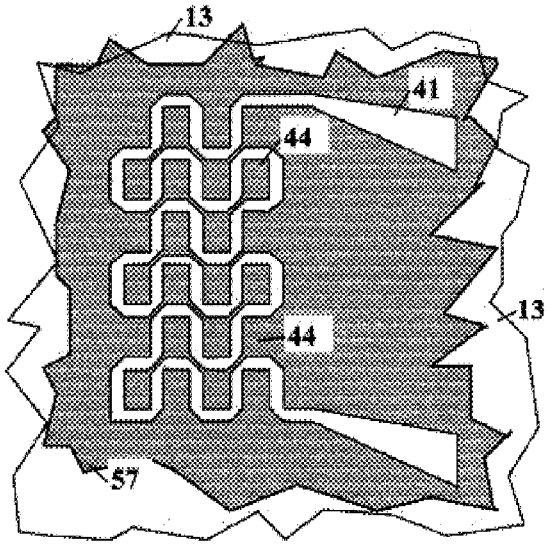
Figure 12I:
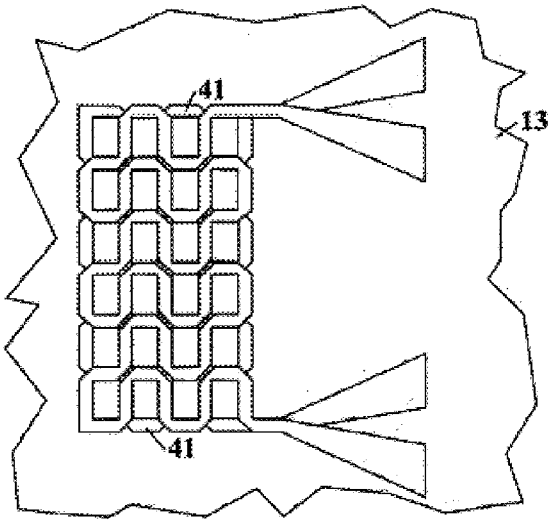

A step-by-step method for creating the pattern of the conductors of FIG. 5 and FIGS. 10A and 10B is shown in FIGS. 12A to 12I. Aluminum foil 41 is cut with a paper cutter 54 and with the aid of a metal template 56, waxed paper 57 and a cutting mat 58. FIG. 12A shows the first step whereby two aluminum foils 41 are placed between the cutting mat and the template. FIG. 12B show the template with all the aluminum foil cut and removed except for the part protected and covered by the template. FIG. 12C shows the aluminum foil with the template removed lying on the cutting mat and with wax paper in between. A second sheet of wax paper is placed on top of the aluminum foil so that the two conductors are sandwiched between the two waxed papers as shown in FIG. 12D. By lightly pressing with a warm iron, the two conductors are adhered temporarily to each of the wax paper sheets. Then with the paper cutter the conductor is cut through the wax paper as shown in FIG. 12D. The two FIGS. 12E and 12F show the two conductors separated by way of their temporary adherence to the wax paper. The cut aluminum is removed so that the conductor becomes a planar coil as shown in FIGS. 12G to 12H. The conductor in FIG. 12H is shown inverted in order to demonstrate its position with respect to conductor of FIG. 12G before the two conductors are adhered on the thin film. FIG. 12I shows the final assembly (winding) whereby the conductors in FIGS. 12G to 12H are aligned and adhered on each side of a thin film forming a grid covering the entire driven/radiating area. Each rectangle in the grid constitutes a current loop following the pattern of the magnetic flux generated by the magnet arrays 22 and 21.

For a given driven/radiating area and associated cost, the number of necessary rare earth magnets is lower compared to ceramic magnets. In order to compensate for lower impedance (resistive) from a shorter conductor path (fewer magnets) and a wider conductor (larger magnet gap 25), multiple conductors are used. This increases both the total conductor length (higher number of windings per given magnetic flux, for a stronger electromagnetic force) and the impedance of the circuit (for matching the impedance of the signal amplification device, hence for direct coupling; no impedance-matching transformer needed).

For a structure employing rare earth magnets, such as neodymium, the method of creating the conductors is similar. FIGS. 13A1 and 13A2 show the final stage of assembling the conductors for a rare earth magnet array. These figures show the method of assembling the conductors using a relatively low number of powerful rare earth magnets. Multiple conductors (for increasing impedance by way of increasing total conductor length) are required to compensate for the limited size magnet structure. FIG. 13A2 shows a desirable way of connecting the assembled set of conductors in series (by way of conductors/connectors 40) for a longer total conductor path, with higher impedance, in order to match impedance with a signal amplification device.

Figure 13B:
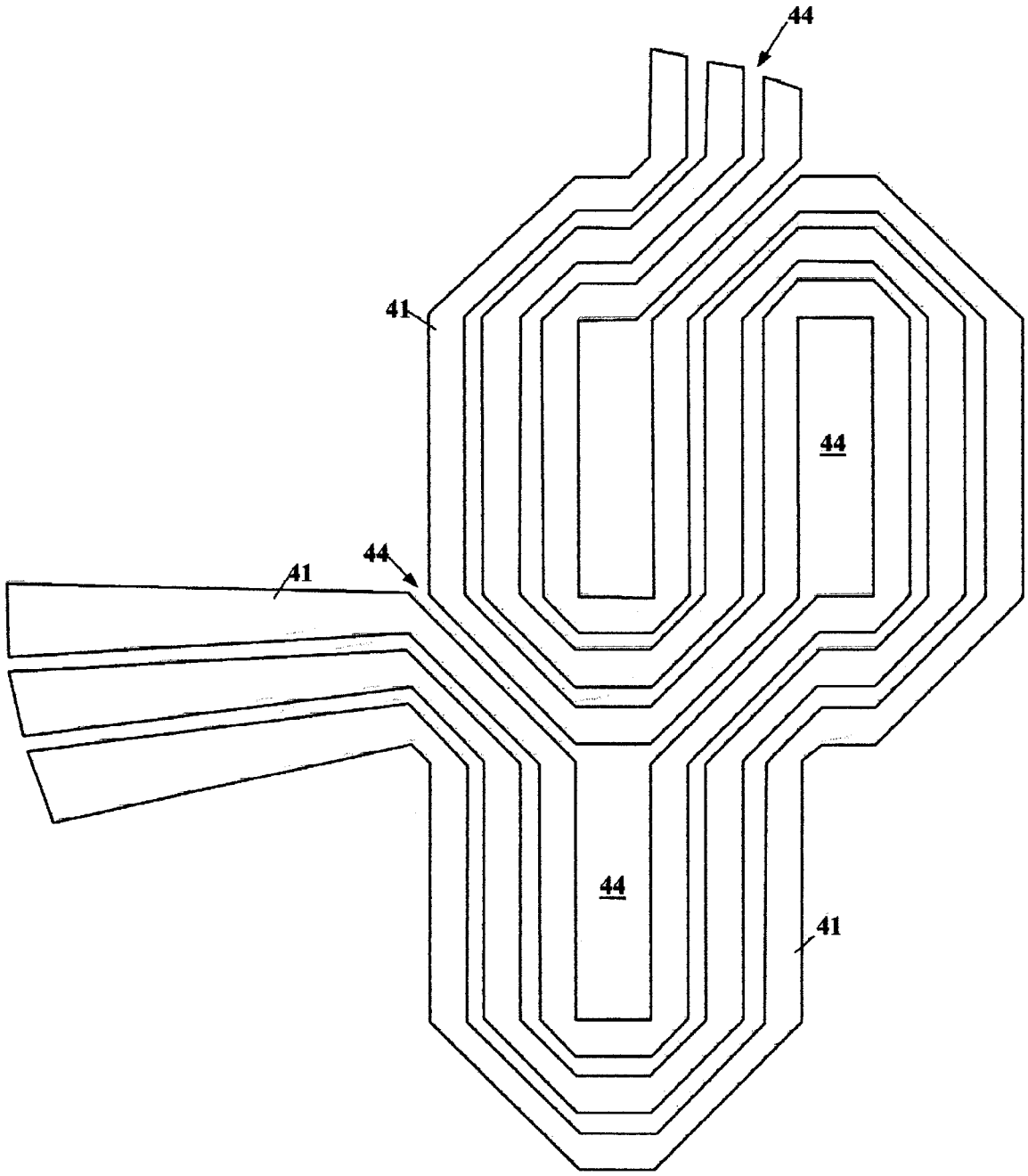
FIG. 13B is a detailed fragmentary plan view of a segment of one of the layers of conductor shown in FIGS. 13A1.

FIG. 13B shows a detailed drawing of a circular segment of the conductors of FIGS. 13A1 and 13A2.

FIGS. 14A1 and 14A2 show a method of assembling conductors with a relatively long total path within the limited space defined by a small array of rare earth magnets. The conductor is a combination of aluminum and insulated thin copper wire, all connected in series (by way of conductors/connectors 40) for a longer conductor path, with higher impedance, in order to better match the impedance of the signal amplification device.

Figure 14B:
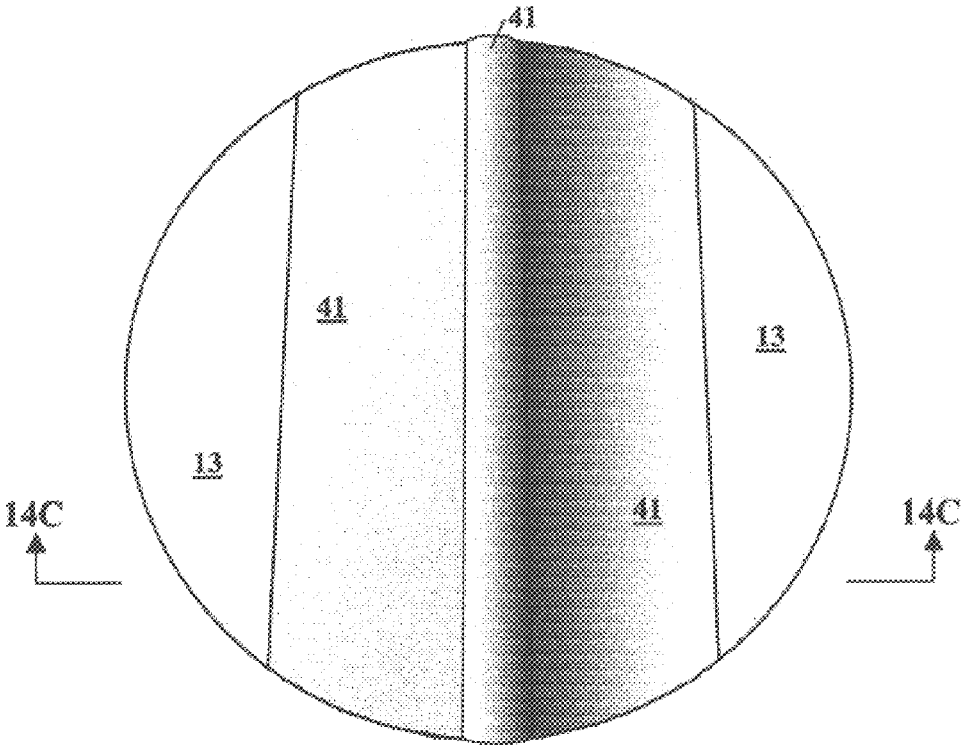
FIG. 14B is a detailed fragmentary plan view of a segment of one of the layers of conductor shown in FIG. 14A2.

FIG. 14B shows a segment of the assembled aluminum-copper conductor combination of FIG. 14A2. As illustrated in these figures, another way to compensate for a limited conductor path is the combination of aluminum conductor 41 and insulated thin copper wire 42 adhered between the aluminum conductor and the thin film. The aluminum conductor also plays the role of a heat-sink for the copper conductor.

Figure 14C:
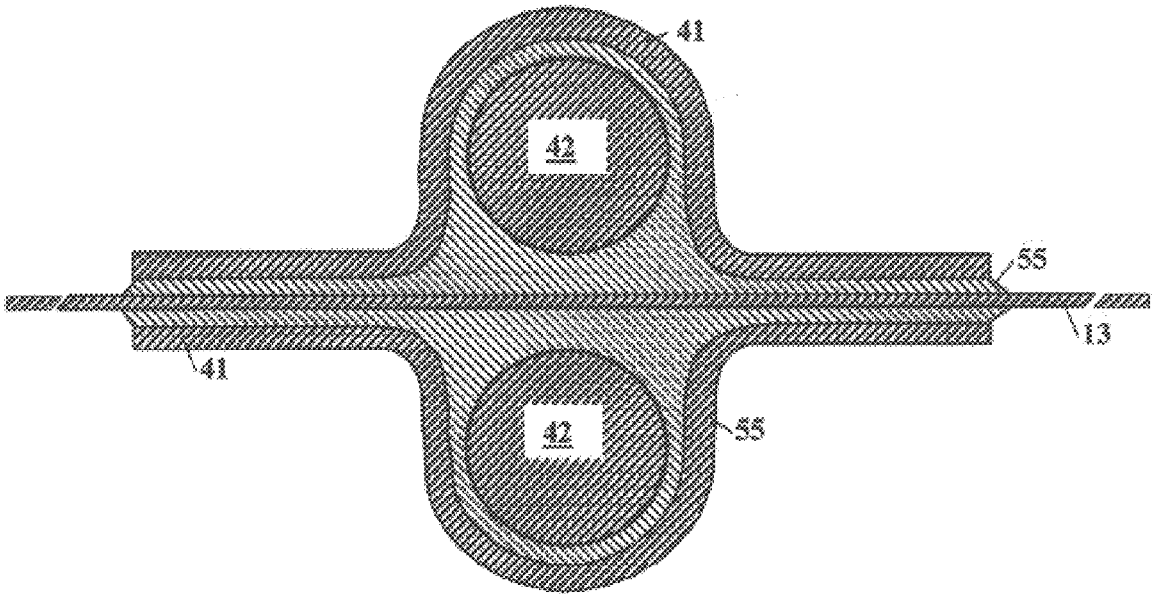
FIG. 14C is a fragmentary cross-sectional view of the conductors and film in FIG. 14B taken along the line 14C—14C.

FIG. 14C shows a detailed cross section of the aluminum-copper conductor combination of FIG. 14B, as adhered to both sides of the thin film.

Figures 15A, 15B:
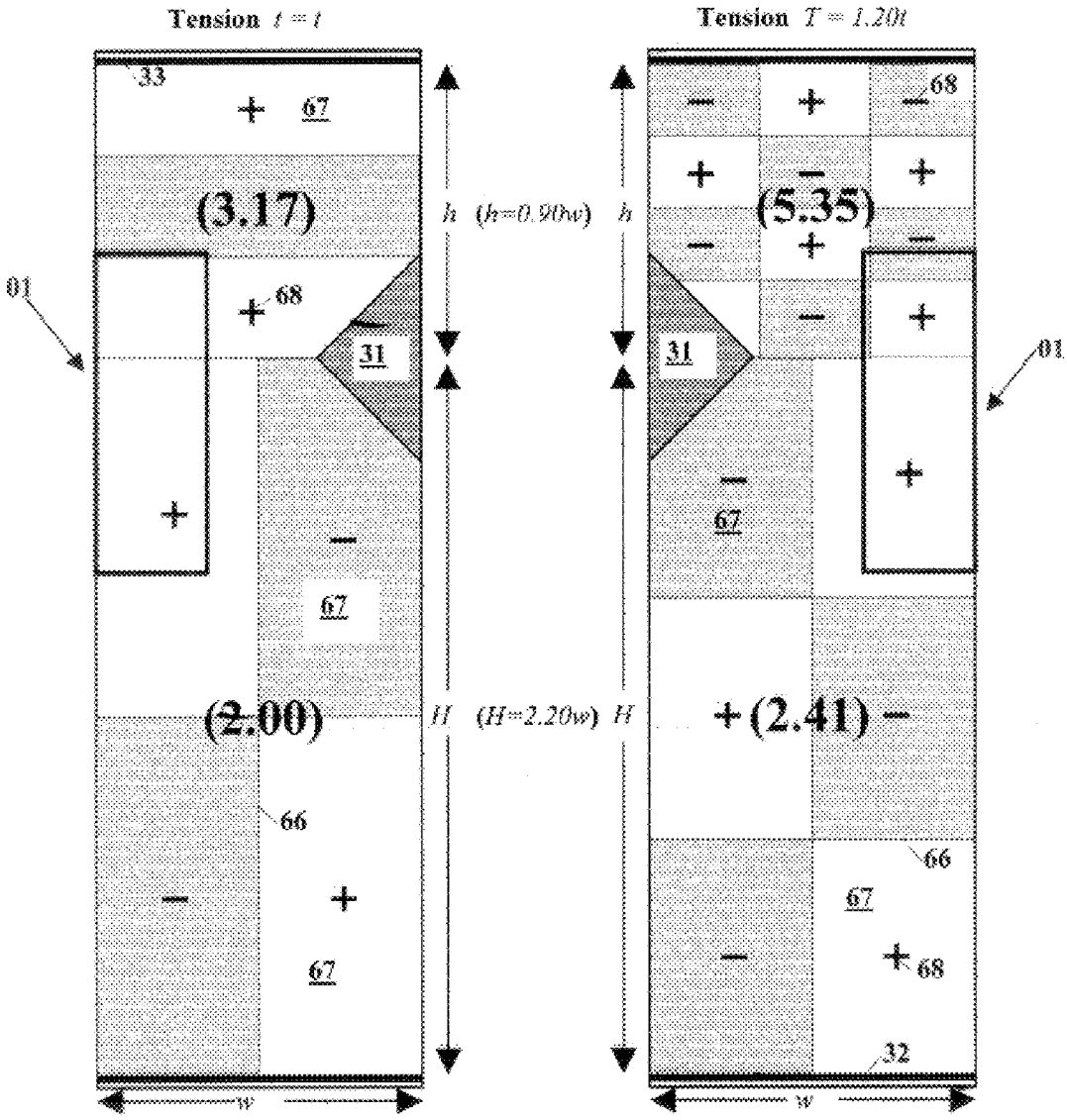
FIGS. 15A and 15B are diagrammatic plan views in the nature of FIGS. 8A and 9A and representing different modes of oscillation under the conditions shown.

FIGS. 15A to 15C are discussed together because they represent an arbitrary snapshot demonstrating one of many possible arrangements for increasing the number of normal modes excited simultaneously. FIG. 15C is not a drawing but is presented as such for consistency. It consists of two tables of higher-resonance to fundamental-resonance frequency ratios $f_{mn}:f_{11}$, one unsorted, shown in Table 1 and one sorted, shown in Table 2. The numeric values representing the arbitrary snapshot are marked on FIGS. 15A to 15B (parentheses) as well as in the tables of FIG. 15C (rectangles). These figures represent a snapshot of an unfolded oscillating medium showing four distinct regions with individual modes of oscillation.

Note: FIGS. 15A to 15C must be considered as participating simultaneously in the illustration of the snapshot example.

Figure 16A:
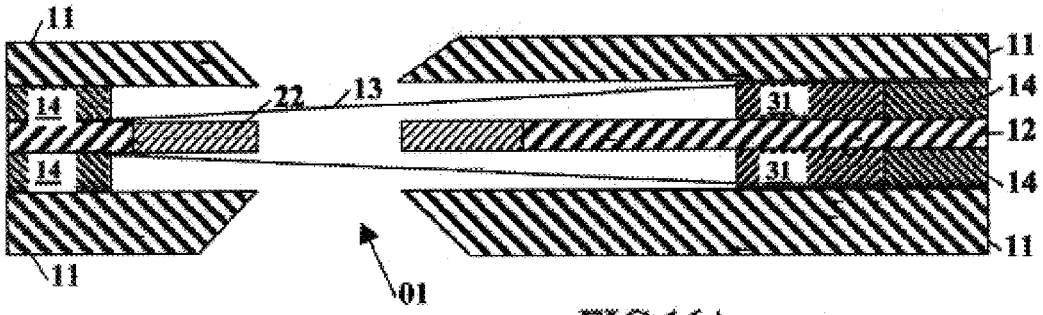
FIG. 16A shows a top cross sectional view in the general nature of FIG. 3B of an alternative embodiment of acoustic transducer in accordance with the present invention. The oscillating members are mounted so that they are not parallel, that is, closer to row of magnets in area of low amplitude oscillations (because of lower compliance of oscillating members in said area).

FIGS. 16A to 17H relate to variations within the overall scope of the present invention. FIGS. 16A to 16B show two possible alternatives for suspending the oscillating medium in the gap between the two parallel baffles. FIG. 16A shows a top cross sectional view of the preferred embodiment with a slanted oscillating medium. FIG. 16B shows a top cross sectional view of the preferred embodiment with no spacers for the oscillating medium. The required gaps with the magnet assembly are adjusted by increasing the air pressure in the sealed cavity between the two thin films. FIG. 16C shows the possibility of suspending a baffle, parallel and above the drumhead of a kettledrum in order to demonstrate the similarity of this percussion instrument to the preferred embodiment of the transducer. FIGS. 17A to 17H show possible combinations of preferred embodiments with a variety of radiation patterns, that is: FIG. 17A—a main module with two baffle extensions, FIG. 17B—two main modules with no baffle extension, FIGS. 17C to 17D—three main modules with no baffle extension, FIG. 17E—two main modules with two baffle extensions, FIGS. 17E to 17F—four main modules with no baffle extension, FIGS. 17G and 17H—main modules and no baffle extension.

Figure 18A:
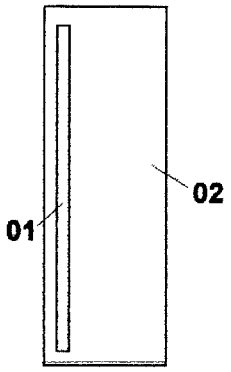
FIGS. 18A to 18C are diagrammatic views of rectangular transducers with an elongated and narrow antinode, aligned with an elongated and narrow opening in the baffle.
Figure 18B:
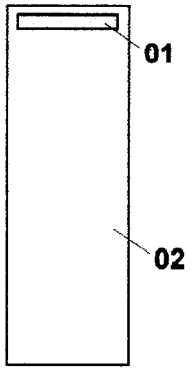
Figure 18C:
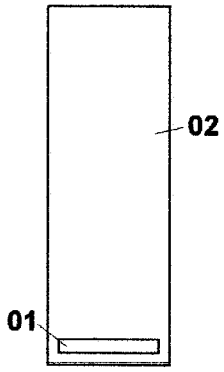
Figure 18D:
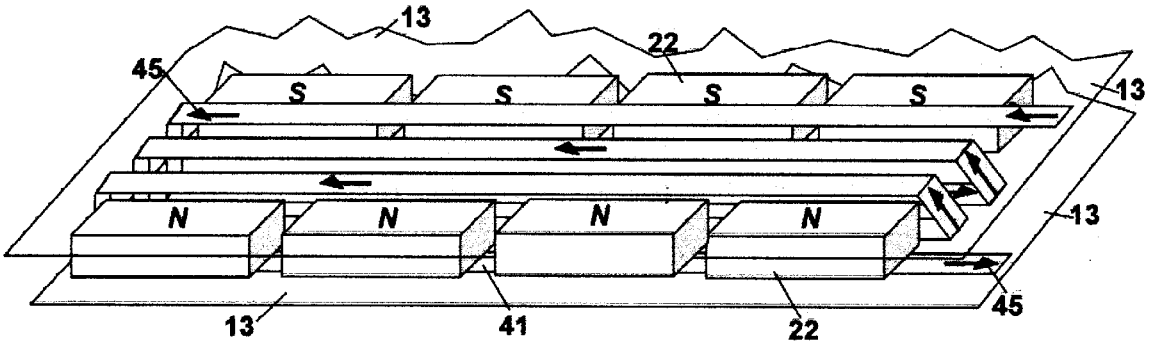
FIG. 18D is a three-dimensional view of an elongated and narrow electromagnetic means for driving a transducers of FIGS. 18A to 18C.
Figure 18E:
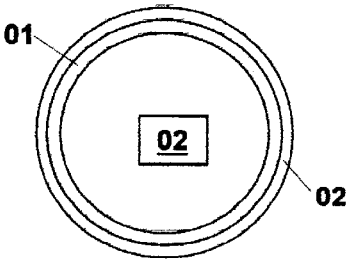
FIGS. 18E to 18G are diagrammatic views of circular transducers having narrow circular, semi-circular and quarter-circular antinodes aligned with openings in baffles of similar shape and dimensions.
Figure 18F:
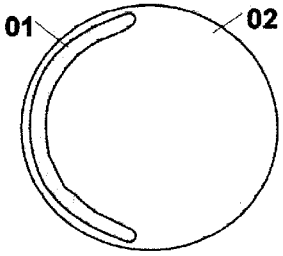
Figure 18G:
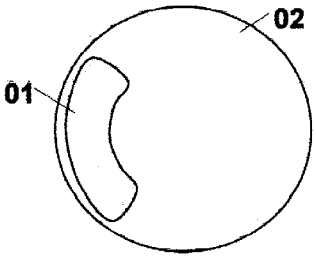

FIGS. 18A to 18C show various positions and sizes of the driven/radiating area as defined by positions and sizes of selected antinodes in a rectangular transducer. FIG. 18D shows a motor means of strips of conductors in a strip-shaped magnetic field produced by a strip-shaped grid of magnets facing each other with opposite polarities. FIGS. 18E to 18G show various positions and sizes of driven/radiating area in a circular transducer.

For a given boundary geometry of an oscillating thin film, mode patterns generated by standing waves at resonance frequencies have predictable geometry as illustrated in FIGS. 7A to 7H. It is this observation, of predictable mode pattern geometry, that constitutes the first fundamental principle of operation of the present invention. Specifically, FIGS. 7A to 7D show the first four mode patterns of a rectangular oscillating thin film. Also, FIG. 7F shows the first nine mode patterns of a rectangular thin film.

The out-of-phase displacement of adjacent antinodes and the even number of antinodes in modes (2,1), (1,2), (2,2), (3,2), (2,3) produce a zero average displacement of the oscillating thin film. Similarly, the odd number of antinodes in modes (1,1), (1,3), (3,1), (3,3) produce a different-from-zero average displacement of the oscillating thin film. The above shows that, in the radiated effective output there is a maximum for each mode pattern with an odd number of antinodes and a minimum for each mode pattern with an even number of antinodes. Such minimum and maximum in effective output is what we have already encountered as resonance-antiresonance irregularity in effective output of an oscillating medium. For simplicity, we consider FIG. 7E showing the mode (2,2) of an oscillating thin film belonging to an oscillating medium of arbitrary geometry. By selecting the asymmetrically positioned upper left antinode of mode (2,2) as the driven/radiating area and by masking with baffles (for clarity, not shown in FIG. 7E—but shown in FIGS. 3A to 3B) the remaining nondriven area of the oscillating thin film, the effective output will be substantially uniform over the frequency range associated with the four lowest modes of oscillation. We may say that the effects of the four lowest modes are controllable because the asymmetrically positioned driven/radiating area is aligned with the asymmetrically positioned opening in the baffle.

Similarly, the effects of the nine lowest modes of an oscillating thin film with identical geometry are controllable when considering the upper left antinode of mode (3,3), as in FIG. 7F. This observation, of controllable effects of modes of oscillation, constitutes the second fundamental principle of operation of the present invention.

Note: Asymmetry is prevalent in the present invention and is the result of the selected extreme asymmetric position for the antinode defining the driven/radiating area.

The resonance-antiresonance irregularities are especially pronounced and audible in the low end of the spectrum, contributing to poor tonal quality. The alignment of the asymmetrically positioned driven/radiating area with the asymmetrically positioned open area 01 in baffle 11 prevents occurrences of resonance-antiresonance irregularities in the effective output at the low end of the spectrum. This is because the inherent asymmetry prevents nodal lines from crossing the limited size driven/radiating area at low frequencies. Or, the nodal lines that first start crossing the driven/radiating area belong to mode patterns associated with higher resonance frequencies, where the nodal lines become progressively denser, as shown in FIG. 7F.

Asymmetry stems from the extreme asymmetric position of the selected driven antinode and from the asymmetric position of open area in the baffle, that allows asymmetric coupling of the oscillating element (as a whole) with the ambient medium. The closed baffle area acoustically insulates the oscillating element from the environment, whereas the open baffle area is acoustically transparent. Generally, the shape of the closed area is asymmetrical (approximately L-shaped in the main embodiment). The shape of the open area is symmetrical, but the position with respect to the boundary of the baffle (and the oscillating element as a whole) is asymmetrical (off-center and as close as possible to the edge).

A limited size and asymmetrically positioned driven/radiating area gives rise to a much larger number of modes simultaneously excited, compared to placing such area at the center of the oscillating medium. The ineffectiveness of a centrally positioned area driving an oscillating medium is derived from the following three facts:

(a) Firstly, when driving the oscillating medium at a point on a nodal line of a mode pattern, the particular mode will not participate in the set of excited modes.

(b) Secondly, when driving the oscillating medium at an antinodal point of a mode pattern, the particular mode is excited in proportion to the associated amplitude involved at that particular point.

(c) Thirdly, driving the oscillating medium at points spanning adjacent antinodes of a mode pattern, gives rise to conflicting out-of-phase displacements that prevent the full development of the particular mode.

Now, since the central area of the oscillating medium is crossed by a large number of nodal lines that start appearing at low frequencies and progressively multiply with increasing frequencies, the number of participating modes will be greatly reduced by a centrally positioned driven/radiating area, giving rise to irregularities in tonal quality of effective output. On the other hand, a relatively small, asymmetrically positioned, driven/radiating area gives rise to a closer approximation of sound at source because a higher number of excited modes participate in determining the timbres of reproduced sounds such as musical instruments or voice. The benefit of combining a small size with asymmetry for a driven/radiating area is supported by a characteristic example from percussion instruments, the kettledrum. If the drumhead is driven (struck) in the center, there is only a dull thump; the sound lacks richness because a relatively large number of nodal lines pass through the central area, therefore many of the associated modes will not be excited; if the drumhead is struck about ¾ out to the edge, many more modes are excited contributing to the production of sound rich in overtones. If the drumhead is struck by a soft mallet, there is a larger area of contact (the driven area is larger) leading to a higher number of driven adjacent antinodes with conflicting displacements, therefore fewer of the higher modes are excited and the produced tone is darker. But, if the drumhead is struck by a hard mallet, the contact area is smaller, the number of nodal lines (or adjacent antinodal areas) struck simultaneously is smaller, more of the higher modes are excited, and the tone is brighter. Similarly, in musical instruments such as the violin or the piano, the strings are driven at narrow segments close to one end for exactly the same reason: production of sound rich in overtones (harmonics) due to the high number of modes simultaneously excited.

Note: In general, the nodes are lines of cancellations (zero displacement) of superposed standing waves as long as energy losses are uniformly distributed among the propagated waves producing the standing waves. This means that at higher characteristic frequencies there will be effective output irregularities caused by nodes, crossing the driven aninodal area, that will interfere with the full development of modes at these higher frequencies. Experimental results based on the performance of prototypes I built show that this is not the case. A possible explanation is that the nodal lines crossing the predetermined antinodal area are not "perfect" nodes in the sense that they do oscillate when a stimulus is applied thereupon. They are "blurry" lines along the expected positions of the nodes. A possible reason behind this phenomenon is the stimulus being applied at the extreme asymmetrical position of the selected antinode in combination with the extreme asymmetrical position of the, aligned with the antinode, opening in the baffles. As a result, areas of extreme differences in mechanical impedance and quality factor Q (from damping) of the oscillating medium are created that give rise to extreme differences in the amplitude of wave disturbances travelling throughout the oscillating medium. Namely, the travelling waves reflected from areas of high impedance and low Q have lower amplitudes than the travelling waves reflected from areas of low impedance and high Q. The opposite is true as well. The resulting standing waves have "deficient" cancellations so that the nodes crossing the driven antinode are nonzero amplitude lines that still oscillate and excite the associated modes under forces exerted by the applied stimulus.

For a given area, the lower resonance frequencies are more sensitive to the width than to the length of the rectangular oscillating thin film. In general, we may say that the longer the propagation path, the longer the propagation time of a disturbance and the lower the resonance frequencies at which the first standing waves start occurring. In particular, for a rectangular thin film, the larger the ratio of length to width, the more sensitive the fundamental frequency is to variations in width, that is, to variations in the propagation path of a widthwise disturbance. The right-angle isosceles triangular clamp 31, introduced as a perturbation in the boundary geometry of the thin film, increases the effective width of the oscillating thin film without increasing the dimensions of the transducer. This is because the widthwise disturbances from the driven/radiating area form standing waves when reflected on the two perpendicular sides of such triangular clamp and then reflected back from the smaller dimension edges, as shown in FIGS. 8A to 8B. The paths of these waves are longer than if the triangular clamp did not exist. Therefore, superposed standing waves resulting from these reflected disturbances start occurring at lower frequencies.

Lengthwise standing waves are practically not affected by the triangular clamp because of the asymmetrical positions of the driven/radiating area and the triangular clamp. Additional clamps at the corners as shown in FIGS. 9D to 9G further increase the path of both widthwise and lengthwise reflected disturbances, leading to an effective increase of both dimensions of the oscillating thin film. Another possible arrangement of clamps is illustrated in FIG. 9M. The boundary shown, forces a disturbance to follow routes that vary from a single short path, to five additional paths having multiply reflected propagation distances that by far exceed the dimensions of the oscillating thin film. And what all these extreme variations in propagation distances do, is to redefine the effective dimensions of the oscillating thin film for further extending the range of occurring resonance frequencies. In particular, the shortest propagation path (thinest line arrow 61 in FIG. 9M) leads to standing waves associated with the highest allowable resonance frequencies while the longest propagation path (thickest line arrow 61 in FIG. 9M), resulting from multiple reflections, leads to standing waves that start occurring at the lowest allowable resonance frequencies.

We may generalize by saying that the oscillating medium with shape perturbations in the boundary of the component thin films, starts having useful effective output at frequencies well below the first lowest and continues to do so well above the last highest resonance frequency as determined by the boundary of the thin films without shape perturbations. Hence, the redefined effective dimensions of each oscillating thin film and resulting superposition of additional standing waves give rise to an increased effective mode density along with an extended effective frequency range of the oscillating medium resonances.

Note: In the context of the present invention, effective mode density is the average number of normal modes occurring simultaneously per unit range of frequencies. This definition relates to the geometry, not to the energy content of the standing waves. Also, effective frequency range is the frequency domain segment delimited by the resonance frequency extremes corresponding to superposed standing waves with the shortest and the longest propagation paths.

The combination of the asymmetrically positioned driven/radiating area with the asymmetrically positioned rectangular open area 01 in baffle 11 and with the asymmetrically positioned triangular perturbation 31 gives rise to a rectangular boundary of such driven/radiating area with variable properties. Therefore, the following parameters vary with position at any given point bordering such boundary: compliance, effective mass, quality factor Q, mechanical impedance.

Compliance: Variation in compliance is a function of the position of a point on the driven/radiating area boundary with respect to thin-film boundary. If the oscillating thin film is divided into cells, the ones closer to larger sections masked by baffles 11 will have a high compliance and will resonate at lower frequencies than cells in sections of lower compliance. Therefore, the driven/radiating area resonates from lower to progressively higher frequencies as a function of compliance variations around the boundary of the driven/radiating area.

Effective mass: Variation in effective mass is a function of the position of a point on the driven/radiating area with respect to thin-film boundaries. If the oscillating thin film is divided into cells, the ones closer to larger sections masked by baffles 11 will have a higher effective mass and resonate at lower frequencies than sections of lower effective mass. Therefore, the driven/radiating area resonates at lower to progressively higher frequencies as a function of effective mass (loading) variations around the boundary of the driven/radiating area.

Quality factor Q: Variations in Q occur around the boundary of the driven/radiating area from lower to higher damping, correspondingly, from sections of higher to lower air-layer compressibility in the air-gaps between the thin film and the baffles. Air-layer compressibility being lower for larger air-gap areas between thin film and baffles 11 and 12 as shown in FIGS. 3A to 3B. By dividing each oscillating thin film into cells, the ones closer to larger sections masked by baffles will have a lower Q, resulting in broader and lower amplitude resonances; the cells closer to smaller sections masked by baffle will have a higher Q, resulting in narrower and higher amplitude resonances. Of course, the central section of the driven/radiating area will have the highest Q resulting in narrowest and highest amplitude resonances.

Mechanical impedance: The edge of the rectangular open area 01 in baffles 11 and 12 constitutes a discontinuity for the oscillating thin films and a boundary with variable and abruptly changing mechanical impedance imposed on the driven/radiating area. The resultant partial reflection (and refraction/transmission) of propagated disturbances is a source of standing waves of variable amplitude, from lower to progressively higher, correspondingly, from boundary sections of the driven/radiating area of lower to progressively higher mechanical impedance. In general, additional superposed standing waves can be induced from partial reflection (and refraction/transmission) of propagated disturbances caused by discontinuities from any abrupt change (say, in the ratio F/v, where F is the applied force and v is the velocity of the oscillating member in the area of the applied stimulus) in mechanical impedance. Changes in mechanical impedance involve either constraining or relaxing the oscillatory motion in predetermined areas of the thin film, or can be anything at all (such as mass loading or boundary geometry) that affects the oscillatory motion induced by disturbances propagating in the oscillating medium. The resulting additional standing waves are superposed on the standing waves determined by the boundary of each of the two oscillating thin films, causing an even further increase of the effective mode density.

Figure 7H:
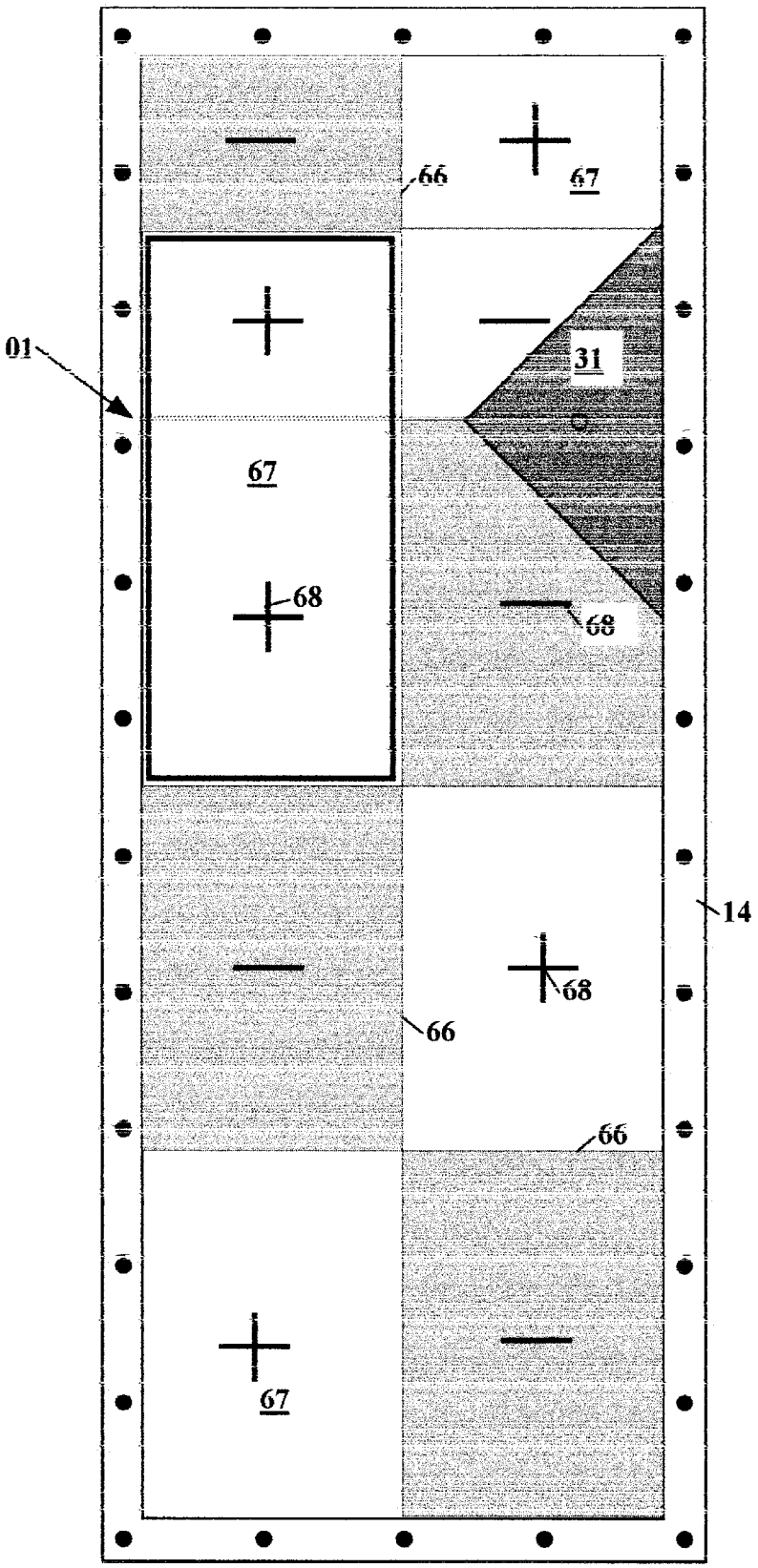

The triangular perturbation 31 introduced in the rectangular shape of each of the two oscillating thin films defines four distinct oscillating regions that are coupled through the common therein driven/radiating area as shown in FIGS. 8A to 8B. Each of such coupled regions produce sets of individual standing waves superposed on the standing waves of the oscillating medium not affected by such triangular perturbation, as illustrated in FIG. 7H. The sets of individual resonance frequencies associated with such standing waves have positions in the frequency domain shifted relative to each other, giving rise to an interlaced sequence of resonance (characteristic) frequencies. This means an increased number of standing waves per unit range of frequency, that is an oscillating medium with a higher effective mode density. The air layer separating the two thin films, being a component of the oscillating medium, oscillates with own resonance frequencies causing a further increase in effective mode density.

The limited, with respect to the total area of the oscillating medium, driven/radiating area reduces directionality of emitted sound and determines a fundamental resonance frequency well above the fundamental resonance frequency of the total area of the oscillating medium. The masking by baffles of the remaining nondriven oscillating medium minimizes the influence of the lower resonance frequencies and of room acoustics on effective output.

Note: In the context of the invention prototype, boundary conditions of the oscillating medium are best defined by the geometry of the two oscillating thin films in combination with the mechanical impedance as affected by the geometry of the air layers in the four air-gaps between each of the two thin films and each of the three baffles (FIG. 3B, FIG. 5). In turn, the geometry of the oscillating thin films is determined by spacers 14 and clamps 31, 32, 33 (FIGS. 6A to 6B); the geometry of the air layers is determined by geometry of baffles 11 and 12 (FIGS. 1 to 3A); the geometry of the baffles is determined by spacers 14, clamps 31, 32, 33, by the relative size and position of open area 01 (FIG. 4) and by the geometry of the baffle extension 03 (FIGS. 1 to 2D). Moreover, the boundary conditions of the oscillating medium are affected by the relative position of open area 01 with respect to floor of listening room (FIGS. 2A to 2D).

The air layer entrapped in the cavity of the oscillating medium strongly couples the thin films 13 at every point thereof because of the low compressibility of such entrapped air. Moreover, since the thin films move in tandem, the air pressure inside the cavity is maintained constant, giving rise to practically uniform and in-phase exerted forces per unit area, independently of whether such area is driven or nondriven.

The combination of the asymmetrical position of driven/radiating area 01, the asymmetrical position of perturbation 31, and the low compressibility of air in the four air gaps (see FIG. 3B) between thin films and baffles, results in better control of excessive displacements that cause flapping of the oscillating medium against the magnet structure and makes possible lower thin-film tensions for extending the low frequency range.

Note: Flapping occurs mostly at the fundamental characteristic frequency of the oscillating medium and is considered, in the context of the present invention, as an extreme case resonance irregularity.

The oscillating medium is driven by an assembly of conductors 41 adhered or otherwise secured on each thin film in the driven/radiating area. Since the assembly of conductors forms a grid adhered on both sides of each thin film, there is superior mechanical coupling of such assembly of conductors with the driven/radiating area. Consequently, there is superior coupling of the driven/radiating area with the electromagnetic forces exerted on the current flowing through the grid of conductors.

Note: As illustrated in FIG. 10A and FIGS. 12G to 12I, the grid structure 41 forms an assembly of double conductors with the exception of the grid boundary, where the conductors are single. Therefore, the current flowing through a grid boundary cross section is half the total current flowing through any other grid cross section of the assembly of conductors.

As shown in FIG. 3B and FIGS. 11A to 11B, the magnet array assembly 22 is supported by thin beams 24 forming a suspended structure with no need for a pole piece supporting panel (the typical perforated ferromagnetic plate). The resulting magnet structure has wide spacing (gaps) in the magnet array and a grid-like pattern of such spacing for further improving the free displacement of air volume and for a minimal interference with the motion of the oscillating medium. The magnet assembly 21 reinforces the boundary magnetic field of magnet array 22 with an oblique magnetic flux, as shown in FIG. 3B. This is to compensate for the lower current intensity in the single conductors at the boundary of grid 41.

Note: The strong magnetic field of rare earth magnets allows for wider spacing in the grid pattern gaps of the magnet structure giving rise in an even weaker interference with the free motion of the coupled with air oscillating medium.

The driven/radiating area is fully exposed and interacts directly with the environment because the magnet array structure is located inside the oscillating medium, as shown in FIG. 3B and FIG. 10A. There is no magnet or any other structure located in front or back of the driven/radiating area interfering with emitted sound. The force exerted on the oscillating medium $F_r=F_1+F_2$ is directly proportional to the current intensity as if the conductors were exposed to a uniform magnetic field. That is, the magnetic field is independent of conductor displacement from the magnet assembly, as shown schematically in FIGS. 10C to 10E. Qualitatively, this is because the average displacement of the oscillating thin films is maintained constant because of strong coupling through the entrapped air layer.

When the acoustical path from the front to the back of the driven/radiating area is equal to a wavelength, dips occur in frequency response due to destructive interference at the particular wavelength of radiated waveform. In an irregular shape baffle assembly 02 and hinged baffle extension 03, the various back-to-front wave paths differ and such destructive interference is spread over a wide frequency range. The baffle shape irregularity is the result of the asymmetrically positioned and relatively limited in size driven/radiating area.

I believe that the resultant natural tonal quality, smooth frequency response and minimal distortion of the transducer effective output are the consequence of the following combined factors:

(a) a higher number of modes will be excited in the oscillating medium from a small and asymmetrically positioned, at a far off-centre antinode, driven/radiating area, (b) fewer occurrences of resonance-antiresonance irregularities result from aligning the oscillating medium and the asymmetrically positioned driven/radiating area therein with the baffle 02 and the asymmetrically positioned opening 01 therein, as shown the combination of FIGS. 4 to 3B and FIGS. 7A to 7H, (c) audibility of resonance-antiresonance irregularities is attenuated by a higher effective mode density from the combined effect of: the asymmetrically positioned and limited in size driven/radiating area, the perturbations in boundary geometry of oscillating thin films, the discontinuities from edges of baffle openings 01, the air layers contained in the oscillating medium cavity and in the gaps between thin films and baffles, (d) a further increase in effective mode density and frequency range of resonances from a variable set of physical parameters caused by the extreme asymmetric positioning of the driven/radiating area relative to boundary of oscillating thin film: compliance, effective mass, impedance, damping, as shown by arrows 65 in FIGS. 9A to 9L, (e) reduced back-to-front-leakage phase cancellations due to a relatively small driven/radiating area compared to area of baffle assembly 02 plus baffle extension 03, as shown in FIGS. 1 to 2D, (f) reduced effects of back-to-front-acoustical-path destructive interference due to driven/radiating area in asymmetrically positioned open area 01 of baffle assembly 02, (g) reduced effects of directionality, of fundamental resonance irregularity and of room acoustics due to a relatively limited size driven/radiating area, (h) adjustable control of early reflections by employing a hinged baffle 03, (i) a driven/radiating area fully exposed to the ambient medium, as shown in FIGS. 1 to 4, (j) a driven/radiating area oscillating in phase at all points, (k) a minimal interference of magnet structure with free motion of driven/radiating area, as shown in FIGS. 3A to 3B, 10A, 11A to 11B, (l) a practically linear, as a function of electric current intensity, force exerted on the driven/radiating area by the magnetic field of magnet arrays 21 and 22, as shown in FIGS. 10C to 10G, (m) reduction of the transducer resonances by employing layered baffles 11, 12 made of plates with different modes of oscillation.

I also believe that: (1) a linear force exerted on the oscillating medium is the most important factor in achieving an effective output with minimal distortion, and (2) an attenuated audibility of resonance-antiresonance irregularities of the oscillating medium is the most important factor for an effective output with natural tonal quality.

The following discussion is presented to assist the reader in understanding the principles of the present invention and to facilitate the design of embodiments of the present invention. However this does not mean that the present invention will not produce its benefits even if the following so-called "assertions" and related hypothetical examples happen to be different from the real world situation.

Assertion 1: The resultant on the driven/radiating area force $F_r=F_1+F_2$ from magnetic field of magnet arrays 21, 22 is practically linear as a function of current intensity because amplitudes are relatively small compared to distance d of each thin film 13 from the parallel therewith plane of symmetry of the magnet assembly 22, as shown in FIG. 10F. To verify this assertion, I made the following two assumptions:

(a) A strong coupling in the driven/radiating area between the two thin films through the layer of air entrapped in the cavity formed by the two thin films. I assumed that such air has low compressibility because of low volume and limited thickness, as shown in FIG. 3B, FIGS. 10C to 10E and FIG. 11A.

Figure 10G:
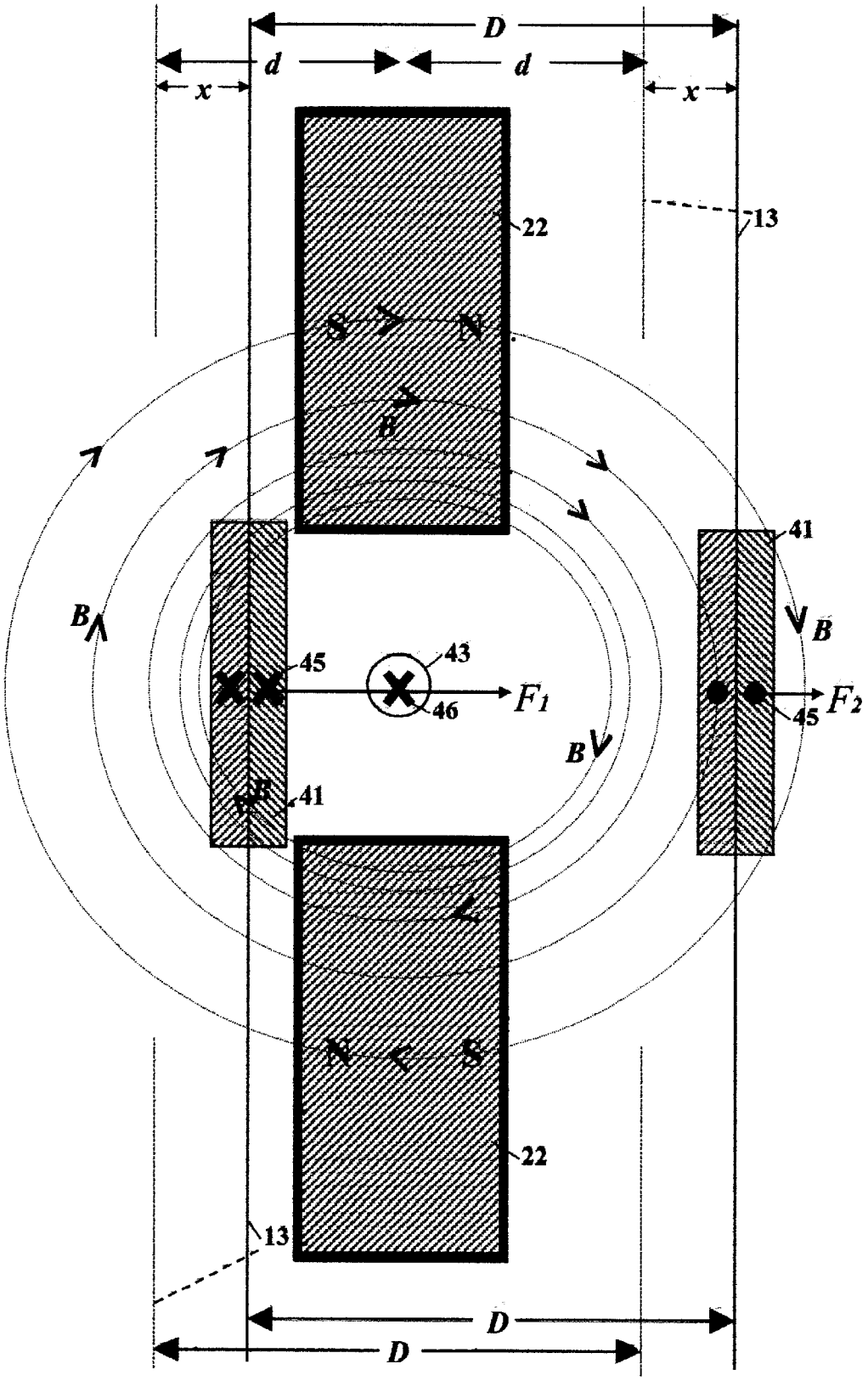

(b) A magnetic field generated by any pair of magnets facing each other with opposite poles is represented by magnetic field lines following a pattern of approximate concentric circular paths, as shown by cross sections in FIGS. 10F to 10G. From this I assume that an equivalent magnetic field can be generated by an imaginary constant electric current 46 flowing through an imaginary cable 43. Such cable coinciding with the, parallel to conductors 41, axis of symmetry of magnets 22. Therefore, the problem of showing linearity of forces exerted on a current-carrying conductor by a magnetic field perpendicular thereon is reduced to determining forces between parallel conductors carrying an electric current.

Example: The diagrams in FIGS. 10C to 10G demonstrate the linearity of the total force exerted on the driven/radiating area as a function of the current flowing through the conductors adhered thereon. In particular, FIGS. 10F to 10G show the two conductors 41, of given length and carrying an electric current of given intensity, exposed to a magnetic field of given intensity from magnet arrays 22. An equivalent magnetic field generated by an imaginary electric current 46 exert two simultaneous push-pull forces $F_1$ and $F_2$ on the two conductors 41. The resultant force $F_r$ is given by the vector sum of $F_1$ and $F_2$:

$$F_r = F_1 + F_2 = Bil\left(\frac{1}{d+x} + \frac{1}{d-x}\right), \text{ hence, } F_r = Bil\frac{2d}{d^2 - x^2} \tag{1}$$

where $F_r$ is the resultant force,

B is the magnetic field (from imaginary electric current 46) intensity, i is the current intensity in conductors 41, l is the segment length of conductor 41, d=D/2 is half the distance D between the two thin films, x is the oscillating medium displacement from equilibrium position.

Because x<<d, equation (1) becomes:

$$F_r = Bil\frac{2}{d} \text{ or } F_r = \frac{4Bl}{D}i \tag{2}$$

As we can see, the resultant force is independent of the displacement x and linear with respect to current intensity i. Relation (2) is true for any segments of conductors exposed to a magnetic field from a correspondingly aligned pair of magnets, therefore, (2) is true for the entire driven/radiating area of the oscillating medium.

Assertion 2: An increased effective mode density attenuates audibility of irregularities at low frequencies. In the low end of the spectrum, antiresonance minima alternate with resonance maxima at widely spaced frequency intervals causing erratic amplitude fluctuations and audible irregularities in effective output. This is because dips in effective output resulting from an even number of antinodes alternate with peaks in effective output resulting from an odd number of antinodes. The audibility of irregularities in the low end of the spectrum is exacerbated by the fact that the ear discerns with greater ease the acoustic contrast of widely spaced amplitude peaks alternating with widely spaced amplitude dips. Hence, an increased effective mode density of the oscillating medium should attenuate audibility of effective output irregularities because the spread of amplitude peaks and dips is reduced. An increased effective mode density can be derived from an oscillating medium with coupled oscillating regions therein having distinct sets of normal modes. And the effective mode density is increased when the associated sets of resonance (characteristic) frequencies are shifted with respect to each other in such a way that, when merged, an interlacing sequence of resonance frequencies is formed in the frequency domain. An infinity of relative positions of such resonance (characteristic) frequency sets satisfy this condition. The criterion for predicting an optimal interlacing sequence is based on the assumption that an approximate alignment of pronounced resonance peaks with pronounced antiresonance dips would be a most effective choice. In its simplest form, this criterion applies to the fundamental resonance frequency (mode (1,1)—a resonance peak) of one oscillating region when aligned with the first overtone (mode (2,1)—an antiresonance dip) of another oscillating region.

Example: The mode frequencies of a rectangular thin film in vacuum is given by the following relation:

$$f_{mn} = \frac{1}{2}\sqrt{\frac{T}{\sigma}}\sqrt{\frac{m^2}{w^2} + \frac{n^2}{h^2}} \tag{3}$$

where $f_{mn}$ is the thin-film (characteristic) resonance frequency for mode m,n in Hertz m,n =1,2,3 . . . , T is the tension of the thin film in (Newtons)/(meter), σ is the thin-film area density in (Kg)/(square meter), h,w are the height and width of thin-film boundary in (meters).

In order to determine the relative position in the frequency domain of the normal mode (characteristic) frequencies belonging an oscillating thin film, the lowest of all resonance frequencies is considered as the reference value, which is the fundamental resonance frequency $f_{11}$. Therefore, instead of considering the absolute values of normal mode frequencies as given by relation (3), we consider the values of every normal mode frequency relative to the lowest of all fundamental resonance frequencies, that is the ratio $f_{mn}/f_{11}$, where $$f_{11} = \frac{1}{2}\sqrt{\frac{T}{\sigma}}\sqrt{\frac{1}{w^2} + \frac{1}{h^2}}\,. \tag{4}$$

Considering the ratios $f_{mn}/f_{11}$ (relative values), rather than the absolute values $f_{mn}$, calculations are simplified and the results are easier to predict because:

(a) Ratios $f_{mn}/f_{11}$ are expressed as a function of only the geometry of the oscillating thin film. Indeed, for predetermined values of thin-film tension T and area density σ, it is simple to prove that $$\frac{f_{mn}}{f_{11}} = \sqrt{\frac{k^2m^2 + n^2}{k^2 + 1}}. \tag{5}$$

where k=h/w is the ratio of height to width of the thin film;

On the other hand, for predetermined values of thin-film tension T and area density σ, the absolute value of $f_{mn}$ is a function of both geometry and area size of the oscillating thin film, for all integer values of m, n. Indeed, if we take as an example the simple case of m=n=1, the fundamental frequency $f_{11}$ can be derived from (4) as $$f_{11} = \frac{1}{2a}\sqrt{\frac{T}{\sigma}}\sqrt{h^2 + w^2},$$

where h, w define the geometry and a=hw defines the area of the oscillating thin film;

(b) Ratios $f_{mn}/f_{11}$ become independent of tension T for oscillating regions belonging to the same thin film, as shown by relation (5);

(c) Ratios $f_{mn}/f_{11}$ become independent of area density σ for all oscillating regions as long as the thin films employed have identical properties, as shown by relation (5);

(d) While resonance frequencies $f_{mn}$ in vacuum, as defined by relation (3), must be corrected by some numeric factor in order to be valid in air, ratios $f_{mn}/f_{11}$ are assumed to be independent of any such numeric factor, since, under identical physical conditions, any such numeric factor would cancel out in relation (5).

In order to demonstrate the possibility of creating an oscillating medium with a high effective mode density, FIGS. 15A to 15C are considered and employed jointly. Said figures illustrate a hypothetical instance or snapshot of two oscillating thin films with arbitrary normal modes of oscillation as determined by the boundary geometry of the four oscillating regions. Variables are marked on the figures under the convention that capital letters represent higher numerical values and small letters express lower numerical values. In order to determine the relative position in the frequency domain of the sets of normal mode (characteristic) frequencies belonging to each of the coupled oscillating regions, the lowest of all resonance frequencies is considered as the reference value. Such lowest resonance frequency is the fundamental resonance frequency of the oscillating region with the largest dimension H and the lowest tension t, as shown in FIGS. 15A to 15B. Now, for reasons of space utilization of a listening room, the width of the transducer must be predetermined. Therefore, the only dimension that can be practically varied, for making sensible geometrical adjustments of the transducer, is the height. Consequently, it is convenient to express the dimensions of the four oscillating regions relative to the width w of the oscillating medium, that is, the heights H and h as multiples of the width w. Accordingly, for a given position of triangular clamp 31, H and h are determined by the positions of the rectangular clamps 32, 33. For simplicity, we consider FIGS. 15A and 15B as a hypothetical case of two oscillating thin films of identical σ and of different tensions t, T but with identical pairs of oscillating regions, as determined by clamps 31, 32, 33. Then the ratios $f_{mn}/f_{11}$ are defined as $$\frac{f_{mn}}{f_{11}} = \frac{K}{k}\sqrt{\frac{T}{t}}\sqrt{\frac{k^2m^2 + n^2}{K^2 + 1}} \tag{6}$$

where $$k = \frac{h}{w},\ K = \frac{H}{w},$$

t=lower and T=higher thin-film tension.

Table 1 in FIG. 15C shows calculated values of $f_{mn}/f_{11}$ for the first four hypothetical normal modes. Table 2 in FIG. 15C shows said calculated values sorted in ascending order for the purpose of numerically demonstrating an interlacing condition and the resulting increase in effective mode density. Calculated resonance frequency ratios 2.00, 2.41, 3.17, 5.35 are marked on FIGS. 15A and 15B as well as on both tables of FIG. 15C to show the association of each snapshot geometrical mode pattern with the corresponding snapshot resonance frequency ratio.

Note: It is important to know that the ratio of height to width of any rectangular thin film must not be expressed as a ratio of integer numbers in order to prevent the phenomenon of degeneracy whereby, for a given resonance frequency, at least two distinct geometric patterns may occur. It can be shown that degeneracy is prevented if the sides of the thin film are incommensurable. Or, from relation (3) above, if h and w are incommensurable, no two pairs of values m and n can give the same characteristic frequency. An interesting observation is that, if in equation (5), we consider the extreme case of relatively large values for k and in equation (6) we consider the extreme case whereby k=K>>1 and t=T, then we have an oscillating medium with both h and H>>w that behaves like a string with modes in harmonic relation because both (5) and (6) become:

$$\frac{f_{mn}}{f_{11}} = m, \text{ for } m = 1, 2, \ldots \tag{7}$$

Indeed, the larger the ratios k and K in equations (5) and (6) are, the more the calculated resonance frequency ratios $f_{mn}/f_{11}$ tend to cluster around positions in the frequency domain that are in harmonic relation, and the larger the resonance frequency gaps will be, especially in the low end of the spectrum. This is why high ratios of height to width in the geometry of oscillating thin films should be avoided if we are to obtain a high effective mode density. On the other hand, high ratios of height to width offer a more uniform, therefore easier to control and predict, distribution of resonance frequencies, albeit wider spaced, in the frequency domain.

Note: Equation (6), with approximate ratios T/t=1.2, h/w=0.9, H/w=2.2, gave very promising calculated results. A prototype, using Kapton Type 30HN, 7.5 micron, thin film and approximate values of t=100 Newton/meter, H+h=61 cm, w=21 cm, experimentally confirmed said calculated results by way of a measured uniform amplitude-frequency response and by way of a perceived natural tonal quality. This, however, does not exclude the existence of other, equally effective, combinations of parameter values.

Assertion 3: The wider the frequency domain spacing between adjacent amplitude dips and peaks, the greater the sensitivity of the hearing mechanism in distinctly detecting irregularities in the spectrum of complex sound such as voice and music. This is a particularly prominent phenomenon in the low frequency end of the spectrum and audibly detrimental to the effective output. A large number of superposed standing waves in the driven/radiating area from coupled through such area oscillating regions leads to an increased effective mode density of the oscillating medium and attenuation in audibility of resonance-antiresonance irregularities.

Example: As an extreme case, consider an oscillating medium with an effective mode density so high that any adjacent irregularities in the effective radiated output are spaced well within the limits of the frequency discrimination capability of the hearing mechanism. Such irregularities would not be distinctly audible because the ear would not be able to discern them. Moreover, a progressively higher number of standing waves gives rise to resonances and associated modes that tend to become statistically significant; in particular, the details in the structure of the lower end of the spectrum tend to be less clear. That is, a high density of interlaced normal modes does not allow development of standing waves with clearly defined mode patterns to distinctly affect the reproduced output in the low end of the frequency range. We may say that a certain degree of randomness in resonance-antiresonance irregularities occurs, otherwise characteristic of only the higher frequency range.

Assertion 4: Relatively high amplitude (high Q) peaks in effective output do not necessarily result in pronounced audibility of resonances. Conversely, relatively low amplitude (low Q) peaks could result in pronounced audibility of resonances. The audibility of a resonance is more a function of the amount of energy stored in such resonance rather than the height of the amplitude peak. A generally accepted consensus is that with adequate damping resonances can be considerably reduced. However, while an amplitude—frequency response curve could appear perfectly flat to the eye, existing strongly damped resonances can still be detected by the ear. This is because the area under the resonance curve, expressing the stored energy, is not much affected by damping although the shape of the resonance curve does change by becoming lower and broader. The inherent device asymmetry produces area segments along the boundary of the driven/radiating area with variable and relatively weak damping. The resultant variable and relatively low Q of the driven/radiating area leads to smooth variations in resonance bandwidths that in turn create a more uniform acoustic energy distribution in effective output.

Example: For segments of the driven/radiating area boundary that are in the vicinity of larger masked (by outer baffles) sections of the thin film, Q becomes progressively lower due to progressively stronger damping while resonance (characteristic) frequencies become progressively lower due to progressively higher compliance and higher effective mass. Generally speaking, the audibility of resonance-antiresonance irregularities is particularly pronounced in the lower frequency range because of wider spaced peaks and dips. A progressively lower Q in combination with progressively lower frequency radiating segments along the boundary of the driven/radiating area, further reduces audibility of irregularities because progressively broader bandwidth resonance peaks partially overlap adjacent antiresonance dips. A side benefit of a low Q is an extended low frequency effective output from a broader bandwidth of the (lowest) fundamental resonance frequency of the oscillating medium.

Assertion 5: Improved impedance matching of oscillating medium to ambient air due to oscillating, in tandem, air entrapped in the cavity between the two oscillating thin films. Also, improved impedance matching of oscillating medium to ambient air, by way of entrapped air oscillating (sucked in and squeezed out) in the asymmetrical gap area between the oscillating medium and the outer baffles (outer-air-gap).

Example: Musical instruments are low efficiency (maximum 2%) devices. The remarkable acoustic output of relatively small size musical instruments such as the violin, flute, clarinet, is mostly due to the excellent impedance matching of the air oscillating in the body (Helmholtz resonator, pipe, horn) of the instrument with the ambient air, and, to a much lesser extent, to the oscillations of the body itself.

To conclude this section, I would like to point out to the reader that the objective of reducing the audibility of resonance-antiresonance irregularities in the effective output relates exclusively to the transducer as a reproducing device; resonances existent in the program material will still be audible as inherent resonances defining the timbres of the reproduced source components such as voice or musical instruments.

Ramifications

Figure 16B:
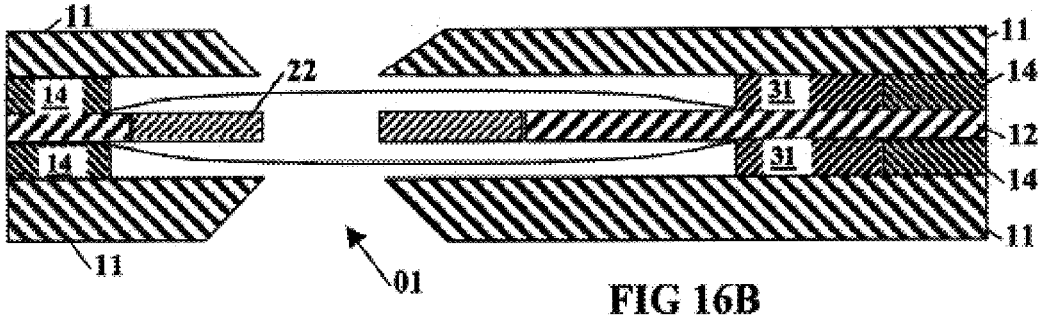
FIG. 16B shows a top cross sectional view in the nature of FIG. 16A of yet a further alternative embodiment of acoustic transducer of the present invention, wherein the oscillating members are curved by inflating the hermetically enclosed space between them.
Figure 16C:
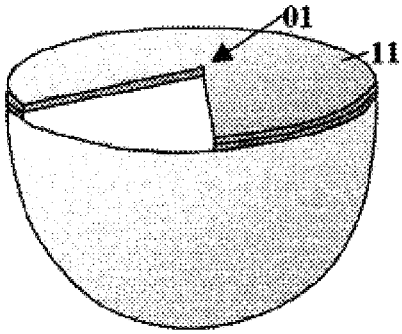
FIG. 16C is a diagrammatic perspective view of an alternative transducer in accordance with the present invention, in the configuration of a kettledrum.
Figure 17A:
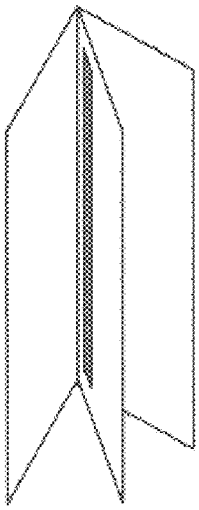
FIG. 17A is a diagrammatic perspective view of an acoustic transducer in accordance with the present invention, having a single transducer module with two baffle extensions.
Figure 17B:
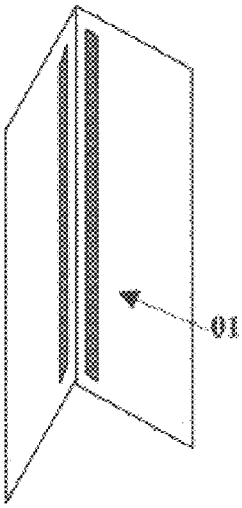
FIG. 17B is a view in the nature of FIG. 17A of an alternative acoustic transducer in accordance with the present invention, wherein two modules are hinged together with no baffle extension.
Figure 17C:
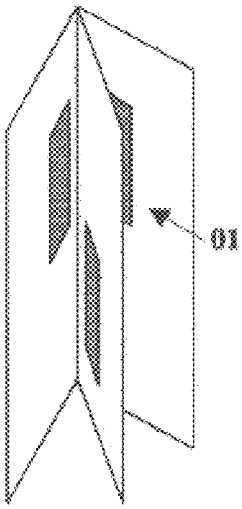
FIGS. 17C and 17D are views in the nature of FIG. 17A of alternative acoustic transducers in accordance with the present invention, wherein three modules are hinged together.
Figure 17D:
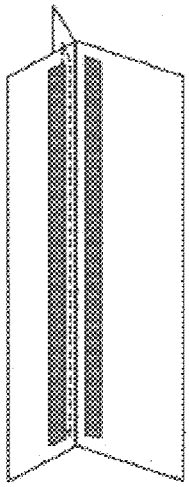
Figure 17E:
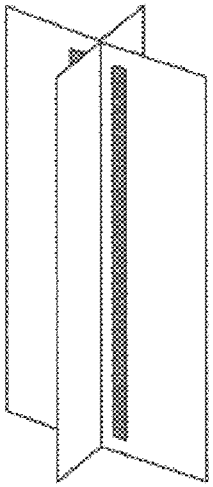
FIG. 17E is a view in the nature FIG. 17A of an alternative acoustic transducer of the present invention having two modules with two baffle extensions.
Figure 17F:
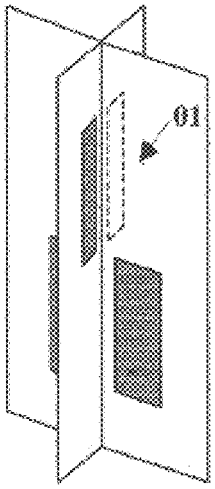
FIG. 17F is a view in the nature of FIG. 17A of an alternative transducer of the present invention having four modules hinged together.
Figure 17G:
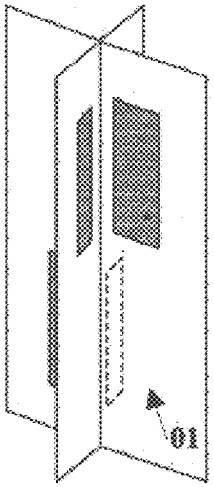
FIG. 17G is a view in the nature of FIG. 17A of an alternative transducer of the present invention having four modules hinged together.
Figure 17H:
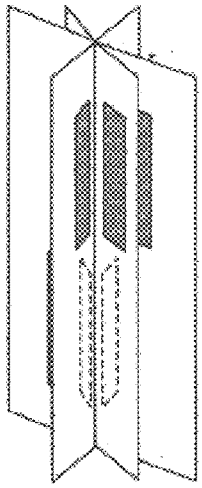
FIG. 17H is a view in the nature of FIG. 17A of an alternative transducer of the present invention having six modules hinged together.

While my foregoing description refers to a preferred embodiment, there are many other possibilities within the contemplated scope of the present invention such as:

(a) The notion of a transducer as described in preferred embodiment of the present invention, a device for converting electric to acoustic energy (loudspeaker), is also valid as a device for converting acoustic to electric energy (microphone) or as a device converting mechanical energy into electric energy (turntable cartridge);

(b) Besides perturbations in geometry by using clamps, perturbations in the boundaries of the oscillating medium can be introduced by also loading at predetermined boundary sections at least one of the oscillating members with thin and flexible material of predetermined mass and shape adhered thereupon. Other types of perturbations can be introduced by restraining the oscillating member by way of sections with higher mechanical impedance imposed on the oscillatory motion of the oscillating member, say by selectively using smaller air gaps—lower air compressibility—between thin films and baffles. Yet other types of perturbations can be created by relaxing said oscillating member by way of sections with lower mechanical impedance imposed on the oscillatory motion of said oscillating member, say by selectively using larger air gaps—higher air compressibility—between thin films and baffles. Such perturbations, that may also have the shapes of the clamps, create discontinuities from transitions in impedance, giving rise to partial reflections of disturbances. Hence, we have formation of distinct propagation paths of superposed standing waves that further increase the effective mode density and extend the frequency range of the driven/radiating area;

(c) For simplicity, the boundary of the oscillating medium in the preferred embodiment is rectangular. Nevertheless, any other boundary such as circular or elliptical is possible, in which case the driven/radiating area could have a piece-of-pie shape that would also be asymmetrically positioned with respect to the boundaries of the oscillating medium, as shown in FIG. 16C. It can also have a circular shape as in FIG. 18E, a semicircular shape as in FIG. 18F or a quarter-circular shape as in FIG. 18G;

(d) Also for simplicity, the driven/radiating area of the preferred embodiment is defined by an antinode belonging to the fourth mode (2,2), as shown in FIGS. 7A to 7D. Nevertheless, any other normal mode with an asymmetrically positioned (as close as possible to the edge) antinode could be considered, as shown in FIGS. 18A to 18C. The higher the resonance frequency of the considered normal mode, the higher the number of eliminated occurrences of resonance-antiresonance irregularities at lower frequencies and the larger the number of normal modes contributing to the improvement of the reproduced waveform tonal quality;

(e) The thin films can be adhered to spacers of unequal thickness giving the oscillating medium a slanted position with respect to the planes of the baffles FIG. 16A. The slopes of the thin films give rise to smaller oscillating medium gaps with the magnet structure for sections of high-frequency-low-amplitude oscillations because of low compliance, and larger gaps for sections of low-frequency-high-amplitude oscillations because of high compliance. The arrangement reduces the danger of flapping against the magnet structure by combining small gaps with low compliance for producing high-frequency-low-amplitude oscillations and large gaps with high compliance for producing low-frequency-high-amplitude oscillations;

(f) The thin films can have boundaries adhered directly to the inner baffle without any spacers. Proper gaps with magnet array structure can be adjusted by increasing the air pressure of the hermetically sealed cavity thus inflating the thin films until the desired spacing with magnet structure is obtained, as shown in FIG. 16B;

(g) Electromagnetic, electrostatic, piezoelectric forces or combinations of forces could be used as motor means for driving the oscillating medium. FIG. 18D shows an example of motor means from strips of conductors in a magnetic field produced by an array of parallel adjacent magnets of opposite polarity. These motor means include also mechanical forces such as in playing musical instruments. The kettledrum, as a percussion instrument, becomes a mechanically driven transducer similar in principle to the preferred embodiment of the present invention if a parallel to the drumhead circular baffle having a piece-of-pie cutaway is suspended with a small gap parallel to the drumhead. For example, an approximation of a ¾ circular segment cutaway as shown in FIG. 16C, would define a practically acceptable driven/radiating area. In addition, mass loaded or clamped perturbations in the circular shape of the drumhead could be applied to manipulate the tone of the instrument. I expect that such an assembly would improve the low frequency response and the tonal quality of the instrument without affecting the process of tuning the instrument to desired pitch;

(h) For an oscillating medium comprising a plurality of thin films, the boundary conditions could be affected by thin films that may or may not be mass-loaded or clamped. The oscillating medium can be constructed in any combination of possible boundary conditions for a further increase in variety of inherent modes leading to a further increase in effective mode density. For example, an oscillating medium may consist of a multitude of rectangular thin films with one thin film having no perturbation in shape, another with a perturbation produced by mass-loading with a thin plate, yet another with a perturbation produced by clamps as presented in the preferred embodiment of this invention. It is conceivable that a driven/radiating area, with a multitude of superposed standing waves from a multitude of coupled through such area oscillating regions, could have the effective mode density at the lower end of the spectrum increased to levels approaching the effective mode density at the higher end of the spectrum;

(i) Eliminating the outer baffles for exposing to the environment both driven and nondriven areas of the oscillating medium offers also the advantage of a simpler construction. With the outer baffles removed, the reduction of irregularities in effective output would exclusively rely on the increased effective mode density from the inherent asymmetry and from geometry perturbations;

(j) One instead of two or more thin films could be used as an oscillating medium, having identical, in every other aspect of the preferred embodiment, characteristics of boundary conditions and asymmetry for reducing occurrences and for attenuating audibility of irregularities. The advantage of a simpler construction is offset by reduced tonal quality from:

lower effective mode density because of fewer possible oscillating regions, interference with emitted sound from the necessity of placing the magnet structures on at least one side of the driven/radiating area, additional interference with free motion of the thin film from pole pieces used for redirecting the magnetic flux to the, adhered on thin film, conductors, distortions in effective output from the conductors adhered on the driven/radiating area moving in a magnetic field affected by distance variations of such area from an array of magnets placed on one side of the oscillating medium;

(k) In the event electrostatic field forces are driving the radiating area, the hermetically sealed cavity between the thin films of the oscillating medium can be filled with gas of high dielectric strength for reducing the danger of high tension arcing;

(l) The hermetically sealed cavity of said oscillating medium could be filled with any substance closely matching the mechanical impedance of the ambient medium.

(m) Various combinations of preferred embodiment modules are shown in FIGS. 17A to 17H in order to demonstrate the simplicity and flexibility of possible design configurations. Worthwhile noting is the ability to radiate horizontally most of the acoustic energy from a pronounced directionality of less than 90 degrees, in FIGS. 17A to 17C, to a 360 degrees virtual cylindrical radiation, simulating a pulsating line source, in FIGS. 17D to 17H. Many more arrangements can be assembled by extrapolating on the idea illustrated in FIGS. 17E to 17H. An unlimited variety of possible radiation patterns could result by manipulating the number of participating modules, the angle between the modules, the positions of the driven/radiating areas and the sense of the electric current feeding each module. A common signal could be supplied to the modules with phase differences of 0 degrees or 180 degrees, in any combination, by simply alternating connections with the terminals of each driven/radiating area. Conventional rigid diaphragm speakers mounted in baffles as in FIGS. 17B to 17H leads to a similar variety of possible radiation patterns;

(n) Coincidence of resonances from identical baffles can be avoided also by employing identical panels of different materials or by employing identical panels and materials but mass loaded so as to shift the individual mode frequencies accordingly;

(o) The ambient medium could be any fluid such as water, in which case the current-carrying conductors would be adhered only on the inner surfaces of the oscillating medium hermetically sealed cavity, for protection from a conductive operating environment;

(p) Of course the possibility of developing a high effective density of modes for reducing audibility of irregularities applies to any oscillating body, including the air volume in an enclosure. As a compromise between the transducer of the present invention and transducers with enclosures, I suggest the case of an enclosure having as a front panel the preferred embodiment of this invention. Three-dimensional perturbations in the internal geometry of the enclosure, functionally similar to the two-dimensional perturbations employed in the preferred embodiment, could be employed for reducing effective output irregularities from the modes of oscillation of the contained volume of air. Specifically, an enclosure consisting of at least two coupled chambers of predetermined volumes and boundary conditions, would be similar in principle with the thin-film oscillating medium of the present invention. The resultant interlacing of resonance (characteristic) frequencies would produce an oscillating volume body of contained air with a high effective mode density. The combined device would still have the advantage of a simple, standalone transducer with improved tonal quality.

Accordingly, the scope of the invention should not be limited to the illustrated embodiments but by the appended claims and their legal equivalents.

What I claim is:

1. A transducer for accurately and efficiently reproducing a stimulus applied thereupon, operating in a fluid ambient medium, having an effective output spectrum defined within a predetermined effective range of frequencies, comprising:

(a) an oscillating medium assembly of layered components suspended in said ambient medium, comprising at least one oscillating member delimited by at least one supporting member with predetermined geometry defining the boundary of said oscillating member;

(b) said oscillating medium with predetermined boundary conditions imposed on the oscillatory motion of said oscillating member;

(c) said oscillatory motion induced by standing waves associated with the intrinsic normal mode patterns of antinodes delimited by nodes, and with the characteristic frequencies of said oscillating member;

(d) said stimulus applied to an asymmetrically positioned, and substantially adjacent to the boundary of said oscillating member, antinode of a normal mode pattern associated with a predetermined characteristic frequency high enough to satisfy the condition of said antinode being substantially adjacent to said boundary of said oscillating member;

(e) said extreme position of said antinode giving rise to values of quality factor Q distributed asymmetrically with respect to the consequent extreme position of the oscillatory forces exerted by said stimulus on said oscillating member;

(f) driving means for coupling said stimulus to said oscillating member by way of said asymmetrically positioned, and substantially adjacent to said boundary of said oscillating member, antinode, so that a substantially high effective density of normal modes and associated characteristic frequencies is derived from a substantially high number of concurrently excited normal modes;

(g) said substantially high number of concurrently excited normal modes resulting from said stimulus being coupled to antinodes delimited by oscillating nodal lines crossing said antinode;

(h) said oscillating nodal lines resulting from partial amplitude cancellations along expected positions of nodes associated with normal modes of oscillation concurrently excited by said stimulus;

(i) said partial amplitude cancellations resulting from amplitude differentials of incident and reflected waves;

(j) said amplitude differentials resulting from applying said stimulus at the extreme asymmetrical position of said antinode, and expected from said asymmetrically distributed quality factor Q of said oscillating member; and (k) means for attenuating effective output irregularities caused by said oscillating medium interacting with said ambient medium;

whereby, a balanced energy distribution in the spectrum of the effective output will be derived from a high effective density of normal modes and from a simultaneous attenuation of irregularities caused by interaction of oscillating with ambient medium, so that said transducer will reproduce an improved approximation of said stimulus at source.

2. A transducer according to claim 1 wherein said attenuating means comprises:

(a) at least one outer baffle facing said oscillating member and separated therefrom by predetermined spacing;

(b) said outer baffle having an asymmetrically positioned open area with a perimeter aligned with the nodal lines delimiting said, asymmetrically positioned and substantially adjacent to said boundary of said oscillating member, antinode;

(c) said open area allowing asymmetrical and partial coupling of said oscillating member with said ambient medium by way of said antinode while the remaining area of said oscillating member being decoupled by said baffle;

(d) said asymmetrical and partial coupling of said oscillating medium with said ambient medium adapted to mask occurrences of irregularities caused by out of phase displacements in the area of said oscillating medium being decoupled from said ambient medium by said baffle;

(e) said asymmetrical and partial coupling of said oscillating member with said ambient medium also adapted to minimize interference of ambient medium with the process of reproducing said stimulus;

(f) said baffle adapted to progressively reduce said quality factor Q of the oscillating member, leading to progressively broader, in bandwidth, and lower, in amplitude, resonance peaks partially overlapping adjacent anti-resonance dips;

(g) said broader and lower resonance peaks, for a uniform distribution of fluctuations in frequency response and for extending the low end of the effective frequency range;

(h) said baffle adapted to cause, in the vicinity of said perimeter of said open area, an abrupt change in the boundary conditions of said oscillating medium imposed to said oscillating member;

(i) said abrupt change in boundary conditions creating a discontinuity in said oscillating member, resulting in additional superposed normal modes concurrently excited from reflection and transmission of disturbances in the vicinity of said nodes delimiting said antinode; and (j) said additional superposed normal modes for further increasing density of normal modes and for extending the high end of the effective frequency range;

whereby, said attenuating means performs the simultaneous functions of masking occurrences of resonance-antiresonance irregularities, of minimizing interference of ambient medium irregularities with reproduction of said stimulus, of limiting fluctuations in frequency response, of extending the effective frequency range and of increasing the normal mode effective density of the effective output.

3. A transducer according to claim 2 further comprising:

means for further altering the boundary conditions of said oscillating medium, deriving therefrom additional discontinuities in said oscillating member, so that additional reflections and transmissions of propagated wave disturbances are induced, giving rise to additional superposed standing waves in said oscillating member;

whereby, additional normal modes of oscillation concurrently participate in reproducing said stimulus, for an additional increase in the density of modes, therefrom substantially minimizing detection of irregularities in the spectrum of the effective output.

4. A transducer according to claim 3 wherein said altering means comprises:

(a) interference with the oscillatory motion of said oscillating member, comprising perturbations imposed on predetermined sections of said oscillating member, for creating at least two coupled oscillating regions therein, each of said oscillating regions defining a distinct set of normal modes and associated characteristic frequencies; and (b) said characteristic frequencies, in combination for all said regions, interlaced in the frequency domain, for an even further increase in said effective density of normal modes of the oscillating medium that concurrently participate in reproducing said stimulus.

5. A transducer according to claim 4 wherein said oscillating medium comprises at least two layered low mass thin oscillating members, positioned at predetermined distance from each other on said supporting member, together delimiting at least one hermetically sealed cavity with predetermined fluid substance entrapped therein, being adapted for;

(a) matching mechanical impedance of said oscillating medium with mechanical impedance of said ambient medium, so as to optimize exchange of energy between said oscillating medium and said ambient medium; and (b) increasing density of normal modes of said oscillating medium by way of the concurrent participation of normal modes of said entrapped in said cavity fluid substance;

whereby, said entrapped in said cavity fluid substance will improve both efficiency and accuracy of said oscillating medium reproducing said stimulus.

6. A transducer according to claim 5 further comprising:

(a) at least one inner baffle suspended between said low mass thin oscillating members, having an asymmetrically positioned open area aligned with said asymmetrically positioned, and substantially adjacent to said oscillating member boundary, antinode of each of said oscillating members;

(b) said inner baffle asymmetrically coupling said oscillating members, through said open area, by way of said antinode of each of said oscillating members interacting with said fluid substance;

(c) said inner baffle decoupling said oscillating members in the remaining area thereof;

(d) said oscillating members having distinct set of normal modes and associated characteristic frequencies, with said characteristic frequencies interlaced in the frequency domain, for even further increasing said effective density of normal modes of said oscillating medium that concurrently participate in reproducing said stimulus;

(e) said driving means comprises said fluid substance entrapped in said hermetically sealed cavity, a mobile member secured to said antinode and a proximal immobile member immersed in said cavity, jointly adapted to interface said oscillating medium with said stimulus; and (f) said stimulus inducing displacements from linear and uniform oscillatory forces exerted on said antinode by said mobile member interacting, in accordance with electrical signals, with said immobile member, and by said cavity fluid interacting, in accordance with pressure variations, with said ambient fluid;

whereby, said transducer will accurately reproduce the spectrum of an applied thereupon stimulus as a result of uniformly accelerated and phase-coherent displacements induced by forces substantially in accordance with the spectrum of said stimulus at source.

7. A transducer according to claim 1 wherein:

(a) said ambient medium is atmospheric air;

(b) said effective output spectrum is defined within the human hearing range of frequencies;

(c) said oscillating member of said oscillating medium is a rectangular thin film, stretched at predetermined tension on said supporting member;

whereby, said transducer will have effective output with improved tonal quality.

8. A transducer according to claim 7 wherein said oscillating medium comprises:

(a) a layered assembly of at least two rectangular parallel oscillating thin films with a substantially massive, rigid, rectangular, inner baffle suspended therebetween, of predetermined thickness and of similar largest dimensions with said thin films;

(b) said inner baffle having a rectangular inner-baffle open area asymmetrically positioned therein and aligned with said asymmetrically positioned antinode;

(c) a pair of rectangular inner-baffle spacers of predetermined thickness, each bordering an opposite side of said inner baffle, each of said inner-baffle spacers also defining boundary geometry of a respective one of said thin films being stretched thereover with predetermined tension;

(d) said predetermined tension of each of said thin films being adapted to define interlacing positions in the frequency domain of characteristic frequencies associated with the normal modes of oscillation of each of said thin films, for an increase in said effective density of normal modes;

(e) each of said thin films being suspended parallel with, and at inner-air-gap spacing from, said inner baffle by way of each of said inner-baffle spacers, while forming together with each of said inner-baffle spacers and said inner baffle, in combination, at least one hermetically sealed cavity with air entrapped therein;

(f) air oscillating in said inner-air-gap spacing having substantially low compressibility, for controlling excessive displacements from the position of equilibrium of said oscillating medium;

(g) said thin films being coupled at said antinode of each said thin film, through said inner-baffle open area, by air entrapped in said cavity, for maximizing density of interacting modes in said antinode driven area;

(h) said thin films being decoupled in the remaining nondriven area by said inner-baffle solid area, limiting interaction of modes thereof;

(i) air in said cavity having substantially constant pressure for uniform and in-phase oscillating forces per unit area of said antinode of each of said thin films;

(j) air oscillating in said cavity also optimizing the impedance matching between said oscillating medium and air of said ambient medium, thereby maximizing acoustic energy exchange between the two media; and (k) normal modes of oscillation of air oscillating in said cavity superposed on normal modes of said oscillating thin films for a further increase in said effective density of normal modes of said oscillating medium.

9. A transducer according to claim 8 further comprising:

(a) clamps introduced as predetermined perturbations in boundary geometry of each of said thin films, adapted to alter said boundary conditions of said oscillating medium and define distinct oscillating regions in each of said thin films, for producing additional said characteristic frequencies interlaced in the frequency domain; and (b) position adjustable clamps introduced as variable perturbations in boundary geometry of said oscillating thin films, adapted to alter the area size and further alter boundary conditions of each of said oscillating regions, so as to fine-tune, by shifting said characteristic frequencies into interlacing positions in the frequency domain, for each of said oscillating regions;

whereby said boundary conditions of said oscillating medium are determined by said inner baffle in combination with each said inner-baffle spacer, said predetermined and variable perturbations in boundary geometry of said oscillating medium and air in each said inner-air-gap spacing.

10. A transducer according to claim 9 further comprising:

(a) a pair of parallel outer baffles of substantially identical largest dimensions with said inner baffle, each of said outer baffles of predetermined thickness and having an asymmetrically positioned outer-baffle open area therein and a rectangular outer-baffle spacer of predetermined thickness bordering the inner side of each of said outer baffles;

(b) a sandwich configuration of said two outer baffles with said oscillating medium suspended at outer-air-gap spacing therebetween by way of said outer-baffle spacers, and having said asymmetrically positioned outer-baffle open area therein aligned with said antinode for asymmetrical and partial coupling of said oscillating medium with said ambient medium;

(c) air oscillating in said outer-air-gap spacing further optimizing the impedance matching between said oscillating medium and air of said ambient medium, for maximum acoustic energy exchange between the two media;

(d) air oscillating in said outer-air-gap spacing having substantially low compressibility, for further preventing excessive displacements of said oscillating medium;

(e) a flat supporting surface for supporting the device;

(f) an extension baffle of predetermined thickness extending from said sandwich configuration at predetermined angle and supporting the device in upright position on said supporting surface; and (g) said extension baffle in combination with said sandwich configuration of said outer baffles and said supporting surface forming a trihedron for controlling early reflections of effective output;

whereby, said boundary conditions of said oscillating medium are jointly determined by said inner and each said outer baffle, by each said inner and each said outer spacer, by said predetermined and variable perturbations in boundary geometry, by air in each said inner-air-gap and each said outer-air-gap spacing, by said extension baffle and said supporting surface.

11. A transducer according to claim 10 wherein said driving means comprises:

(a) an assembly of current-carrying grid of conductors secured to said antinode of each said thin films;

(b) a frame-like magnet array, flush-mounted in each said outer-baffle open area;

(c) a panel-like magnet array flush-mounted in said inner-baffle open area;

(d) said assembly of current-carrying grid of conductors being adapted to form a configuration of layered current loops, so as to maximize coupling with each said antinode, thereby producing substantially phase-coherent displacements thereof;

(e) said layered current loops being adapted to also dissipate heat generated by electric current carried by said grid of conductors, so as to minimize electric resistance variations, thereby minimizing waveform distortion of reproduced effective output;

(f) said frame-like array and panel-like array being adapted to produce a substantially uniform magnetic field within the space defined by extreme displacement amplitudes of each said antinode by forces exerted on electric current carried by said conductors; and (g) said air-sealed cavity in said oscillating medium having constant air pressure for uniform and phase-coherent forces per unit area of each said antinode.

12. An electroacoustic transducer operating in an ambient fluid comprising:

(a) three panels, of predetermined geometry, assembled as a sandwich configuration of an inner module, a first outer module and a second outer module;

(b) said inner module comprising a pair of stretched thin films, of predetermined geometry, and an inner baffle therebetween, together forming a layered oscillating medium assembly hermetically sealed to form a fluid-containing cavity, said thin films each having an asymmetrically positioned driven/radiating area, said inner baffle having a port therein, asymmetrically positioned and aligned with said driven/radiating areas of said thin films, whereby said thin films are coupled in the area defined by said port and decoupled in the remaining non-driven area defined by the solid segment of the inner baffle;

(c) a geometrical perturbation in the boundary of each of said thin films, causing two oscillating regions to be defined therein and coupled by way of said driven/radiating area;

(d) each of said outer modules comprising an outer baffle with an asymmetrically positioned port therein, aligned with said driven/radiating area, through which port said layered oscillating medium assembly is coupled with said ambient fluid in the driven/radiating area; and (e) motor means for generating generally uniform and linear forces across said driven/radiating area of said thin films.

13. A transducer of claim 12, wherein said motor means comprises:

(a) a mobile member secured to said driven/radiating area of each of said thin films; and (b) an immobile member immersed in said hermetically sealed fluid-containing cavity and in the vicinity of said driven/radiating area of each of said thin films;

whereby linear and uniform forces are exerted on said driven/radiating area from said mobile and immobile members interacting in accordance with an electrical signal and whereby there is direct coupling of the entire driven/radiating area with ambient medium.

14. A transducer of claim 12, further comprising, in any combination, at least one extension baffle movably secured, at predetermined angle, to an edge of at least one said sandwich configuration, for creating a predetermined radiation pattern of effective output.

15. A method of limiting detection of irregularities in effective output of an electroacoustic transducer operating in a fluid ambient medium, having an oscillating medium with predetermined boundary and boundary conditions defined by supporting components, said irregularities being caused by resonances of said components and resonances of said oscillating medium interacting with said ambient medium fluid, comprising the following step in the design, construction and operation of said transducer:

(a) deriving a high density of intrinsic normal modes concurrently participating in the process of reproducing a stimulus;

(b) said stimulus being applied on a predetermined section of said oscillating medium coincident with an antinode of a predetermined normal mode pattern; and (c) said section being asymmetrically positioned and substantially adjacent to said boundary of said oscillating medium.

16. A method of claim 15, further comprising:

(a) increasing the density of normal modes by altering boundary conditions of the oscillation medium, so as to produce an effective spectrum with resonance frequencies so dense that they are difficult to discern;

(b) screening out irregularities in effective output in the low frequency range by further altering boundary conditions of the oscillating medium, thereby limiting occurrences of irregularities by eliminating the effect of all resonance frequencies at and below the resonance frequency associated with a predetermined normal mode of oscillation; and (c) limiting irregularities caused by said supporting components by shifting characteristic frequencies thereof, with respect to each other, so as to derive destructive interference of resonances.

17. A method of claim 16, further comprising:

(a) optimizing the exchange of energy between oscillating and ambient medium by incorporating in the oscillating medium a component with impedance matching the impedance of said ambient medium;

(b) limiting interference of ambient medium with the process of reproducing said stimulus by said oscillating medium;

(c) limiting the effective output distortions in reproducing said stimulus on said antinode of the oscillating medium by way of exerting linear and phase-coherent forces per unit area of oscillating medium;

(d) limiting the interference of a structure driving said oscillating medium with the process of reproducing a stimulus applied on the oscillating medium; and (e) controlling early reflections of the reproduced effective output;

whereby, said electroacoustic transducer will accurately and efficiently reproduce the spectrum of a stimulus applied thereupon.

18. An electroacoustic transducer for audio reproduction having components for adjustment of operating parameters to produce smooth frequency response with balanced output over a selected range of the audio spectrum, comprising:

(a) a frame for an oscillating medium;

(b) an oscillating medium mounted in said frame for oscillatory motion;

(c) means for driving said oscillating medium in response to an audio stimulus, asymmetrically applied with respect to boundary of said oscillating medium;

(d) said components comprising at least three clamps applied at specific areas on the periphery of the oscillating medium to increase the density of modes of vibration;

(e) one of said clamps being set to restrain movement of the oscillating medium at its periphery to multiply the number of natural mode patterns and associated characteristic frequencies by increasing the number of superposed standing waves generated by the driven area of the oscillating medium;

(f) a second of said clamps being variably positionable across the width of said oscillating medium near to the driven area, so as to fine tune the interlacing of characteristic frequencies in the frequency domain by shifting the high frequency end of the selected range; and (g) a third of said clamps being variably positionable across the width of said oscillating medium distant from the driven area, so as to fine tune the interlacing of characteristic frequencies in the frequency domain by shifting the low frequency end of the selected range;

whereby said oscillating medium of said electroacoustic transducer will limit perception of resonance-antiresonance irregularities in effective output, caused by the intrinsic normal modes of oscillation of the oscillating medium.

19. A transducer of claim 18, wherein said oscillating medium comprises a thin film.

20. A transducer of claim 18, wherein said oscillating medium comprises a pair of thin films hermetically sealed to form a cavity with air entrapped therein.

* * * * *